US011007781B2

(12) United States Patent
Nishimura

(10) Patent No.: US 11,007,781 B2
(45) **Date of Patent: *May 18, 2021**

(54) PRINTHEAD HAVING ONE OR TWO NOZZLE ROWS THAT JET AT LEAST EIGHT DIFFERENT TYPES OF PRINT FLUIDS

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/796,477

(22) Filed: Feb. 20, 2020

(65) Prior Publication Data

US 2020/0290351 A1 Sep. 17, 2020

Related U.S. Application Data

(63) Continuation-in-part of application No. 16/351,065, filed on Mar. 12, 2019, now Pat. No. 10,857,797.

(51) Int. Cl.
*B41J 2/14* (2006.01)
*B41J 2/21* (2006.01)

(52) U.S. Cl.
CPC ..... *B41J 2/1433* (2013.01); *B41J 2/14201* (2013.01); *B41J 2/2103* (2013.01); *B41J 2002/14419* (2013.01)

(58) Field of Classification Search
CPC ..... B41J 2/14201; B41J 2/2103; B41J 2/1433
See application file for complete search history.

(56) References Cited

U.S. PATENT DOCUMENTS 10,857,797 B2 * 12/2020 Nishimura ..... B41J 2/145

* cited by examiner

*Primary Examiner* — Lamson D Nguyen
(74) *Attorney, Agent, or Firm* — Duft & Bornsen, PC

(57) ABSTRACT

Printheads for a jetting apparatus. In one embodiment, a printhead includes inlet ports each configured to receive one of eight or more types of print fluids, and a plurality of nozzles arranged in one or two nozzle rows. Each of the nozzles is fluidly coupled to one of the inlet ports. In groupings of eight or more adjacent nozzles of the plurality, the adjacent nozzles are each configured to jet a different one of the types of print fluids.

20 Claims, 42 Drawing Sheets

PRINTHEAD HAVING ONE OR TWO NOZZLE ROWS THAT JET AT LEAST EIGHT DIFFERENT TYPES OF PRINT FLUIDS

RELATED APPLICATIONS

This non-provisional patent application is a continuation-in-part of U.S. patent application Ser. No. 16/351,065 filed on Mar. 12, 2019, which is incorporated herein by reference.

TECHNICAL FIELD

The following disclosure relates to the field of image formation, and in particular, to printheads.

BACKGROUND

Image formation is a procedure whereby a digital image is recreated on a medium by propelling droplets of ink or another type of print fluid onto the medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and a diaphragm that is driven by an actuator, such as a piezoelectric actuator. A printhead also includes a drive circuit that controls when each individual jetting channel fires based on image data. To jet from a jetting channel, the drive circuit provides a jetting pulse to the actuator, which causes the actuator to deform a wall of the pressure chamber via the diaphragm. The deformation of the pressure chamber creates pressure waves within the pressure chamber that eject a droplet of print fluid (e.g., ink) out of the nozzle.

SUMMARY

Embodiments described herein include a printhead having a single row of nozzles or two rows of nozzles in close proximity, where the nozzles in a row are configured to jet different types of print fluid. In a conventional printhead, each nozzle in a row jets the same type of print fluid, such as the same color of ink. As described herein, nozzles in a single row are able to jet eight (or more) different types of print fluid, and nozzles in two rows are able to jet four (or more) different types of print fluid. Being able to jet eight or more different types of print fluid in a single row of nozzles, or in two rows of nozzles in close proximity, allows more flexibility in how the printhead is used, such as for printing on cylindrical mediums or other non-planar surfaces.

One embodiment comprises a printhead that includes inlet ports each configured to receive one of eight or more types of print fluids, and a plurality of nozzles arranged in one or two nozzle rows. Each of the nozzles is fluidly coupled to one of the inlet ports. In groupings of eight or more adjacent nozzles of the plurality, the adjacent nozzles are each configured to jet a different one of the types of print fluids.

In another embodiment, the printhead further comprises supply manifolds disposed within the printhead. A first one of the supply manifolds is fluidly coupled to a first one of the inlet ports, and to a first subset of the nozzles. A second one of the supply manifolds is fluidly coupled to a second one of the inlet ports, and to a second subset of the nozzles. A third one of the supply manifolds is fluidly coupled to a third one of the inlet ports, and to a third subset of the nozzles. A fourth one of the supply manifolds is fluidly coupled to a fourth one of the inlet ports, and to a fourth subset of the nozzles. A fifth one of the supply manifolds is fluidly coupled to a fifth one of the inlet ports, and to a fifth subset of the nozzles. A sixth one of the supply manifolds is fluidly coupled to a sixth one of the inlet ports, and to a sixth subset of the nozzles. A seventh one of the supply manifolds is fluidly coupled to a seventh one of the inlet ports, and to a seventh subset of the nozzles. An eighth one of the supply manifolds is fluidly coupled to an eighth one of the inlet ports, and to an eighth subset of the nozzles.

In another embodiment, the nozzles are arranged longitudinally along the printhead. The first one of the supply manifolds and the third one of the supply manifolds comprise upper supply manifolds disposed longitudinally along a first side of the printhead. The second one of the supply manifolds and the fourth one of the supply manifolds comprise upper supply manifolds disposed longitudinally along a second side of the printhead.

In another embodiment, the fifth one of the supply manifolds and the seventh one of the supply manifolds comprise lower supply manifolds disposed longitudinally along the first side of the printhead. The sixth one of the supply manifolds and the eighth one of the supply manifolds comprise lower supply manifolds disposed longitudinally along the second side of the printhead.

In another embodiment, the first one of the supply manifolds and the fifth one of the supply manifolds are vertically aligned on the first side of the printhead, the third one of the supply manifolds and the seventh one of the supply manifolds are vertically aligned on the first side of the printhead, the second one of the supply manifolds and the sixth one of the supply manifolds are vertically aligned on the second side of the printhead, and the fourth one of the supply manifolds and the eighth one of the supply manifolds are vertically aligned on the second side of the printhead.

In another embodiment, the nozzles are arranged in two nozzle rows, and the nozzles in a first one of the nozzle rows are offset from the nozzles in a second one of the nozzle rows.

In another embodiment, the types of print fluids comprise different colors of ink, and the adjacent nozzles in the groupings are each configured to jet a different color of ink.

Another embodiment comprises a housing having inlet ports disposed at a top surface, and a plate stack attached to an interface surface of the housing. The plate stack includes a diaphragm plate that forms diaphragms for jetting channels of the printhead, an upper restrictor plate, an upper chamber plate, a lower restrictor plate, a lower chamber plate, and a nozzle plate having nozzles arranged in one or two nozzle rows for the jetting channels. The housing and the plate stack form a first upper supply manifold fluidly coupled to a first one of the inlet ports and a first subset of the jetting channels, a second upper supply manifold fluidly coupled to a second one of the inlet ports and a second subset of the jetting channels, a third upper supply manifold fluidly coupled to a third one of the inlet ports and a third subset of the jetting channels, and a fourth upper supply manifold fluidly coupled to a fourth one of the inlet ports and a fourth subset of the jetting channels. The housing and the plate stack form a first lower supply manifold fluidly coupled to a fifth one of the inlet ports and a fifth subset of the jetting channels, a second lower supply manifold fluidly coupled to a sixth one of the inlet ports and a sixth subset of the jetting channels, a third lower supply manifold fluidly coupled to a seventh one of the inlet ports and a seventh subset of the jetting channels, and a fourth lower supply manifold fluidly coupled to an eighth one of the inlet ports and an eighth subset of the jetting channels.

In another embodiment, the nozzles are arranged longitudinally along the printhead. The first upper supply manifold, the third upper supply manifold, the first lower supply manifold, and the third lower supply manifold are disposed longitudinally along a first side of the printhead. The second upper supply manifold, the fourth upper supply manifold, the second lower supply manifold, and the fourth lower supply manifold are disposed longitudinally along a second side of the printhead.

In another embodiment, the housing includes an access hole that extends from the interface surface through to the top surface, and manifold ducts disposed longitudinally along the interface surface on opposite sides of the access hole. A first one of the manifold ducts is disposed along a first side of the access hole, and forms the first upper supply manifold. A second one of the manifold ducts is disposed along a second side of the access hole, and forms the second upper supply manifold. A third one of the manifold ducts is disposed along the first side of the access hole in parallel with the first one of the manifold ducts, and forms the third upper supply manifold. A fourth one of the manifold ducts is disposed along the second side of the access hole in parallel with the second one of the manifold ducts, and forms the fourth upper supply manifold.

In another embodiment, the diaphragm plate includes first manifold openings fluidly coupled with the first one of the manifold ducts, second manifold openings fluidly coupled with the second one of the manifold ducts, third manifold openings fluidly coupled with the third one of the manifold ducts, and fourth manifold openings fluidly coupled with the fourth one of the manifold ducts. The diaphragm plate further includes port extension openings each fluidly coupled to one of the inlet ports.

In another embodiment, the upper restrictor plate includes restrictor openings for the first subset of the jetting channels, the second subset of the jetting channels, the third subset of the jetting channels, the fourth subset of the jetting channels, the seventh subset of the jetting channels, and the eighth subset of the jetting channels. The upper restrictor plate further includes chamber openings for the fifth subset of the jetting channels, and the sixth subset of the jetting channels. The upper restrictor plate further includes port extension openings that coincide with the port extension openings of the diaphragm plate.

In another embodiment, the upper chamber plate includes chamber openings for each of the subsets of the jetting channels, and port extension openings that coincide with the port extension openings of the upper restrictor plate.

In another embodiment, the lower restrictor plate includes restrictor openings for the fifth subset of the jetting channels, and the sixth subset of the jetting channels. The lower restrictor plate further includes chamber openings for the first subset of the jetting channels, the second subset of the jetting channels, the third subset of the jetting channels, the fourth subset of the jetting channels, the seventh subset of the jetting channels, and the eighth subset of the jetting channels. The lower restrictor plate further includes port extension openings that coincide with the port extension openings of the upper chamber plate.

In another embodiment, the lower chamber plate includes chamber openings for each of the subsets of the jetting channels, and manifold openings disposed longitudinally. A first one of the manifold openings is disposed along a first side of the chamber openings, and forms the first lower supply manifold. A second one of the manifold openings is disposed along a second side of the chamber openings, and forms the second lower supply manifold. A third one of the manifold openings is disposed along the first side of the chamber openings in parallel with the first one of the manifold openings, and forms the third lower supply manifold. A fourth one of the manifold openings is disposed along the second side of the chamber openings in parallel with the second one of the manifold openings, and forms the fourth lower supply manifold.

Another embodiment comprises a printhead that includes inlet ports each configured to receive one of eight or more types of print fluids, and a plurality of nozzles arranged in one or two nozzle rows. Each of the nozzles is fluidly coupled to one of the inlet ports. The printhead further includes supply manifolds, that include a first upper supply manifold fluidly coupled to a first one of the inlet ports and a first subset of the nozzles, a second upper supply manifold fluidly coupled to a second one of the inlet ports and a second subset of the nozzles, a third upper supply manifold fluidly coupled to a third one of the inlet ports and a third subset of the nozzles, and a fourth upper supply manifold fluidly coupled to a fourth one of the inlet ports and a fourth subset of the nozzles. The supply manifolds further include a first lower supply manifold fluidly coupled to a fifth one of the inlet ports and a fifth subset of the nozzles, a second lower supply manifold fluidly coupled to a sixth one of the inlet ports and a sixth subset of the nozzles, a third lower supply manifold fluidly coupled to a seventh one of the inlet ports and a seventh subset of the nozzles, and a fourth lower supply manifold fluidly coupled to an eighth one of the inlet ports and an eighth subset of the nozzles.

In another embodiment, the first upper supply manifold is disposed longitudinally along a first side of the nozzles within a first half section of the printhead, the third upper supply manifold is disposed longitudinally along the first side within a second half section of the printhead, and the first upper supply manifold and the third upper supply manifold are longitudinally aligned along the first side. The second upper supply manifold is disposed longitudinally along a second side of the nozzles within the first half section of the printhead, the fourth upper supply manifold is disposed longitudinally along the second side within the second half section of the printhead, and the second upper supply manifolds and the fourth upper supply manifold are longitudinally aligned along the second side.

In another embodiment, the first lower supply manifold is disposed longitudinally along the first side of the nozzles within the first half section of the printhead, the third lower supply manifold is disposed longitudinally along the first side within the second half section of the printhead, and the first lower supply manifold and the third lower supply manifold are longitudinally aligned along the first side. The second lower supply manifold is disposed longitudinally along the second side of the nozzles within the first half section of the printhead, the fourth lower supply manifold is disposed longitudinally along the second side within the second half section of the printhead, and the second lower supply manifolds and the fourth lower supply manifold are longitudinally aligned along the second side.

In another embodiment, the first upper supply manifold and the first lower supply manifold are vertically aligned within the first half section, the second upper supply manifold and the second lower supply manifold are vertically aligned within the first half section, the third upper supply manifold and the third lower supply manifold are vertically aligned within the second half section, and the fourth upper supply manifold and the fourth lower supply manifold are vertically aligned within the second half section.

In another embodiment, the nozzles are arranged in a single nozzle row.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
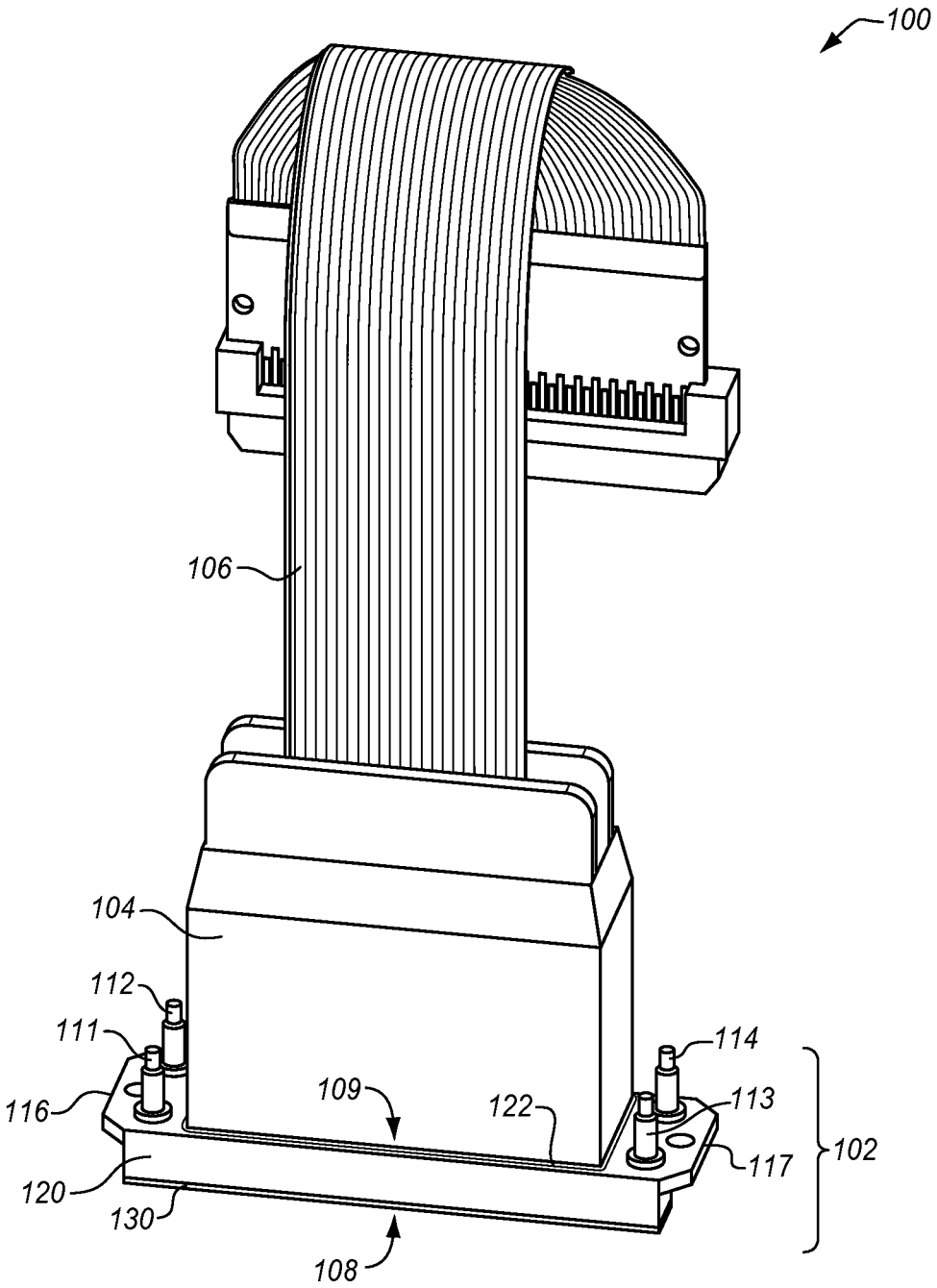
FIG. 1 is a perspective view of a printhead in an illustrative embodiment.

FIG. 1 is a perspective view of printhead 100 in an illustrative embodiment. Printhead 100 is an apparatus or device configured to jet or eject droplets of print fluids onto a medium, such as paper, plastic, card stock, transparent sheets, a substrate for 3D printing, cloth, and the like. Printhead 100 includes nozzles arranged in one or two rows so that ejection of print fluids from the nozzles causes formation of characters, symbols, images, layers of an object, etc., on the medium as printhead 100 and/or the medium are moved relative to one another. Printhead 100 includes a head member 102 and electronics 104. Head member 102 is an elongated component that forms the jetting channels of printhead 100. A typical jetting channel includes a nozzle, a pressure chamber, and a diaphragm that is driven by an actuator, such as a piezoelectric actuator. Electronics 104 control how the nozzles of printhead 100 jet droplets in response to control signals provided by a controller board. Although not visible in FIG. 1, electronics 104 include a plurality of actuators (e.g., piezoelectric actuators) that contact the diaphragms of the jetting channels. Electronics 104 also include cabling 106, such as a ribbon cable, that connects to a controller board. The controller board is configured to provide control signals to printhead 100 via cabling 106 to control jetting of the individual jetting channels, to control the temperature of printhead 100, etc.

The bottom surface 108 of head member 102 includes the nozzles of the jetting channels, and represents the discharge surface of printhead 100. The top surface 109 of head member 102 represents the input/output (I/O) portion for receiving print fluids into printhead 100 and/or conveying print fluids (e.g., fluids that are not jetted) out of printhead 100. In this embodiment, top surface 109 includes a plurality of inlet ports 111-114 that receive print fluids for jetting. An inlet port 111-114 comprises an opening in head member 102 that acts as an entry point for a print fluid. Inlet ports 111-114 may include a hose coupling, hose barb, etc., for coupling with a supply hose of a reservoir, a cartridge, or the like. Top surface 109 has two ends 116-117 that are separated by electronics 104. In this embodiment, inlet ports 111-112 are disposed toward end 116, and inlet ports 113-114 are disposed toward end 117.

Head member 102 includes a housing 120 and a plate stack 130. Housing 120 is a rigid member made from stainless steel or another type of material. Housing 120 includes an access hole 122 that provides a passageway for electronics 104 to pass through housing 120 so that actuators may interface with diaphragms of the jetting channels. Plate stack 130 attaches to an interface surface (not visible) of housing 120. Plate stack 130 (also referred to as a laminate plate stack) is a series of plates that are fixed or bonded to one another to form a laminated stack. As described in more detail below, plate stack 130 may include the following plates: one or more nozzle plates, one or more chamber plates, one or more restrictor plates, and a diaphragm plate. A nozzle plate includes a plurality of nozzles that are arranged in one or two rows. A chamber plate includes a plurality of openings that form the pressure chambers of the jetting channels. A restrictor plate includes a plurality of restrictors that fluidly connect the pressure chambers of the jetting channels with a supply manifold. A diaphragm plate is a sheet of a semi-flexible material that vibrates in response to actuation by an actuator (e.g., piezoelectric actuator).

Figure 2:
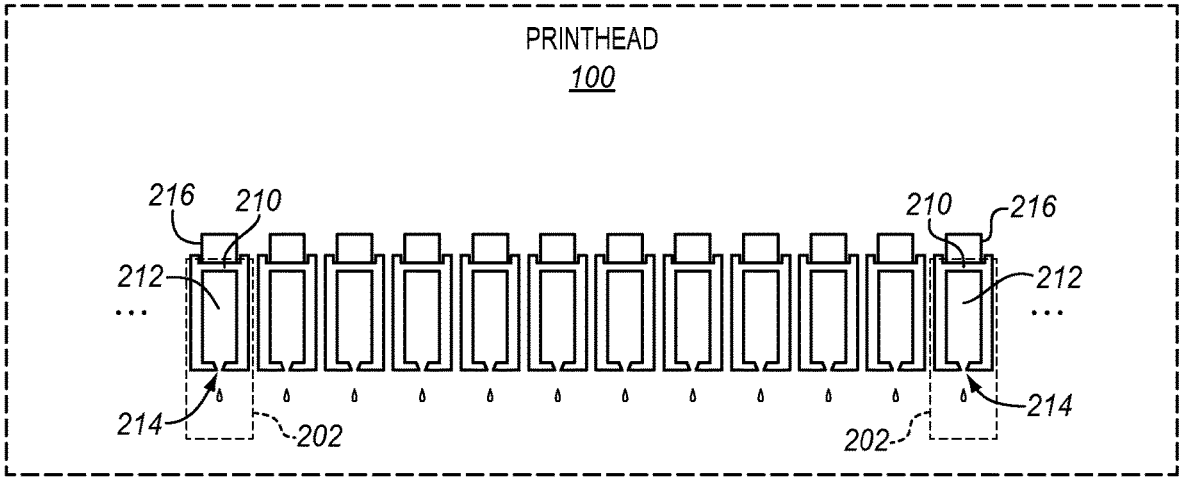
FIG. 2 is a schematic diagram of jetting channels within a printhead in an illustrative embodiment.
Figure 3:
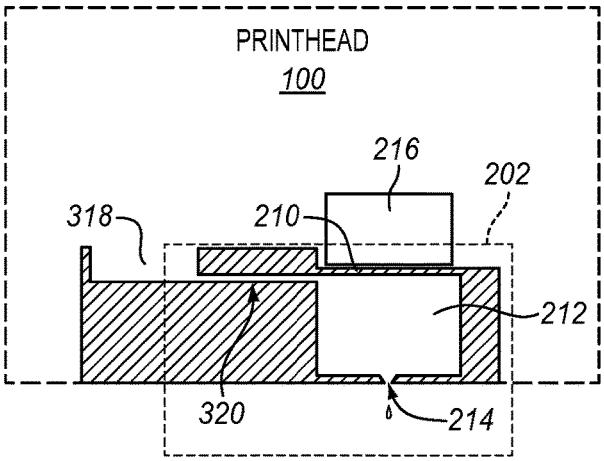
FIG. 3 is another schematic diagram of a jetting channel within a printhead in an illustrative embodiment.

FIG. 2 is a schematic diagram of jetting channels 202 within printhead 100 in an illustrative embodiment. This diagram represents a view along a length of printhead 100. A jetting channel 202 is a structural element within printhead 100 that jets or ejects a print fluid. Each jetting channel 202 includes a diaphragm 210, a pressure chamber 212, and a nozzle 214. An actuator 216 contacts diaphragm 210 to control jetting from a jetting channel 202. Jetting channels 202 may be formed in one or two rows along a length of printhead 100, and each jetting channel 202 may have a similar configuration as shown in FIG. 2. FIG. 3 is another schematic diagram of a jetting channel 202 within printhead 100 in an illustrative embodiment. This diagram represents a view across a width of a portion of printhead 100. A supply manifold 318 is configured to supply a print fluid to jetting channel 202 through a restrictor 320. Restrictor 320 fluidly couples pressure chamber 212 to supply manifold 318, and controls the flow of the print fluid into pressure chamber 212. One wall of pressure chamber 212 is formed with diaphragm 210 that physically interfaces with actuator 216. Diaphragm 210 may comprise a sheet of semi-flexible material that vibrates in response to actuation by actuator 216. The print fluid flows through pressure chamber 212 and out of nozzle 214 in the form of a droplet in response to actuation by actuator 216. Actuator 216 is configured to receive a drive waveform, and to actuate or "fire" in response to a jetting pulse on the drive waveform. Firing of actuator 216 in jetting channel 202 creates pressure waves in pressure chamber 212 that cause jetting of a droplet from nozzle 214.

Jetting channel 202 as shown in FIGS. 2-3 is an example to illustrate a basic structure of a jetting channel, such as the diaphragm, pressure chamber, and nozzle. Other types of jetting channels are also considered herein. For example, some jetting channels may have a pressure chamber having a different shape than is illustrated in FIGS. 2-3. Also, the position of supply manifold 318 and/or restrictor 320 may differ in other embodiments.

In FIG. 1, printhead 100 is configured to jet four (or more) different types of print fluids, and may be referred to as a four-color printhead. Types of print fluid may differ based on color or pigment, viscosity, density, polymers, etc. Inlet ports 111-114 are each fluidly coupled to a fluid reservoir, container, or other supply of a different type of print fluid. For example, inlet ports 111-114 may be fluidly coupled to cyan (C), magenta (M), yellow (Y), and black (K) reservoirs, respectively. A traditional four-color printhead has four rows of nozzles, and each row of nozzles jets a single color of ink. As will be described in more detail below, printhead 100 has one or two rows of nozzles, and nozzles in a row are configured to jet different types of print fluid.

Figure 4:
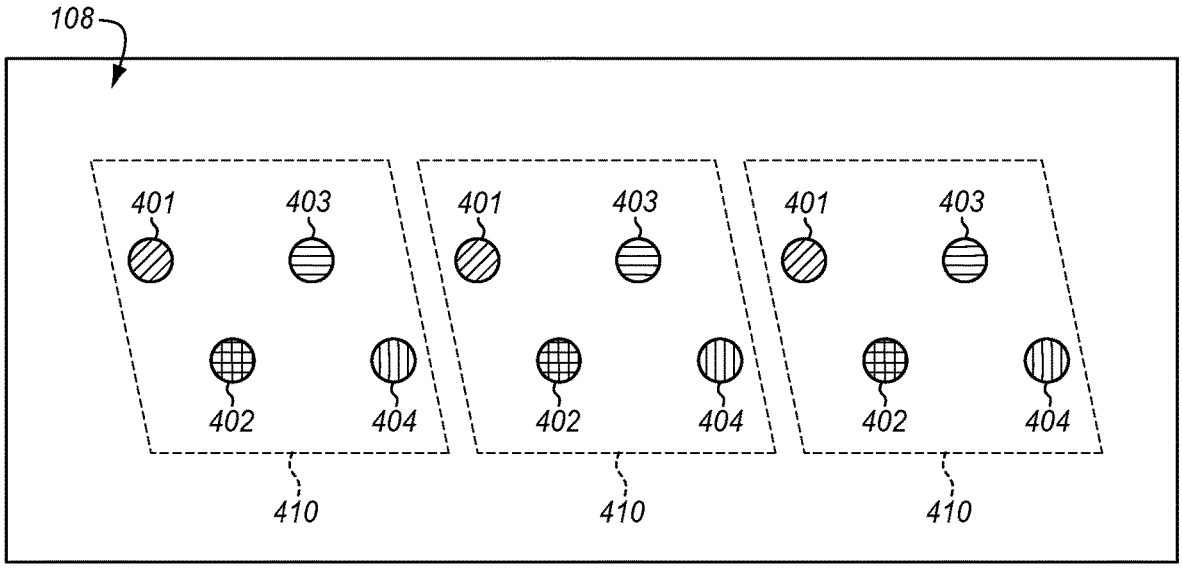
FIG. 4 is a view of a bottom surface of a printhead in an illustrative embodiment.

FIG. 4 is a view of bottom surface 108 of printhead 100 in an illustrative embodiment. In this embodiment, nozzles 401-404 of printhead 100 are arranged longitudinally into two nozzle rows, where nozzles 401-404 in adjacent nozzle rows are staggered or offset (although nozzles 401-404 may not be offset in other embodiments). Nozzles 401 are part of a jetting channel that is configured to jet a first type of print fluid (e.g., a first color), which is indicated by diagonal hashing. Nozzles 402 are part of a jetting channel that is configured to jet a second type of print fluid (e.g., a second color), which is indicated by cross hashing. Nozzles 403 are part of a jetting channel that is configured to jet a third type of print fluid (e.g., a third color), which is indicated by horizontal hashing. Nozzles 404 are part of a jetting channel that is configured to jet a fourth type of print fluid (e.g., a fourth color), which is indicated by vertical hashing. Nozzles 401-404 are arranged into groupings 410 of four adjacent nozzles. Adjacent nozzles are nozzles that are next to or neighboring one another. For instance, when nozzles 401-404 are arranged in two nozzle rows as shown in FIG. 4, one pair of adjacent nozzles are consecutive along one of the nozzle rows, and another pair of adjacent nozzles are consecutive along the other nozzle row. The pairs of nozzles are also adjacent across the nozzle rows.

With nozzles 401-404 arranged in this manner, each nozzle 401-404 in a grouping 410 is configured to jet a different type of print fluid, such as a different color of ink. For example, nozzle 401 may be configured to jet cyan (C), nozzle 402 may be configured to jet magenta (M), nozzle 403 may be configured to jet yellow (Y), and nozzle 404 may be configured to jet black (K). Thus, instead of j jetting a single color along a nozzle row as with a traditional printhead, nozzles in a nozzle row of printhead 100 are able to jet different colors. For example, the top nozzle row alternates between nozzles 401 that jet a first type of print fluid, and nozzles 403 that jet a third type of print fluid. The bottom nozzle row alternates between nozzles 402 that jet a second type of print fluid, and nozzles 404 that jet a fourth type of print fluid. FIG. 4 is provided as an example, and an actual printhead may include many more nozzles than is illustrated. Also, although two nozzle rows are shown in FIG. 4, printhead 100 may include a single nozzle row in other embodiments.

Figure 5:
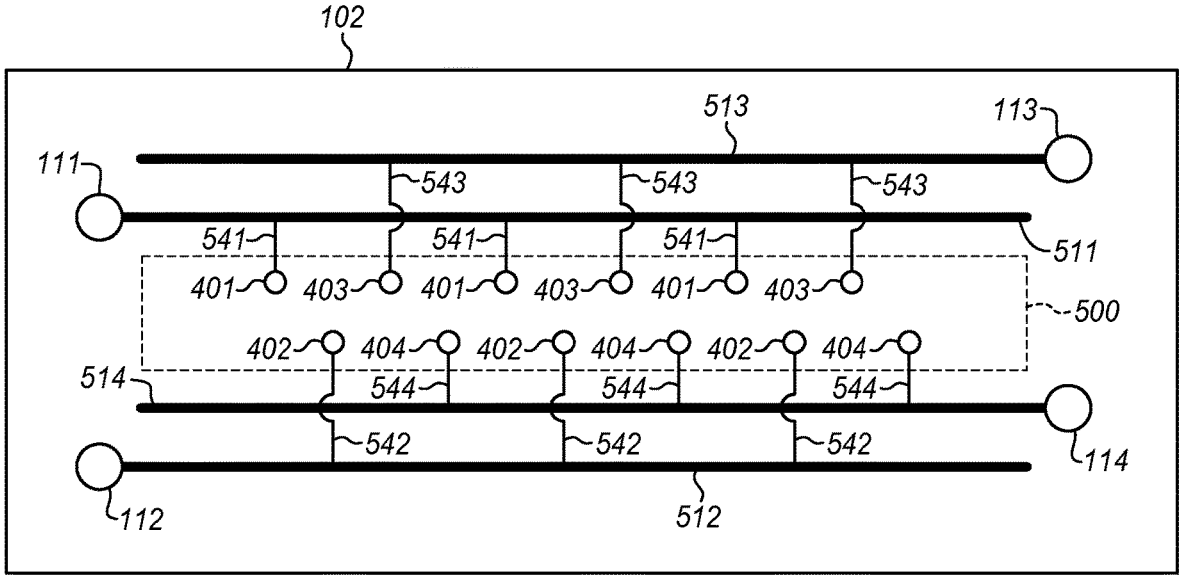
FIG. 5 is a schematic diagram of a head member in an illustrative embodiment.

In order to jet four (or more) different types of print fluids, head member 102 in FIG. 1 includes supply manifolds disposed longitudinally that each supply a print fluid to a subset of the jetting channels/nozzles. FIG. 5 is a schematic diagram of head member 102 in an illustrative embodiment. The jetting channels 500 of printhead 100 are schematically illustrated in FIG. 5 as nozzles in two nozzle rows. Although the nozzles are shown as staggered in FIG. 5, the nozzles in the two nozzle rows may be aligned in other embodiments. Head member 102 includes supply manifolds 511-514 that are disposed longitudinally. A supply manifold is a groove, duct, conduit, etc., within head member 102 that is configured to convey a print fluid to jetting channels. Supply manifold 511 is fluidly coupled to inlet port 111, and is also fluidly coupled to a subset of the jetting channels 500 indicated by nozzles 401 via fluid path 541. Thus, when a first print fluid (e.g., a first color of ink) is supplied to inlet port 111, supply manifold 511 receives the first print fluid and supplies the first print fluid to the subset of jetting channels for nozzles 401. Supply manifold 512 is fluidly coupled to inlet port 112, and is also fluidly coupled to a subset of the jetting channels 500 indicated by nozzles 402 via fluid path 542. Thus, when a second print fluid (e.g., a second color of ink) is supplied to inlet port 112, supply manifold 512 receives the second print fluid and supplies the second print fluid to the subset of jetting channels for nozzles 402. Supply manifold 513 is fluidly coupled to inlet port 113, and is also fluidly coupled to a subset of the jetting channels 500 indicated by nozzles 403 via fluid path 543. Thus, when a third print fluid (e.g., a third color of ink) is supplied to inlet port 113, supply manifold 513 receives the third print fluid and supplies the third print fluid to the subset of jetting channels for nozzles 403. Supply manifold 514 is fluidly coupled to inlet port 114, and is also fluidly coupled to a subset of the jetting channels 500 indicated by nozzles 404 via fluid path 544. Thus, when a fourth print fluid (e.g., a fourth color of ink) is supplied to inlet port 114, supply manifold 514 receives the fourth print fluid and supplies the fourth print fluid to the subset of jetting channels for nozzles 404.

Fluid paths 541-544 are provided in the form of a restrictor, which is a passageway that fluidly couples a supply manifold to a pressure chamber and prevents a backflow of print fluid. There is a different fluid path 541-544 between the nozzles 401-404 in a row, and supply manifolds 511-514. For example, nozzles 401 in the top row couple with supply manifold 511 via fluid path 541, while nozzles 403 in the same row couple with supply manifold 513 via fluid path 543. Thus, the fluid paths for the nozzles 401 and 403 in the top row alternate between supply manifold 511 and supply manifold 513. Similarly, nozzles 402 in the bottom row couple with supply manifold 512 via fluid path 542, while nozzles 404 in the same row couple with supply manifold 514 via fluid path 544. Thus, the fluid paths for the nozzles 402 and 404 in the bottom row alternate between supply manifold 512 and supply manifold 514. This allows for nozzles in the same row to jet different types of print fluid. In an example of four-color printing, supply manifold 511 may supply cyan ink to nozzles 401, and these nozzles 401 would exclusively jet cyan. Supply manifold 512 may supply a magenta ink to nozzles 402, and these nozzles 402 would exclusively jet magenta. Supply manifold 513 may supply yellow ink to nozzles 403, and these nozzles 403 would exclusively jet yellow. Supply manifold 514 may supply black ink to nozzles 404, and these nozzles 404 would exclusively jet black.

Figure 6:
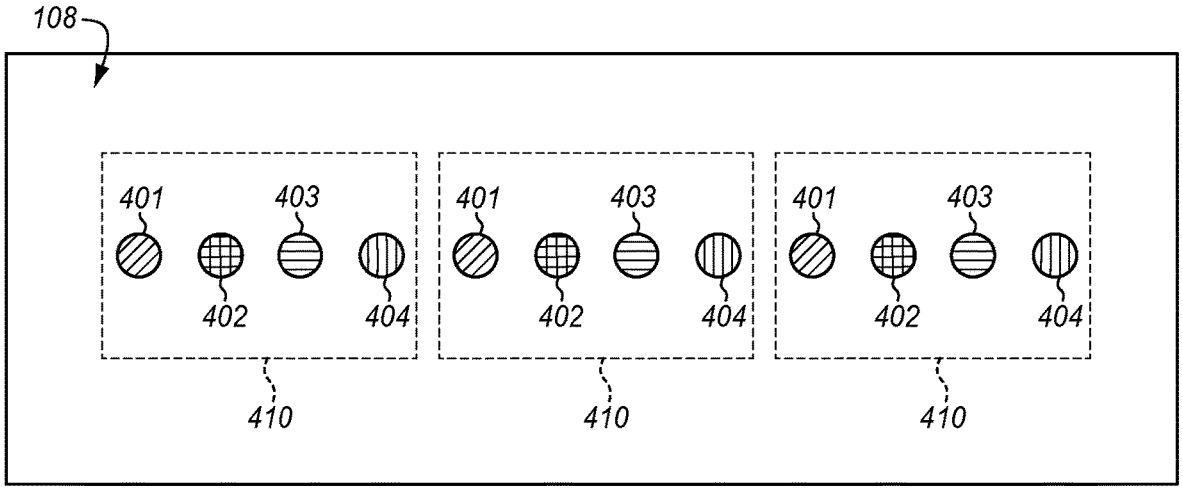
FIG. 6 is a view of a bottom surface of a printhead in another illustrative embodiment.

FIG. 6 is a view of bottom surface 108 of printhead 100 in another illustrative embodiment. In this embodiment, nozzles 401-404 of printhead 100 are arranged longitudinally into a single nozzle row. Like above, nozzles 401 are part of a jetting channel that is configured to jet a first type of print fluid (e.g., a first color). Nozzles 402 are part of a jetting channel that is configured to jet a second type of print fluid (e.g., a second color). Nozzles 403 are part of a jetting channel that is configured to jet a third type of print fluid (e.g., a third color). Nozzles 404 are part of a jetting channel that is configured to jet a fourth type of print fluid (e.g., a fourth color). Nozzles 401-404 are arranged into groupings 410 of four adjacent nozzles, where the adjacent nozzles are consecutive along the nozzle row.

With nozzles 401-404 arranged in this manner, each nozzle 401-404 in a grouping 410 is configured to jet a different type of print fluid, such as a different color of ink. For example, nozzle 401 may be configured to jet cyan (C), nozzle 402 may be configured to jet magenta (M), nozzle 403 may be configured to jet yellow (Y), and nozzle 404 may be configured to jet black (K). Thus, instead of j jetting a single color along a nozzle row as with a traditional printhead, nozzles 401-404 in the nozzle row of printhead 100 jet different colors. FIG. 6 is provided as an example, and an actual printhead may include many more nozzles than is illustrated.

Figure 7:
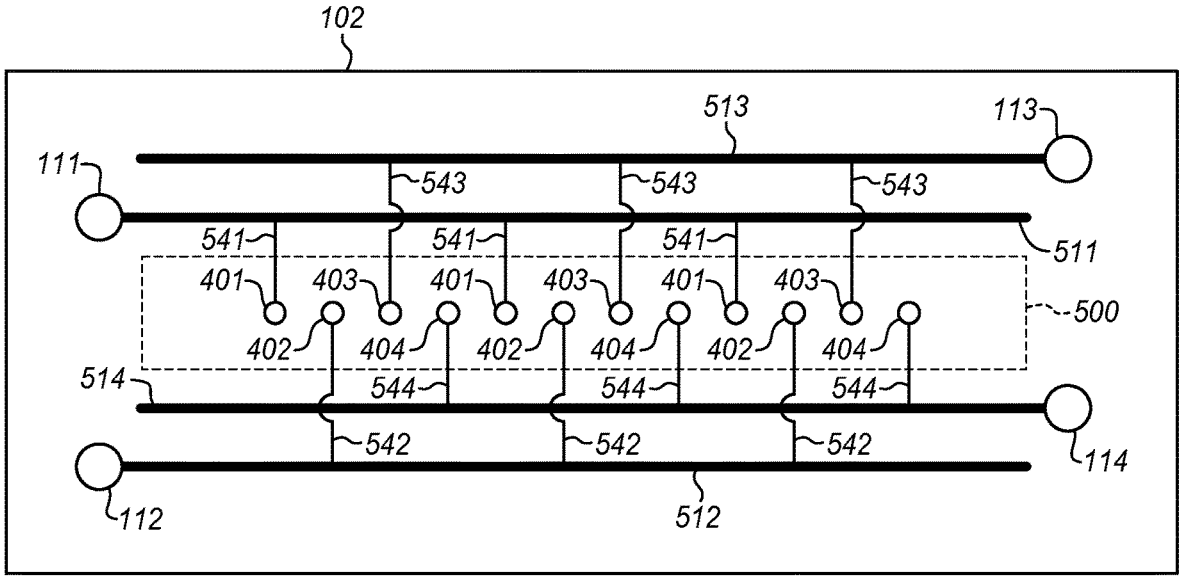
FIG. 7 is a schematic diagram of a head member in another illustrative embodiment.

FIG. 7 is a schematic diagram of head member 102 in another illustrative embodiment. The jetting channels of printhead 100 are schematically illustrated in FIG. 7 as nozzles in a single nozzle row. Head member 102 includes supply manifolds 511-514 that are disposed longitudinally. Supply manifold 511 is fluidly coupled to inlet port 111, and is also fluidly coupled to a subset of the jetting channels 500 indicated by nozzles 401 via fluid path 541. Supply manifold 512 is fluidly coupled to inlet port 112, and is also fluidly coupled to a subset of the jetting channels 500 indicated by nozzles 402 via fluid path 542. Supply manifold 513 is fluidly coupled to inlet port 113, and is also fluidly coupled to a subset of the jetting channels 500 indicated by nozzles 403 via fluid path 543. Supply manifold 514 is fluidly coupled to inlet port 114, and is also fluidly coupled to a subset of the jetting channels 500 indicated by nozzles 404 via fluid path 544.

There is a different fluid path 541-544 between the nozzles 401-404 in the single nozzle row, and supply manifolds 511-514. For example, nozzles 401 in the single nozzle row couple with supply manifold 511 via fluid path 541, nozzles 402 in the single nozzle row couple with supply manifold 512 via fluid path 542, nozzles 403 in the single nozzle row couple with supply manifold 513 via fluid path 543, and nozzles 404 in the single nozzle row couple with supply manifold 514 via fluid path 544. Thus, the fluid paths for the nozzles 401-404 in the single nozzle row switch between supply manifolds 511-514. This allows for nozzles in the same row to jet at least four different types of print fluid.

Figure 8:
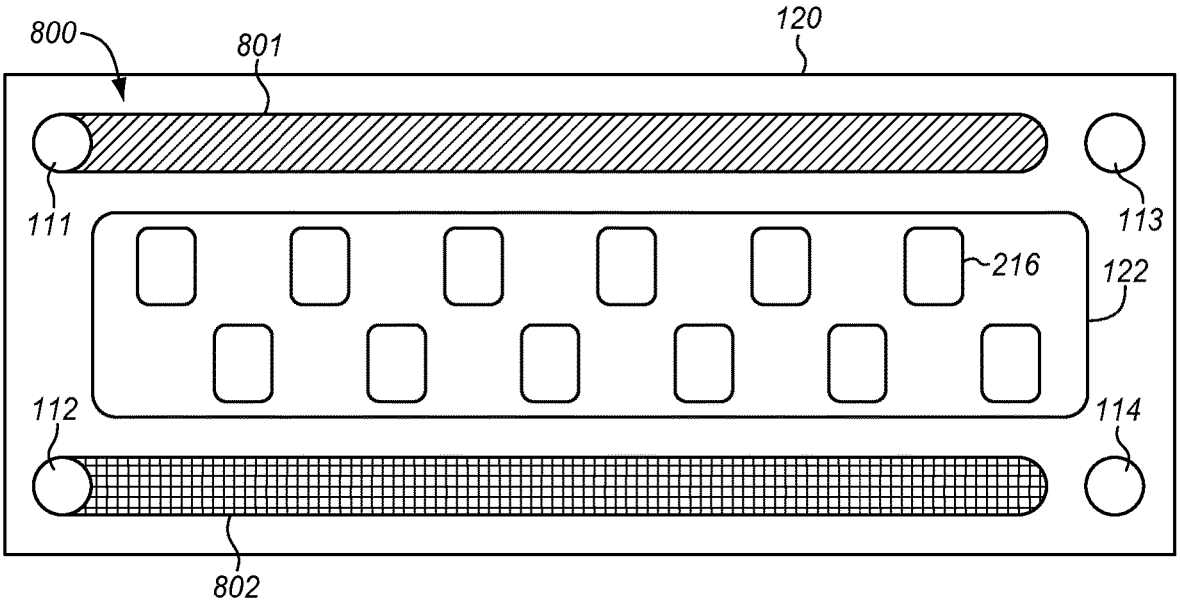
FIG. 8 is a bottom view of a housing in an illustrative embodiment.

The structure of head member 102 to form the supply manifolds, the fluid paths, the jetting channels, etc., may vary depending on desired implementations. The following embodiments set forth examples of the structure of head member 102. FIGS. 8-18 illustrate the structure of head member 102 in one illustrative embodiment. The structural elements in these figures are not drawn to scale, and are provided as an example. As an overview, head member 102 includes jetting channels for two rows of nozzles. Head member 102 also includes a pair of upper supply manifolds, and a pair of lower supply manifolds that each supply a different type of print fluid to subsets of the jetting channels. An upper supply manifold and a lower supply manifold are disposed longitudinally on one side of head member 102 (i.e., one side of the jetting channels), and the other upper supply manifold and the other lower supply manifold are disposed longitudinally on the other side of head member 102. As described above in FIG. 1, head member 102 includes a housing 120 and a plate stack 130. FIG. 8 is a bottom view of housing 120 in an illustrative embodiment. The bottom surface of housing 120 is referred to as interface surface 800, which is the surface of housing 120 that faces plate stack 130 and interfaces with plate stack 130. Housing 120 includes access hole 122 at or near its center that extends from interface surface 800 through to top surface 109 (see FIG. 1). Access hole 122 provides a passageway for actuators 216, such as a plurality of piezoelectric actuators, to pass through and interface with a diaphragm plate (shown in FIG. 9). In this embodiment, actuators 216 are arranged in two rows that are staggered.

Housing 120 also includes manifold ducts 801-802 disposed longitudinally along a length of housing 120 on interface surface 800. Manifold ducts 801-802 comprise elongated cuts or grooves along interface surface 800 configured to convey a print fluid. Manifold ducts 801-802 are fluidly coupled to inlet ports 111-112, respectively. Inlet ports 113-114 are also visible as extending through housing 120, and will be fluidly coupled to lower supply manifolds as is described in more detail below.

Figure 9:
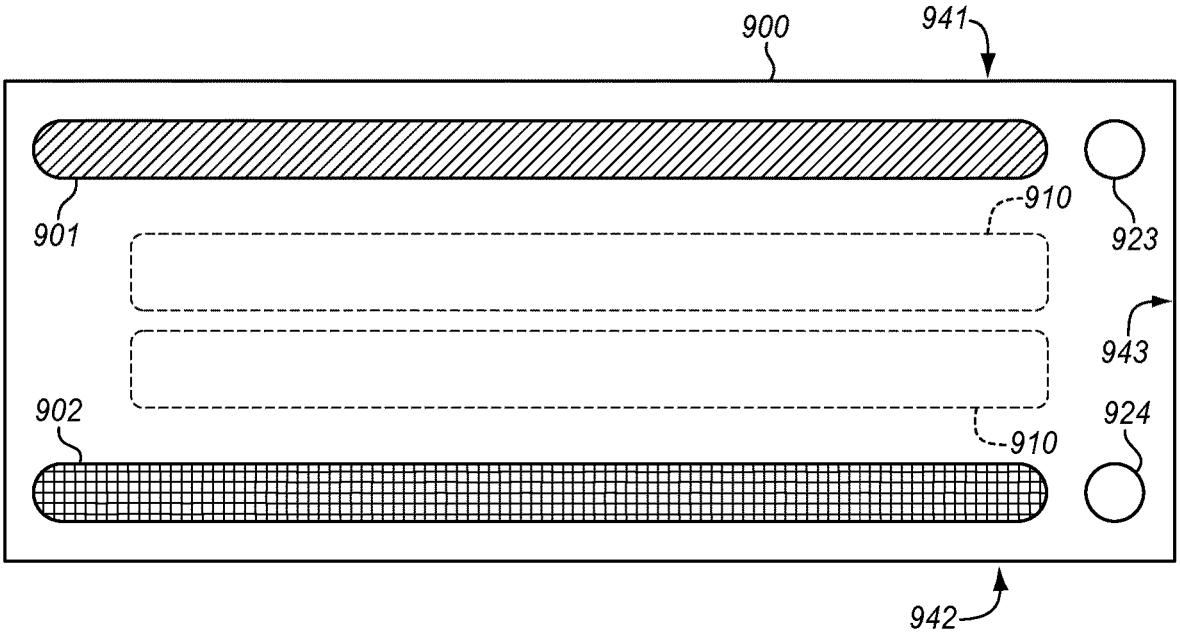
FIG. 9 is a plan view of a diaphragm plate in an illustrative embodiment.

FIGS. 9-13 show one example of plate stack 130 that includes a diaphragm plate, an upper restrictor plate, a lower restrictor plate, a chamber plate, and a nozzle plate. FIG. 9 is a plan view of a diaphragm plate 900 in an illustrative embodiment. Diaphragm plate 900 is a thin sheet of material (e.g., metal, plastic, etc.) that is generally rectangular in shape and is substantially flat or planar. Diaphragm plate 900 includes diaphragm sections 910 comprising a semi-flexible material that forms diaphragms for the jetting channels. Diaphragm plate 900 further includes manifold openings 901-902, which comprise elongated apertures or holes through diaphragm plate 900 disposed longitudinally along a length of diaphragm plate 900. Manifold openings 901-902 are disposed toward the long sides 941-942 of diaphragm plate 900 on opposing sides of diaphragm sections 910 to coincide with manifold ducts 801-802 of housing 120 and to form the upper supply manifolds (e.g., supply manifolds 511-512) of head member 102. Diaphragm plate 900 also includes port extension openings 923-924 that coincide with inlet ports 113-114, respectively, of housing 120. Port extension openings 923-924 may be disposed toward an end 943 of diaphragm plate 900.

Figure 10:
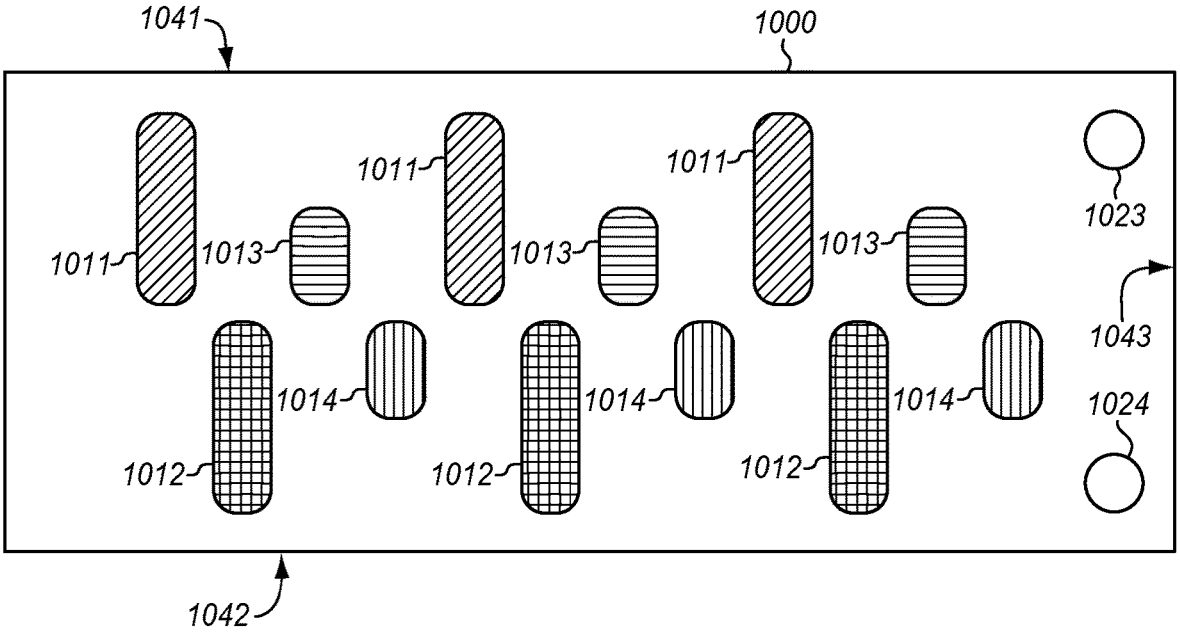
FIG. 10 is a plan view of an upper restrictor plate in an illustrative embodiment.

FIG. 10 is a plan view of upper restrictor plate 1000 in an illustrative embodiment. Upper restrictor plate 1000 is a thin sheet of material that is generally rectangular in shape and is substantially flat or planar. Upper restrictor plate 1000 includes restrictor openings 1011-1012. Restrictor openings 1011-1012 comprise elongated apertures or holes through upper restrictor plate 1000 transversely disposed or oriented. Restrictor openings 1011-1012 are configured to fluidly couple pressure chambers of jetting channels (for nozzles 401-402) with manifold openings 901-902, respectively. Restrictor openings 1011-1012 are formed in two rows (i.e., a top row and a bottom row), with restrictor openings 1011 in one row and restrictor openings 1012 in the other row and offset or staggered in relation to one another. Upper restrictor plate 1000 further includes chamber openings 1013-1014 toward a middle region of upper restrictor plate 1000. Chamber openings 1013-1014 comprise apertures or holes through upper restrictor plate 1000 that form pressure chambers for a portion of the jetting channels (i.e., the jetting channels for nozzles 403-404). Chamber openings 1013-1014 do not extend transversely as far as restrictor openings 1011-1012 toward the long sides 1041-1042 of upper restrictor plate 1000, and therefore are not fluidly coupled to manifold openings 901-902. Chamber openings 1013-1014 are formed in two rows, with chamber openings 1013 in one row and chamber openings 1014 in the other row that are offset or staggered in relation to one another. Restrictor openings 1011 alternate with chamber openings 1013 in the top row, and restrictor openings 1012 alternate with chamber openings 1014 in the bottom row. Upper restrictor plate 1000 also includes port extension openings 1023-1024 that coincide with port extension openings 923-924, respectively, of diaphragm plate 900. Port extension openings 1023-1024 may be disposed toward an end 1043 of upper restrictor plate 1000.

Figure 11:
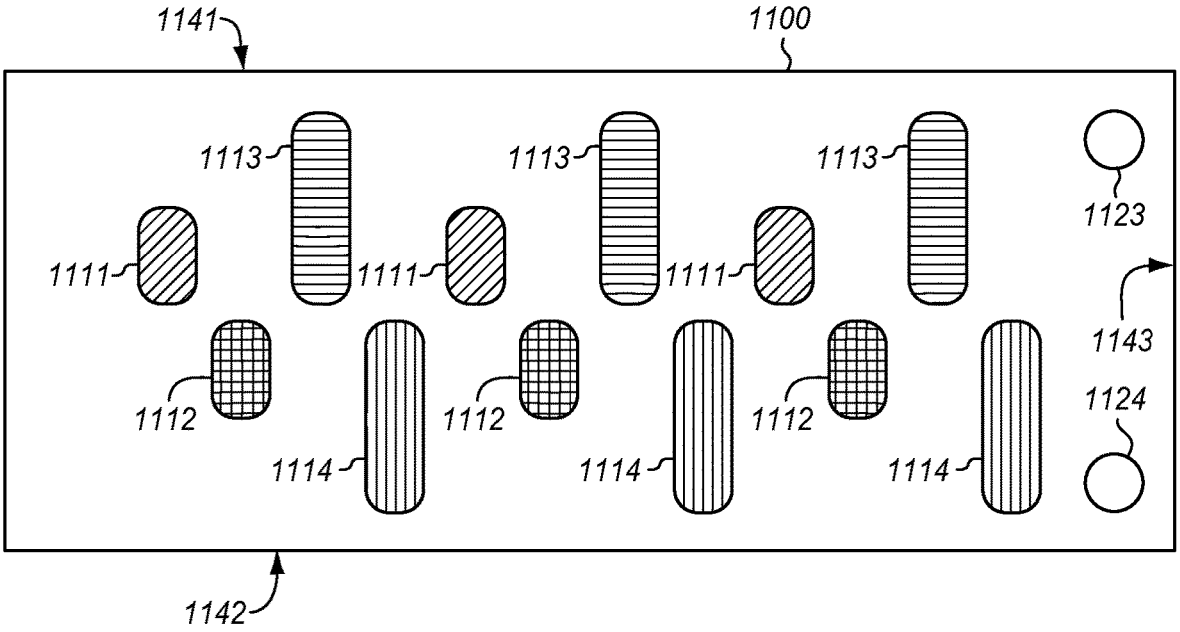
FIG. 11 is a plan view of a lower restrictor plate in an illustrative embodiment.

FIG. 11 is a plan view of lower restrictor plate 1100 in an illustrative embodiment. Lower restrictor plate 1100 is a thin sheet of material that is generally rectangular in shape and is substantially flat or planar. Lower restrictor plate 1100 includes restrictor openings 1113-1114. Restrictor openings 1113-1114 comprise elongated apertures or holes through lower restrictor plate 1100 transversely disposed or oriented. Restrictor openings 1113-1114 are configured to fluidly couple pressure chambers of jetting channels (for nozzles 403-404) with manifold openings of the chamber plate (see FIG. 12). Restrictor openings 1113-1114 are formed in two rows (i.e., a top row and a bottom row), with restrictor openings 1113 in one row and restrictor openings 1114 in the other row and offset or staggered in relation to one another. Lower restrictor plate 1100 further includes chamber openings 1111-1112 toward a middle region of lower restrictor plate 1100. Chamber openings 1111-1112 comprise apertures or holes through lower restrictor plate 1100 that form pressure chambers for a portion of the jetting channels (i.e., the jetting channels for nozzles 401-402). Chamber openings 1111-1112 do not extend transversely as far as restrictor openings 1113-1114 toward the long sides 1141-1142 of lower restrictor plate 1100, and therefore are not fluidly coupled to the manifold openings of the chamber plate. Chamber openings 1111-1112 are formed in two rows, with chamber openings 1111 in one row and chamber openings 1112 in the other row that are offset or staggered in relation to one another. Restrictor openings 1113 alternate with chamber openings 1111 in the top row, and restrictor openings 1114 alternate with chamber openings 1112 in the bottom row. Lower restrictor plate 1100 also includes port extension openings 1123-1124 that coincide with port extension openings 1023-1024, respectively, of upper restrictor plate 1000. Port extension openings 1123-1124 may be disposed toward an end 1143 of lower restrictor plate 1100.

Figure 12:
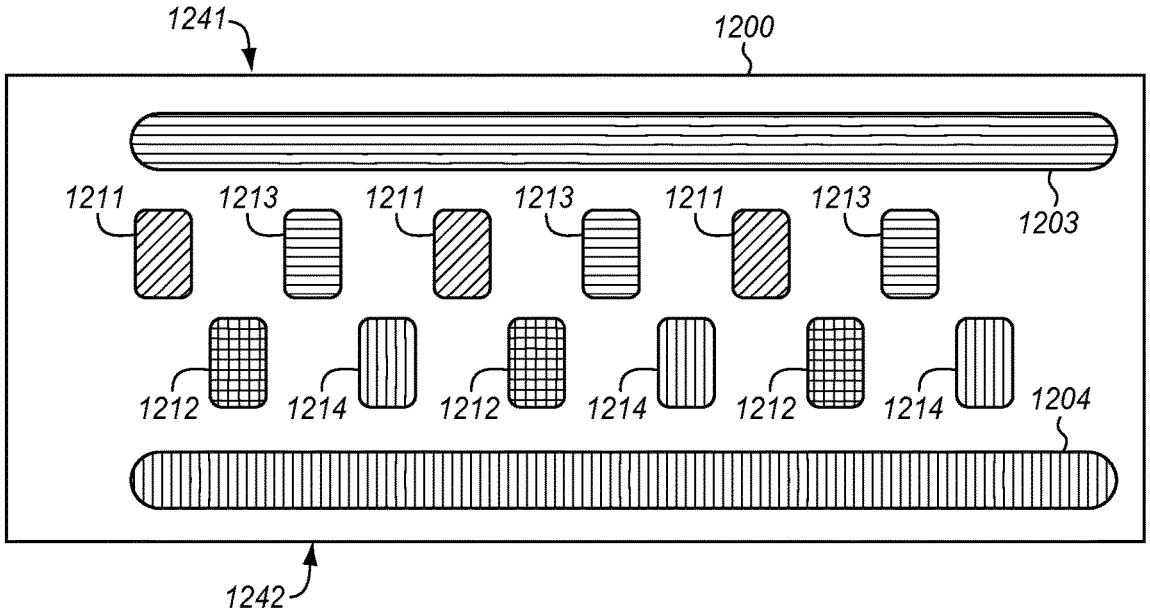
FIG. 12 is a plan view of a chamber plate in an illustrative embodiment.

FIG. 12 is a plan view of chamber plate 1200 in an illustrative embodiment. Chamber plate 1200 is a thin sheet of material that is generally rectangular in shape and is substantially flat or planar. Chamber plate 1200 includes chamber openings 1211-1214 disposed toward a middle region of chamber plate 1200. Chamber openings 1211-1214 comprise apertures or holes through chamber plate 1200 that form pressure chambers for the jetting channels. Chamber openings 1211-1214 are aligned in two longitudinal rows that are staggered. Chamber plate 1200 further includes manifold openings 1203-1204, which comprise elongated apertures or holes through chamber plate 1200 disposed longitudinally along a length of chamber plate 1200. Manifold openings 1203-1204 are disposed toward the long sides 1241-1242 of chamber plate 1200 on opposing sides of chamber openings 1211-1214 to form the lower supply manifolds (e.g., supply manifolds 513-514) of head member 102. Although one chamber plate 1200 is illustrated, there may be multiple chamber plates 1200 used to form the pressure chambers and lower supply manifolds. Looking back to FIG. 11, restrictor openings 1113-1114 are configured to fluidly couple pressure chambers of jetting channels (for nozzles 403-404) with manifold openings 1203-1204, respectively.

Figure 13:
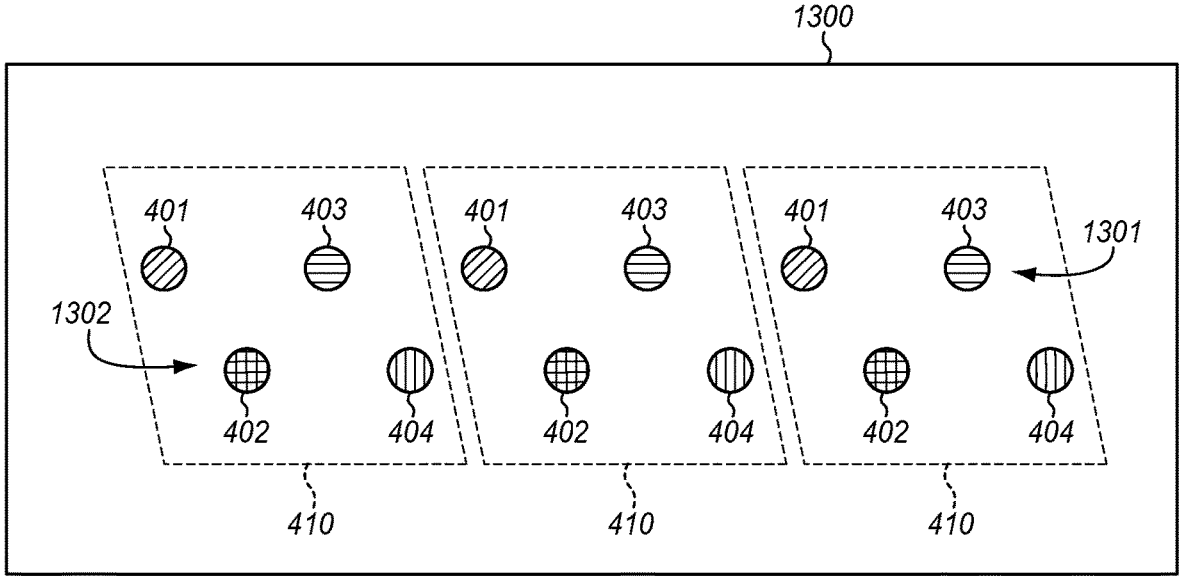
FIG. 13 is a plan view of a nozzle plate in an illustrative embodiment.

FIG. 13 is a plan view of nozzle plate 1300 in an illustrative embodiment. Nozzle plate 1300 is a thin sheet of material that is generally rectangular in shape and is substantially flat or planar. Nozzle plate 1300 includes orifices that form nozzles 401-404 of the jetting channels. As described in FIG. 4, nozzles 401-404 are arranged in two nozzle rows 1301-1302 that are staggered or offset from one another. Nozzles 401 and 403 are in nozzle row 1301, and nozzles 402 and 404 are in nozzle row 1302. Nozzles 401-404 are arranged into groupings 410 of four adjacent nozzles, and each nozzle 401-404 in a grouping 410 is configured to jet a different type of print fluid.

Figure 14:
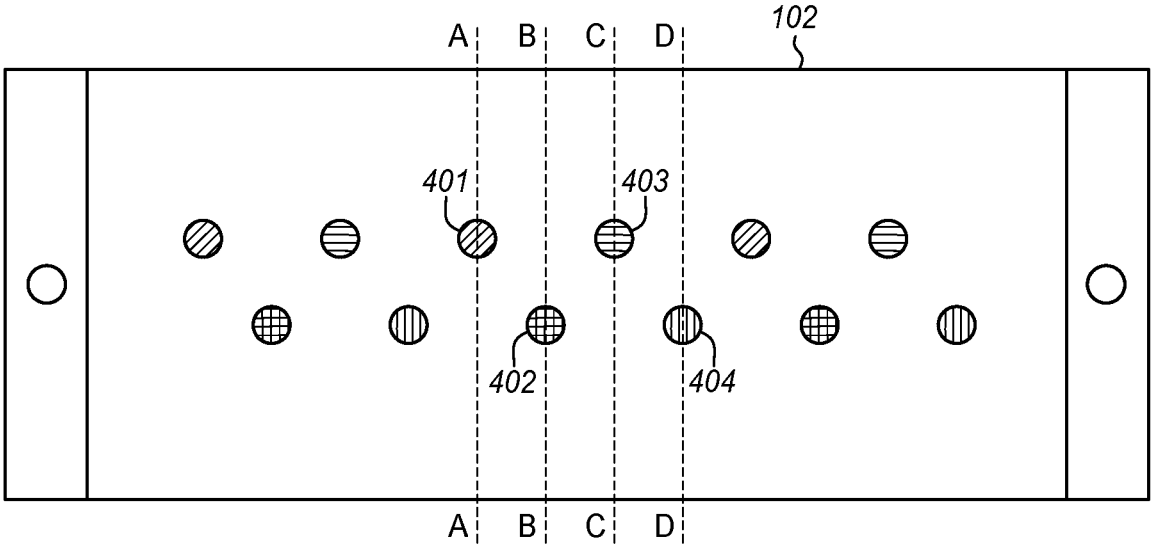
FIG. 14 is a bottom view of a head member in an illustrative embodiment.
Figure 15:
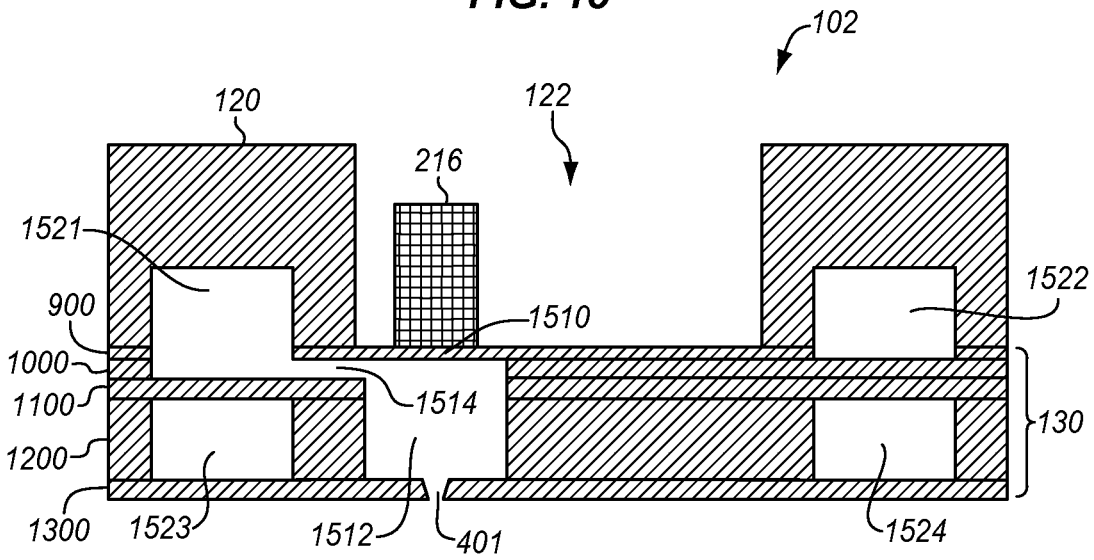
FIGS. 15-18 are cross-sectional views of a head member in an illustrative embodiment.

FIG. 14 is a bottom view of head member 102 in an illustrative embodiment. FIGS. 15-18 are cross-sectional views of head member 102 in an illustrative embodiment. The view in FIG. 15 is across cut plane A-A in FIG. 14. From top to bottom in FIG. 15, head member 102 includes housing 120, diaphragm plate 900, upper restrictor plate 1000, lower restrictor plate 1100, chamber plate 1200, and nozzle plate 1300. As is visible in FIG. 15, head member 102 includes a pair of upper supply manifolds 1521-1522 and a pair of lower supply manifolds 1523-1524. Upper supply manifold 1521 is formed with manifold duct 801 and manifold opening 901 (see FIGS. 8-9). Upper supply manifold 1522 is formed with manifold duct 802 and manifold opening 902 (see FIGS. 8-9). Lower supply manifold 1523 is formed with manifold opening 1203, and lower supply manifold 1524 is formed with manifold opening 1204 (see FIG. 12). An upper supply manifold 1521 and a lower supply manifold 1523 are disposed longitudinally on one side of head member 102 (i.e., one side of the jetting channel(s)), and the other upper supply manifold 1522 and the other lower supply manifold 1524 are disposed longitudinally on the other side of head member 102. On each side, an upper supply manifold and a lower supply manifold may be vertically aligned with one another.

Plate stack 130 forms a jetting channel for nozzle 401. The jetting channel includes diaphragm 1510, pressure chamber 1512, and nozzle 401. Pressure chamber 1512 is fluidly coupled to upper supply manifold 1521 via restrictor 1514 (formed with restrictor opening 1011 in FIG. 10). Restrictor 1514 controls the flow of print fluid from upper supply manifold 1521 to pressure chamber 1512. Actuation by actuator 216 will cause the print fluid to be ejected out of the jetting channel through nozzle 401. The jetting channel for nozzle 401 is fluidly coupled to upper supply manifold 1521, and is fluidly isolated from the other supply manifolds 1522-1524 so that it receives one type of print fluid.

Figure 16:
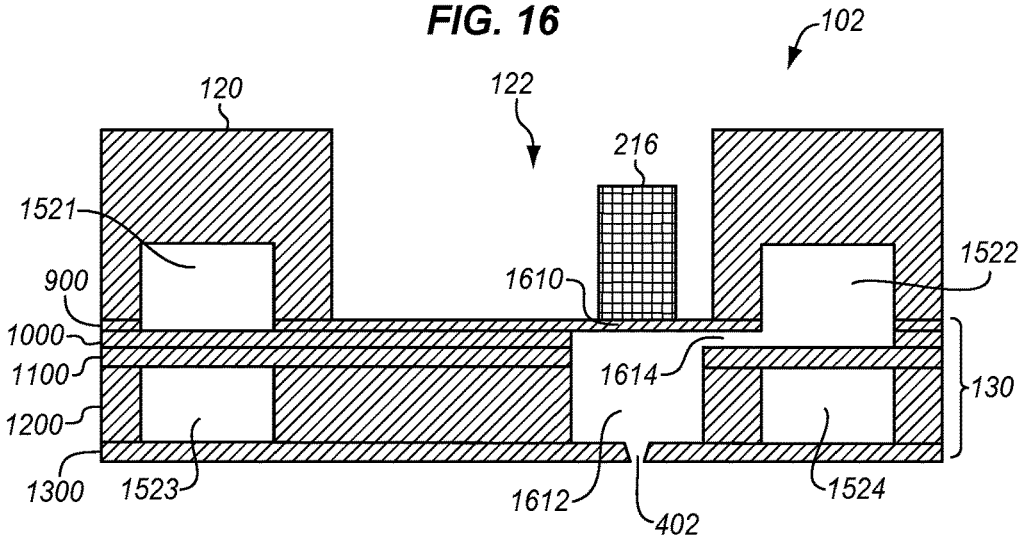

The view in FIG. 16 is across cut plane B-B in FIG. 14, showing a jetting channel for nozzle 402. The jetting channel includes diaphragm 1610, pressure chamber 1612, and nozzle 402. Pressure chamber 1612 is fluidly coupled to upper supply manifold 1522 via restrictor 1614 (formed with restrictor opening 1012 in FIG. 10). Restrictor 1614 controls the flow of print fluid from upper supply manifold 1522 to pressure chamber 1612. Actuation by actuator 216 will cause the print fluid to be ejected out of the jetting channel through nozzle 402. The jetting channel for nozzle 402 is fluidly coupled to upper supply manifold 1522, and is fluidly isolated from the other supply manifolds 1521 and 1523-1524 so that it receives one type of print fluid.

Figure 17:
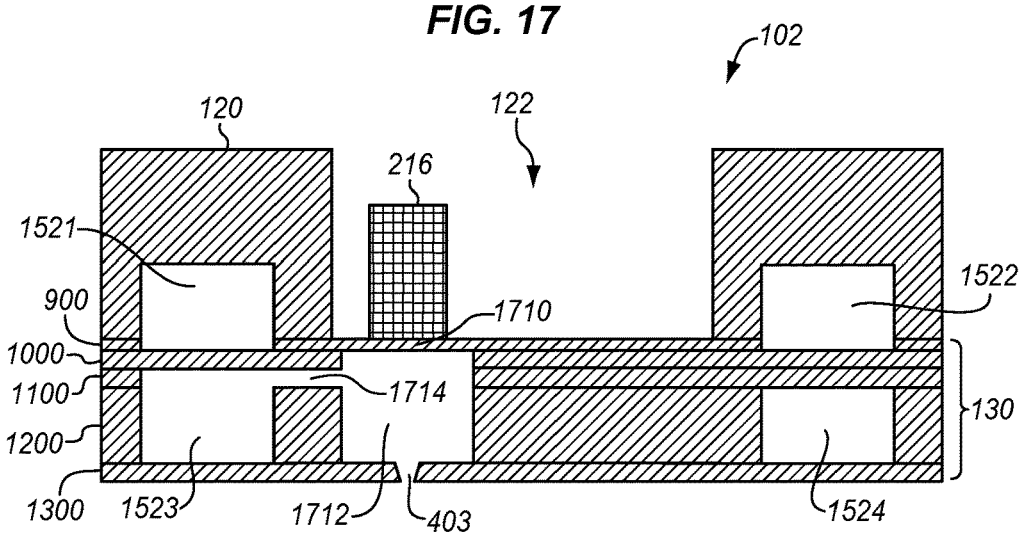

The view in FIG. 17 is across cut plane C-C in FIG. 14, showing a jetting channel for nozzle 403. The jetting channel includes diaphragm 1710, pressure chamber 1712, and nozzle 403. Pressure chamber 1712 is fluidly coupled to lower supply manifold 1523 via restrictor 1714 (formed with restrictor opening 1113 in FIG. 11). Restrictor 1714 controls the flow of print fluid from lower supply manifold 1523 to pressure chamber 1712. Actuation by actuator 216 will cause the print fluid to be ejected out of the jetting channel through nozzle 403. The jetting channel for nozzle 403 is fluidly coupled to lower supply manifold 1523, and is fluidly isolated from the other supply manifolds 1521-1522 and 1524 so that it receives one type of print fluid.

Figure 18:
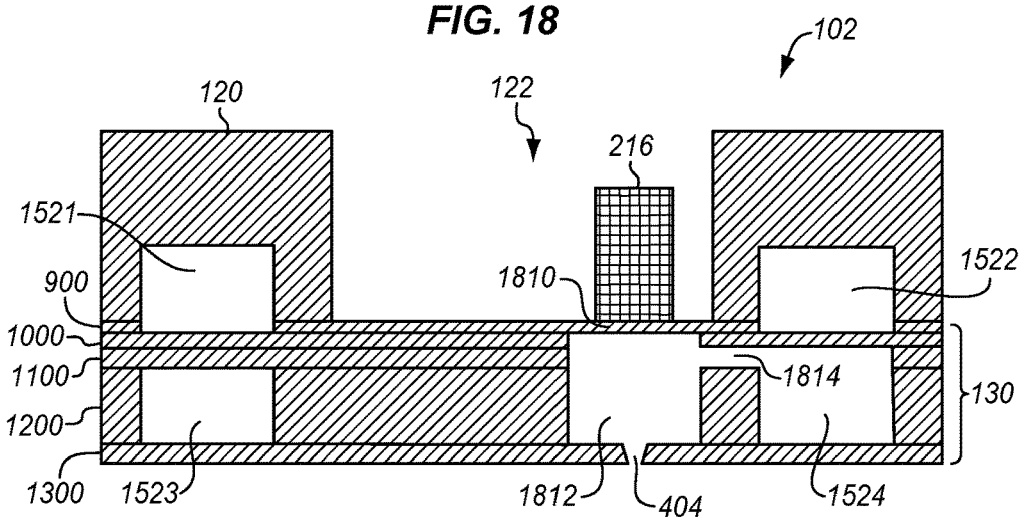

The view in FIG. 18 is across cut plane D-D in FIG. 14, showing a jetting channel for nozzle 404. The jetting channel includes diaphragm 1810, pressure chamber 1812, and nozzle 404. Pressure chamber 1812 is fluidly coupled to lower supply manifold 1524 via restrictor 1814 (formed with restrictor opening 1114 in FIG. 11). Restrictor 1814 controls the flow of print fluid from lower supply manifold 1524 to pressure chamber 1812. Actuation by actuator 216 will cause the print fluid to be ejected out of the jetting channel through nozzle 404. The jetting channel for nozzle 404 is fluidly coupled to lower supply manifold 1524, and is fluidly isolated from the other supply manifolds 1521-1523 so that it receives one type of print fluid.

Figure 19:
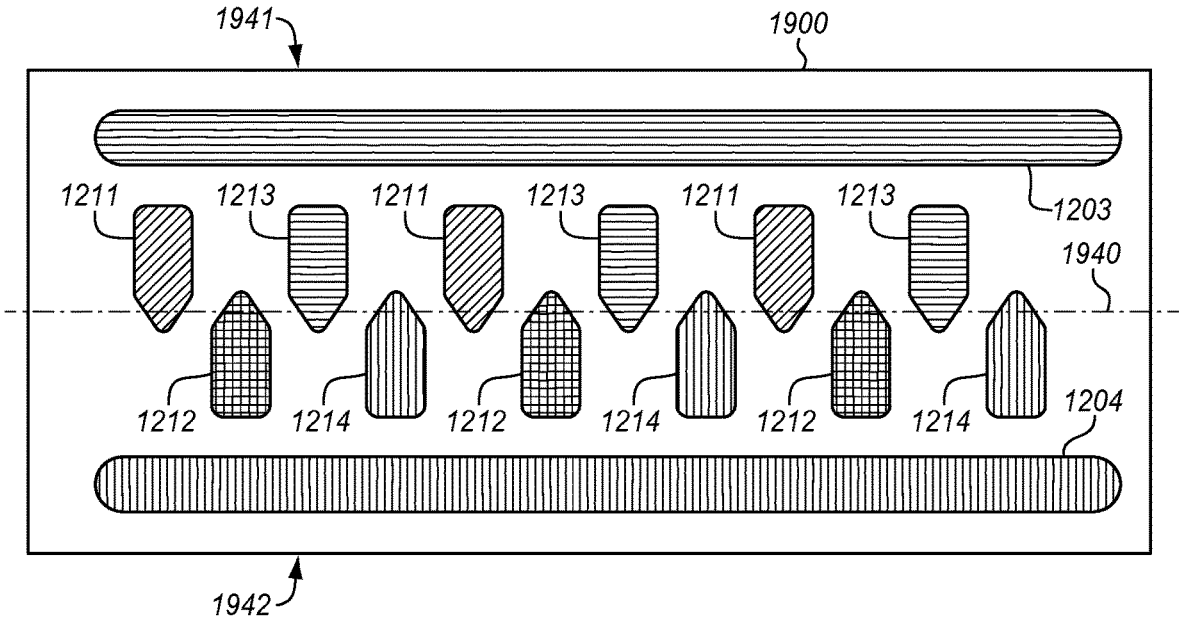
FIG. 19 is a plan view of a chamber plate in an illustrative embodiment.
Figure 20:
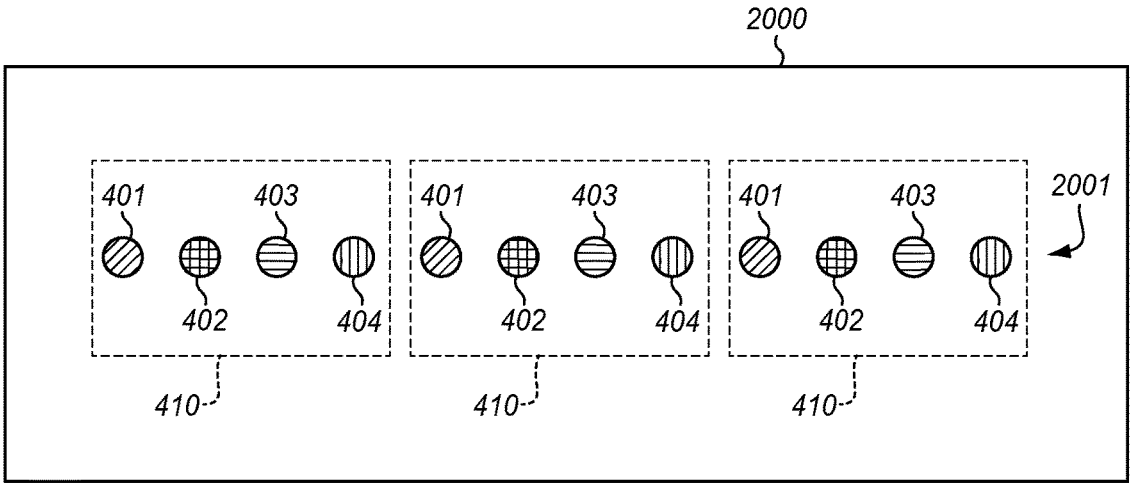
FIG. 20 is a plan view of a nozzle plate in an illustrative embodiment.

FIGS. 19-20 illustrate the structure of head member 102 in another illustrative embodiment. In this embodiment, diaphragm plate 900, upper restrictor plate 1000, and lower restrictor plate 1100 may be similar to the embodiment described above in FIGS. 9-11, but alternative plates are shown for the chamber plate and the nozzle plate. FIG. 19 is a plan view of chamber plate 1900 in an illustrative embodiment. Chamber plate 1900 is a thin sheet of material that is generally rectangular in shape and is substantially flat or planar. Chamber plate 1900 includes chamber openings 1211-1214 disposed toward a middle region of chamber plate 1900. Chamber openings 1211-1214 are aligned in two longitudinal rows that are staggered. However, chamber openings 1211-1214 each extend across a longitudinal center line 1940 of chamber plate 1900. Chamber plate 1900 further includes manifold openings 1203-1204, which comprise elongated apertures or holes through chamber plate 1900 disposed longitudinally along a length of chamber plate 1900. Manifold openings 1203-1204 are disposed toward the long sides 1941-1942 of chamber plate 1900 on opposing sides of chamber openings 1211-1214 to form the lower supply manifolds of head member 102. Although one chamber plate 1900 is illustrated, there may be multiple chamber plates 1900 used to form the pressure chambers and lower supply manifolds.

FIG. 20 is a plan view of nozzle plate 2000 in an illustrative embodiment. Nozzle plate 2000 is a thin sheet of material that is generally rectangular in shape and is substantially flat or planar. Nozzle plate 2000 includes orifices that form nozzles 401-404 of the jetting channels. As described in FIG. 6, nozzles 401-404 are arranged in a single nozzle row 2001. Nozzles 401-404 are arranged into groupings 410 of four adjacent nozzles, where the adjacent nozzles are consecutive along nozzle row 2001. Each nozzle 401-404 in a grouping 410 is configured to jet a different type of print fluid.

Figure 21:
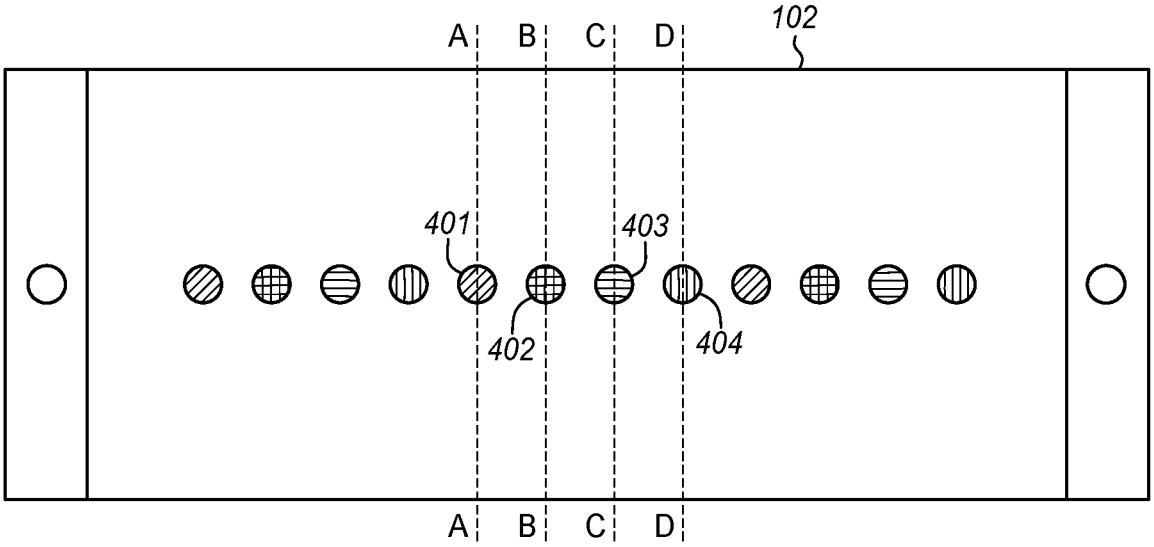
FIG. 21 is a bottom view of a head member in an illustrative embodiment.
Figure 22:
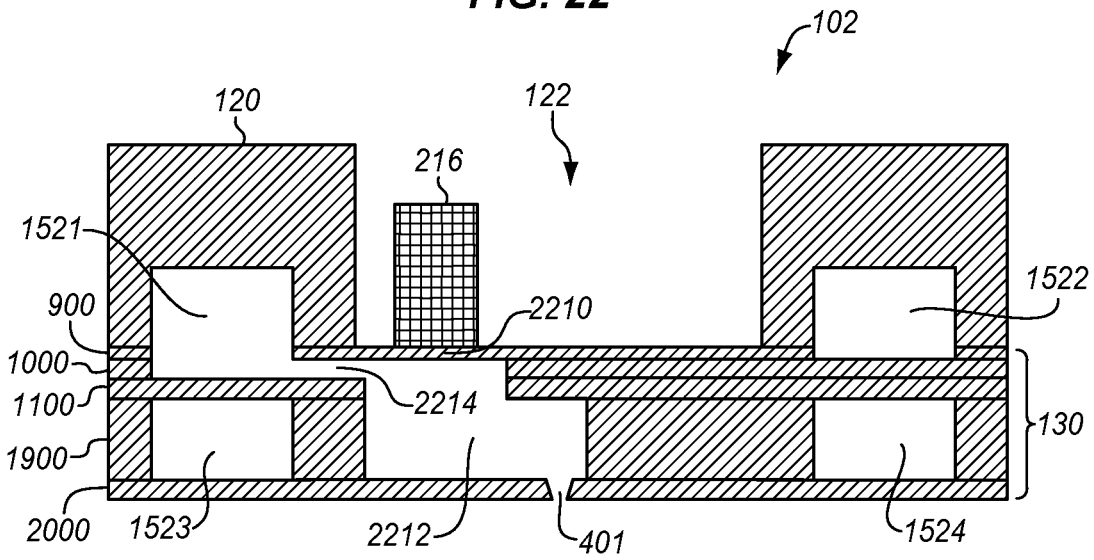
FIGS. 22-25 are cross-sectional views of a head member in an illustrative embodiment.

FIG. 21 is a bottom view of head member 102 in an illustrative embodiment. FIGS. 22-25 are cross-sectional views of head member 102 in an illustrative embodiment. The view in FIG. 22 is across cut plane A-A in FIG. 21. From top to bottom in FIG. 22, head member 102 includes housing 120, diaphragm plate 900, upper restrictor plate 1000, lower restrictor plate 1100, chamber plate 1900, and nozzle plate 2000. As is visible in FIG. 22, head member 102 includes a pair of upper supply manifolds 1521-1522 and a pair of lower supply manifolds 1523-1524. Plate stack 130 forms a jetting channel for nozzle 401. The jetting channel includes diaphragm 2210, pressure chamber 2212, and nozzle 401. Pressure chamber 2212 is fluidly coupled to upper supply manifold 1521 via restrictor 2214 (formed with restrictor opening 1011 in FIG. 10). Restrictor 2214 controls the flow of print fluid from upper supply manifold 1521 to pressure chamber 2212. Actuation by actuator 216 will cause the print fluid to be ejected out of the jetting channel through nozzle 401.

Figure 23:
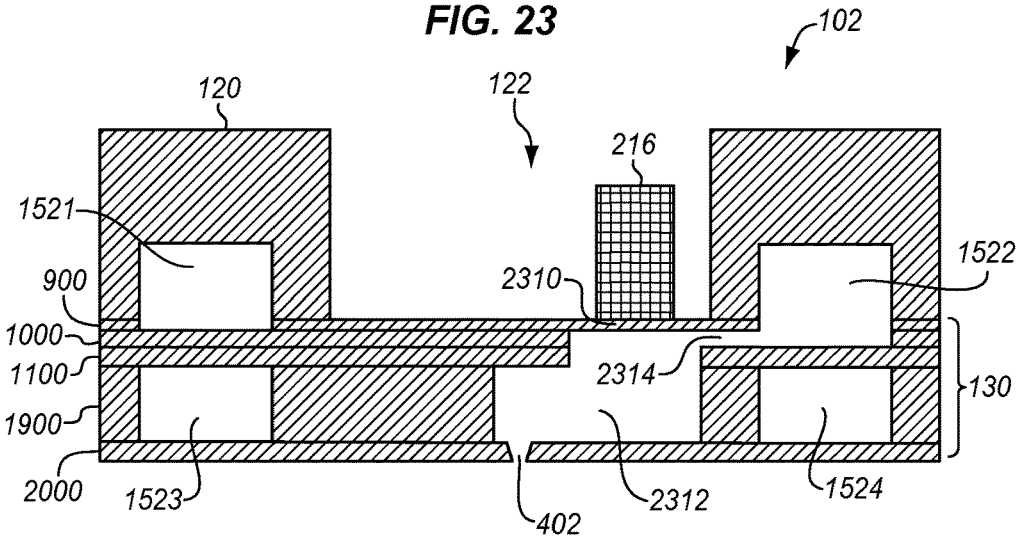

The view in FIG. 23 is across cut plane B-B in FIG. 21, showing a jetting channel for nozzle 402. The jetting channel includes diaphragm 2310, pressure chamber 2312, and nozzle 402. Pressure chamber 2312 is fluidly coupled to upper supply manifold 1522 via restrictor 2314 (formed with restrictor opening 1012 in FIG. 10). Restrictor 2314 controls the flow of print fluid from upper supply manifold 1522 to pressure chamber 2312. Actuation by actuator 216 will cause the print fluid to be ejected out of the jetting channel through nozzle 402.

Figure 24:
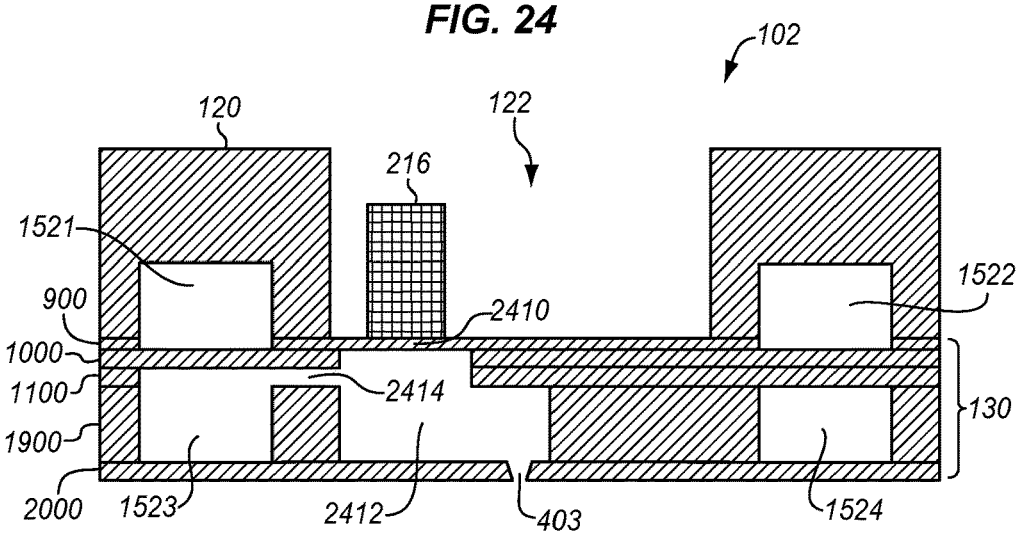

The view in FIG. 24 is across cut plane C-C in FIG. 21, showing a jetting channel for nozzle 403. The jetting channel includes diaphragm 2410, pressure chamber 2412, and nozzle 403. Pressure chamber 2412 is fluidly coupled to lower supply manifold 1523 via restrictor 2414 (formed with restrictor opening 1113 in FIG. 11). Restrictor 2414 controls the flow of print fluid from lower supply manifold 1523 to pressure chamber 2412. Actuation by actuator 216 will cause the print fluid to be ejected out of the jetting channel through nozzle 403.

Figure 25:
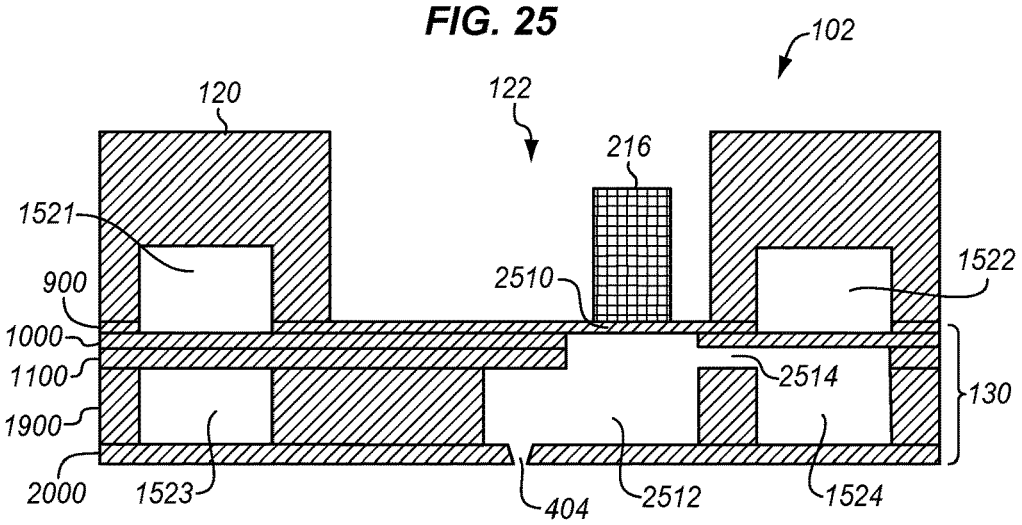

The view in FIG. 25 is across cut plane D-D in FIG. 21, showing a jetting channel for nozzle 404. The jetting channel includes diaphragm 2510, pressure chamber 2512, and nozzle 404. Pressure chamber 2512 is fluidly coupled to lower supply manifold 1524 via restrictor 2514 (formed with restrictor opening 1114 in FIG. 11). Restrictor 2514 controls the flow of print fluid from lower supply manifold 1524 to pressure chamber 2512. Actuation by actuator 216 will cause the print fluid to be ejected out of the jetting channel through nozzle 404.

Figure 26:
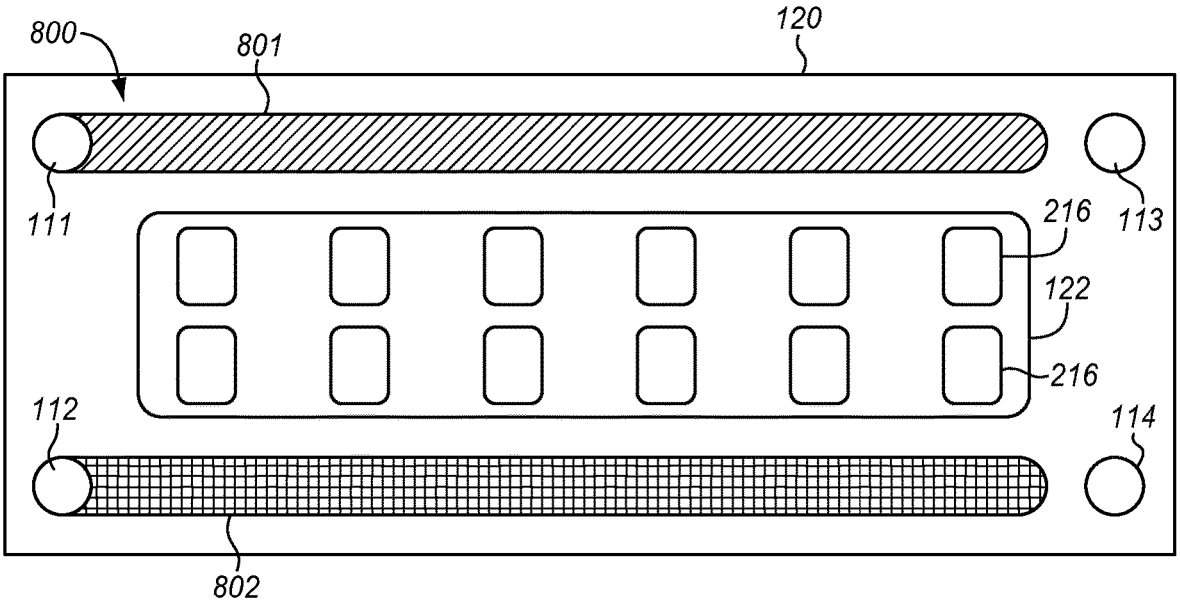
FIG. 26 is a bottom view of a housing in an illustrative embodiment.

FIGS. 26-34 illustrate the structure of head member 102 in another illustrative embodiment. Again, the structural elements in these figures are not drawn to scale, and are provided as an example. FIG. 26 is a bottom view of housing 120 in an illustrative embodiment. Interface surface 800 of housing 120 is similar to FIG. 8 with manifold ducts 801-802 disposed longitudinally along a length of housing 120. Manifold ducts 801-802 are fluidly coupled to inlet ports 111-112, respectively. Inlet ports 113-114 are also visible as extending through housing 120, and will be fluidly coupled to lower supply manifolds as is described in more detail below. In this embodiment, actuators 216 are arranged in two rows, and the actuators 216 in each row are aligned.

Figure 27:
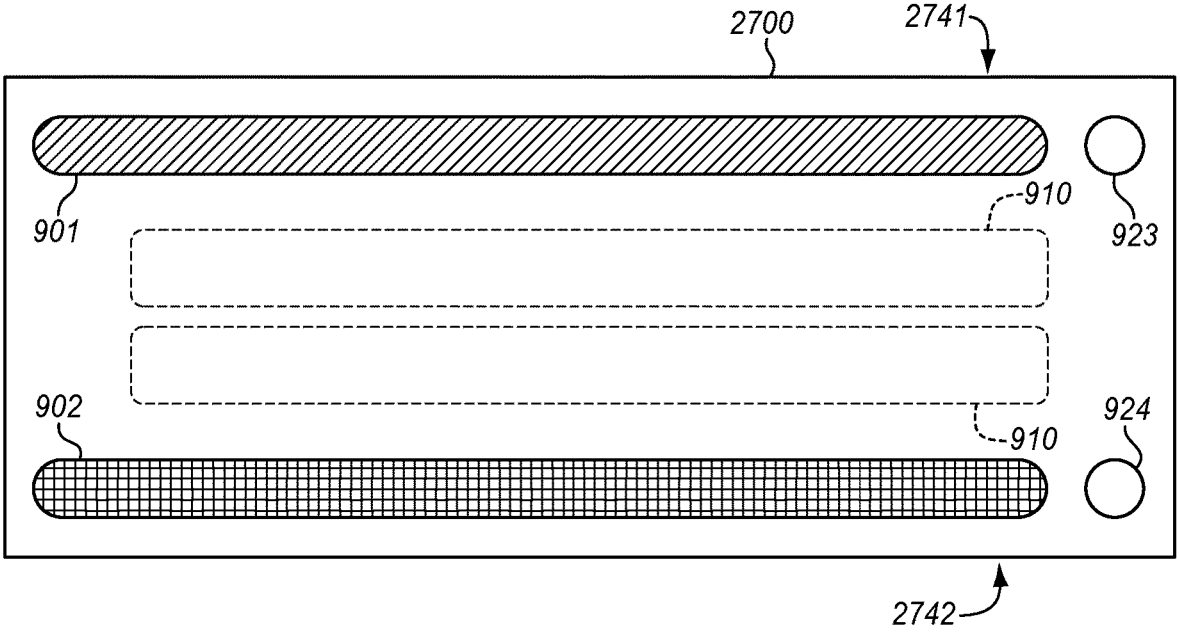
FIG. 27 is a plan view of a diaphragm plate in an illustrative embodiment.

FIGS. 27-31 show another example of plate stack 130 that includes a diaphragm plate, an upper restrictor plate, a lower restrictor plate, a chamber plate, and a nozzle plate. FIG. 27 is a plan view of a diaphragm plate 2700 in an illustrative embodiment. Diaphragm plate 2700 includes diaphragm sections 910 comprising a semi-flexible material that forms diaphragms for the jetting channels. Diaphragm plate 2700 further includes manifold openings 901-902, which comprise elongated apertures or holes through diaphragm plate 2700 disposed longitudinally along a length of diaphragm plate 2700. Manifold openings 901-902 are disposed toward the long sides 2741-2742 of diaphragm plate 2700 on opposing sides of diaphragm sections 910 to coincide with manifold ducts 801-802 of housing 120 and to form the upper supply manifolds (e.g., supply manifolds 511-512) of head member 102. Diaphragm plate 2700 also includes port extension openings 923-924 that coincide with inlet ports 113-114, respectively, of housing 120.

Figure 28:
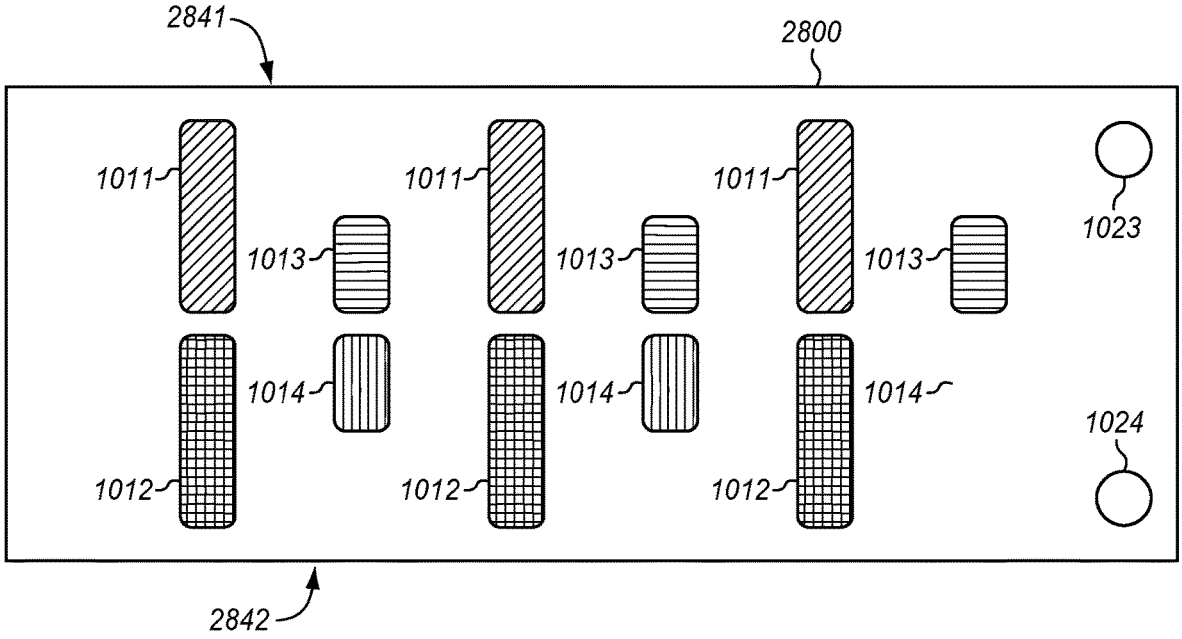
FIG. 28 is a plan view of an upper restrictor plate in an illustrative embodiment.

FIG. 28 is a plan view of upper restrictor plate 2800 in an illustrative embodiment. Upper restrictor plate 2800 is a thin sheet of material that is generally rectangular in shape and is substantially flat or planar. Upper restrictor plate 2800 includes restrictor openings 1011-1012. Restrictor openings 1011-1012 comprise elongated apertures or holes through upper restrictor plate 2800 transversely disposed or oriented. Restrictor openings 1011-1012 are configured to fluidly couple pressure chambers of jetting channels (for nozzles 401-402) with manifold openings 901-902, respectively. Restrictor openings 1011-1012 are formed in two rows (i.e., a top row and a bottom row), with restrictor openings 1011 in one row and restrictor openings 1012 in the other row. Restrictor openings 1011 in one row are aligned with restrictor openings 1012 in the other row. Upper restrictor plate 2800 further includes chamber openings 1013-1014 toward a middle region of upper restrictor plate 2800. Chamber openings 1013-1014 comprise apertures or holes through upper restrictor plate 2800 that form pressure chambers for a portion of the jetting channels (i.e., the jetting channels for nozzles 403-404). Chamber openings 1013-1014 do not extend transversely as far as restrictor openings 1011-1012 toward the long sides 2841-2842 of upper restrictor plate 2800, and therefore are not fluidly coupled to manifold openings 901-902. Chamber openings 1013-1014 are formed in two rows, with chamber openings 1013 in one row and chamber openings 1014 in the other row. Chamber openings 1013 in one row are aligned with chamber openings 1014 in the other row. Restrictor openings 1011 alternate with chamber openings 1013 in the top row, and restrictor openings 1012 alternate with chamber openings 1014 in the bottom row. Upper restrictor plate 2800 also includes port extension openings 1023-1024 that coincide with port extension openings 923-924, respectively, of diaphragm plate 2700.

Figure 29:
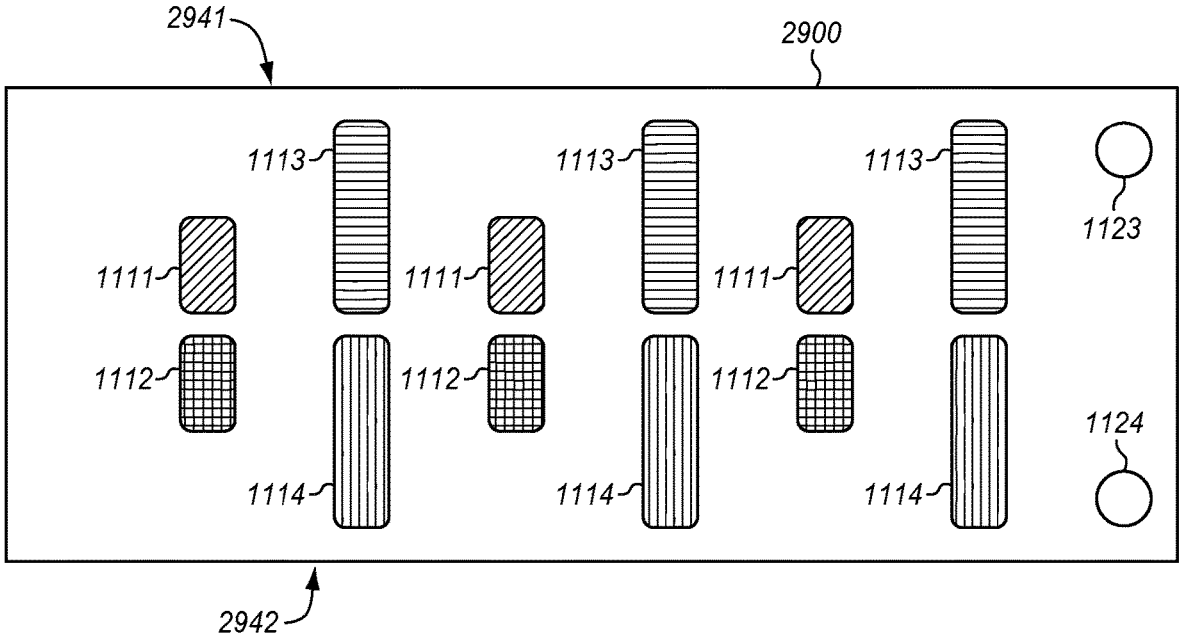
FIG. 29 is a plan view of a lower restrictor plate in an illustrative embodiment.

FIG. 29 is a plan view of lower restrictor plate 2900 in an illustrative embodiment. Lower restrictor plate 2900 is a thin sheet of material that is generally rectangular in shape and is substantially flat or planar. Lower restrictor plate 2900 includes restrictor openings 1113-1114. Restrictor openings 1113-1114 comprise elongated apertures or holes through lower restrictor plate 2900 transversely disposed or oriented. Restrictor openings 1113-1114 are configured to fluidly couple pressure chambers of jetting channels (for nozzles 403-404) with manifold openings of the chamber plate (see FIG. 30). Restrictor openings 1113-1114 are formed in two rows (i.e., a top row and a bottom row), with restrictor openings 1113 in one row and restrictor openings 1114 in the other row. Restrictor openings 1113 in one row are aligned with restrictor openings 1114 in the other row. Lower restrictor plate 2900 further includes chamber openings 1111-1112 toward a middle region of lower restrictor plate 2900. Chamber openings 1111-1112 comprise apertures or holes through lower restrictor plate 2900 that form pressure chambers for a portion of the jetting channels (i.e., the jetting channels for nozzles 401-402). Chamber openings 1111-1112 do not extend transversely as far as restrictor openings 1113-1114 toward the long sides 2941-2942 of lower restrictor plate 2900, and therefore are not fluidly coupled to the manifold openings of the chamber plate. Chamber openings 1111-1112 are formed in two rows, with chamber openings 1111 in one row and chamber openings 1112 in the other row. Chamber openings 1111 in one row are aligned with chamber openings 1112 in the other row. Restrictor openings 1113 alternate with chamber openings 1111 in the top row, and restrictor openings 1114 alternate with chamber openings 1112 in the bottom row. Lower restrictor plate 2900 also includes port extension openings 1123-1124 that coincide with port extension openings 1023-1024, respectively, of upper restrictor plate 2800.

Figure 30:
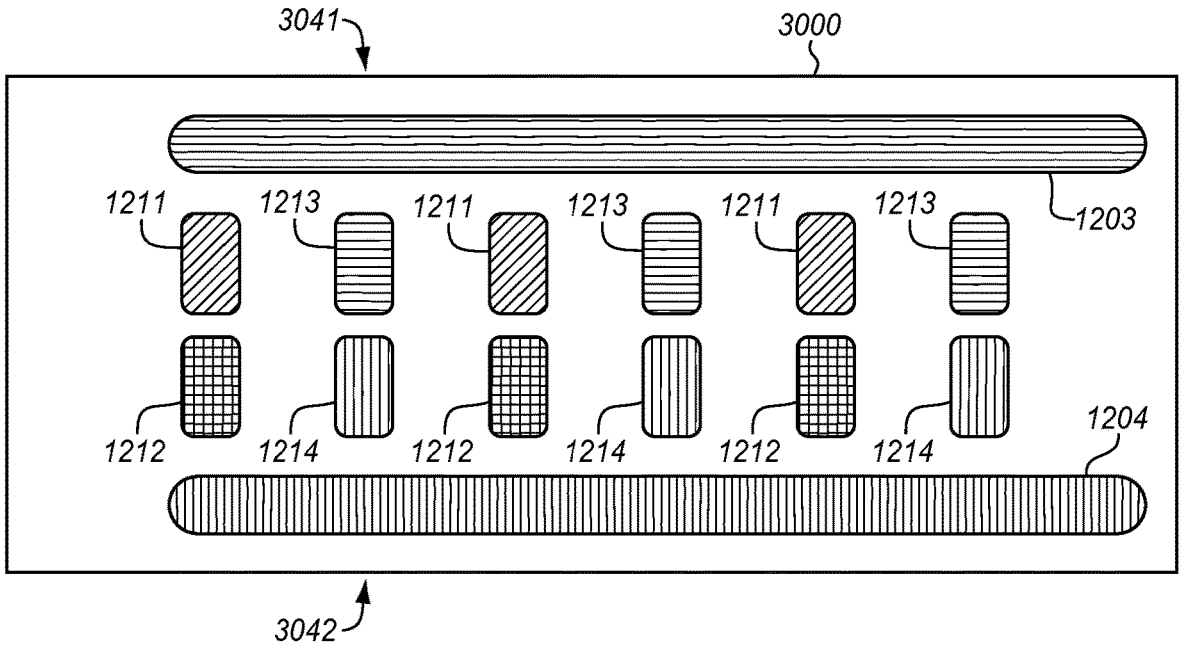
FIG. 30 is a plan view of a chamber plate in an illustrative embodiment.

FIG. 30 is a plan view of chamber plate 3000 in an illustrative embodiment. Chamber plate 3000 is a thin sheet of material that is generally rectangular in shape and is substantially flat or planar. Chamber plate 3000 includes chamber openings 1211-1214 disposed toward a middle region of chamber plate 3000. Chamber openings 1211-1214 comprise apertures or holes through chamber plate 3000 that form pressure chambers for the jetting channels. Chamber openings 1211-1214 are formed in two rows, and chamber openings 1211 and 1213 in one row are aligned with chamber openings 1212 and 1214 in the other row. Chamber plate 3000 further includes manifold openings 1203-1204, which comprise elongated apertures or holes through chamber plate 3000 disposed longitudinally along a length of chamber plate 3000. Manifold openings 1203-1204 are disposed toward the long sides 3041-3042 of chamber plate 3000 on opposing sides of chamber openings 1211-1214 to form the lower supply manifolds (e.g., supply manifolds 513-514) of head member 102. Although one chamber plate 3000 is illustrated, there may be multiple chamber plates 3000 used to form the pressure chambers and lower supply manifolds. Looking back to FIG. 29, restrictor openings 1113-1114 are configured to fluidly couple pressure chambers of jetting channels (for nozzles 403-404) with manifold openings 1203-1204, respectively.

Figure 31:
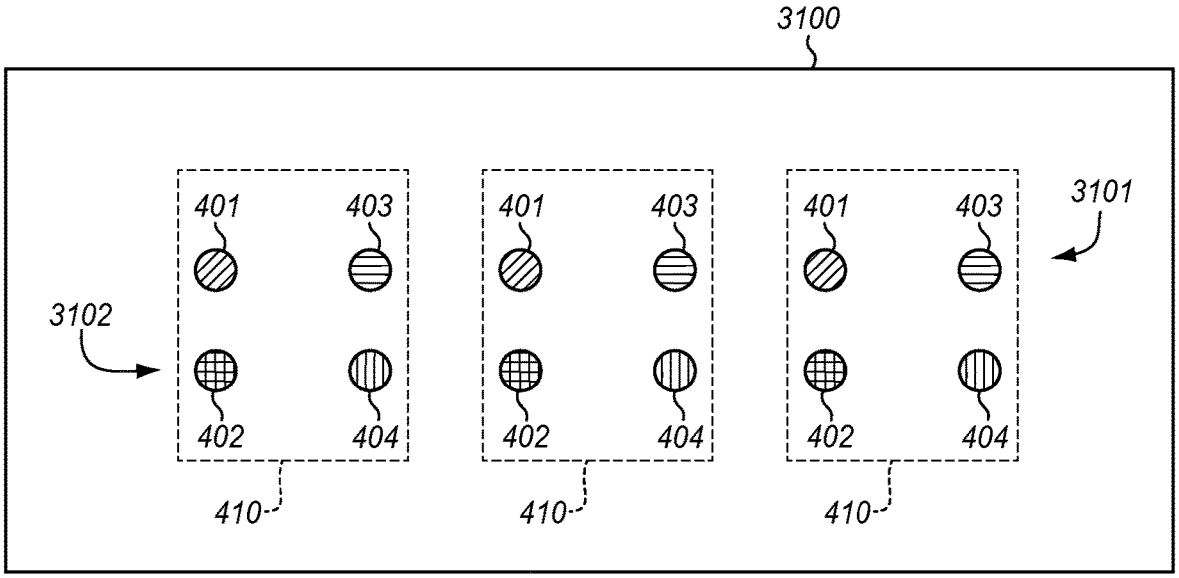
FIG. 31 is a plan view of a nozzle plate in an illustrative embodiment.

FIG. 31 is a plan view of nozzle plate 3100 in an illustrative embodiment. Nozzle plate 3100 is a thin sheet of material that is generally rectangular in shape and is substantially flat or planar. Nozzle plate 3100 includes orifices that form nozzles 401-404 of the jetting channels. In this embodiment, nozzles 401-404 are arranged in two nozzle rows 3101-3102. More particularly, nozzles 401 and 403 are in nozzle row 3101, and nozzles 402 and 404 are in nozzle row 3102. Nozzles 401 and 403 in nozzle row 3101 are aligned with nozzles 402 and 404 in nozzle row 3102. As in the above embodiments, nozzles 401-404 are arranged into groupings 410 of four adjacent nozzles, and each nozzle 401-404 in a grouping 410 is configured to jet a different type of print fluid.

Figure 32:
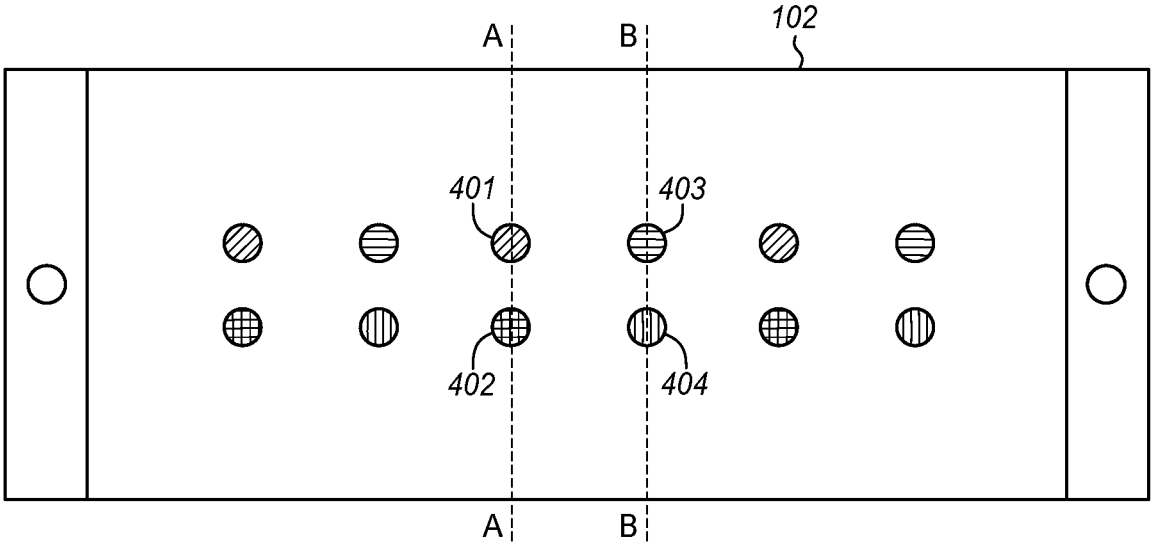
FIG. 32 is a bottom view of a head member in an illustrative embodiment.
Figure 33:
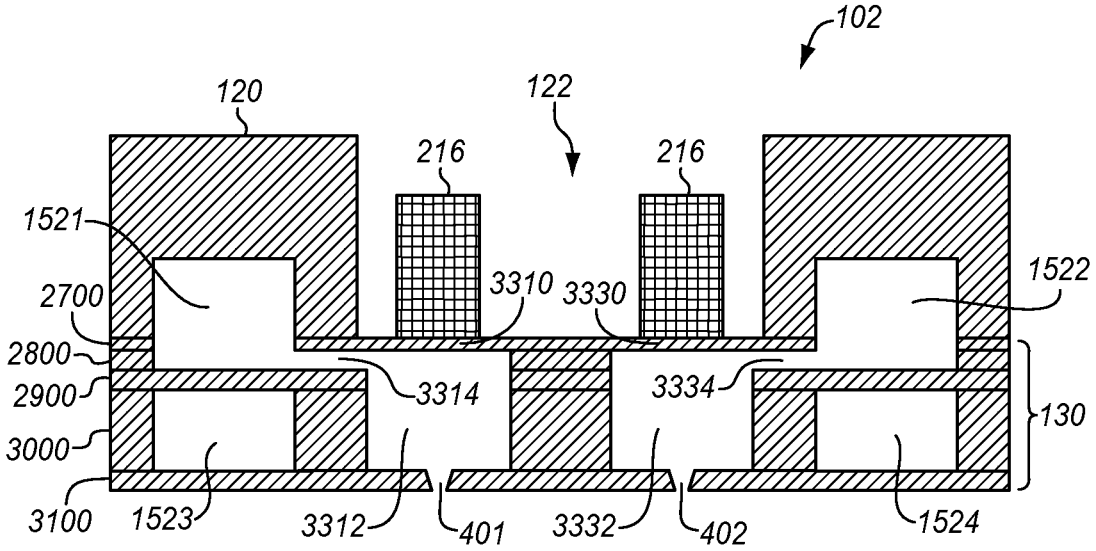
FIGS. 33-34 are cross-sectional views of a head member in an illustrative embodiment.
Figure 34:
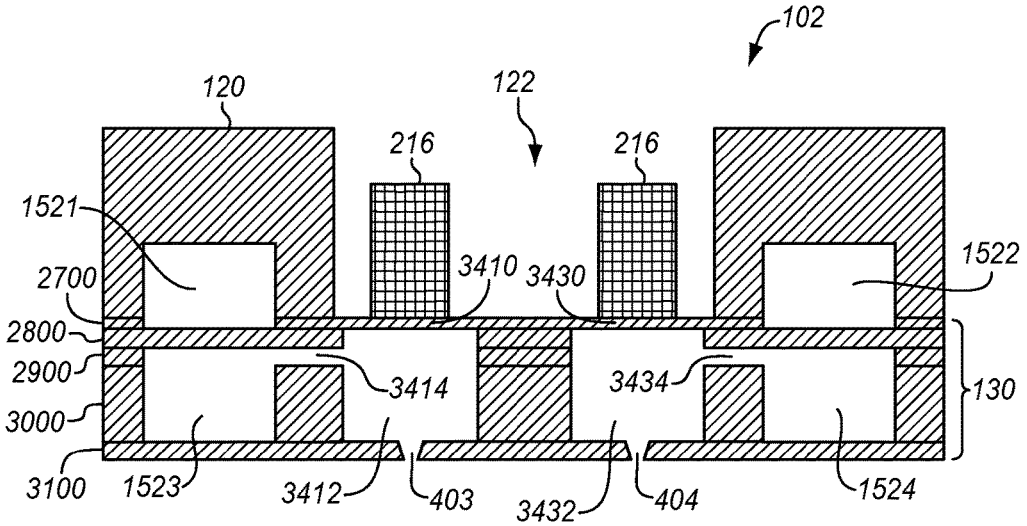

FIG. 32 is a bottom view of head member 102 in an illustrative embodiment. FIGS. 33-34 are cross-sectional views of head member 102 in an illustrative embodiment. The view in FIG. 33 is across cut plane A-A in FIG. 32. From top to bottom in FIG. 33, head member 102 includes housing 120, diaphragm plate 2700, upper restrictor plate 2800, lower restrictor plate 2900, chamber plate 3000, and nozzle plate 3100. This view shows a jetting channel for nozzle 401 and a jetting channel for nozzle 402 that are aligned transversely. The jetting channel for nozzle 401 includes diaphragm 3310, pressure chamber 3312, and nozzle 401. Pressure chamber 3312 is fluidly coupled to upper supply manifold 1521 via restrictor 3314. Restrictor 3314 controls the flow of print fluid from upper supply manifold 1521 to pressure chamber 3312. Actuation by actuator 216 will cause the print fluid to be ejected out of the jetting channel through nozzle 401. The jetting channel for nozzle 402 includes diaphragm 3330, pressure chamber 3332, and nozzle 402. Pressure chamber 3332 is fluidly coupled to upper supply manifold 1522 via restrictor 3334. Restrictor 3334 controls the flow of print fluid from upper supply manifold 1522 to pressure chamber 3332. Actuation by actuator 216 will cause the print fluid to be ejected out of the jetting channel through nozzle 402.

The view in FIG. 34 is across cut plane B-B in FIG. 32. This view shows a jetting channel for nozzle 403 and a jetting channel for nozzle 404 that are aligned transversely. The jetting channel for nozzle 403 includes diaphragm 3410, pressure chamber 3412, and nozzle 403. Pressure chamber 3412 is fluidly coupled to lower supply manifold 1523 via restrictor 3414. Restrictor 3414 controls the flow of print fluid from lower supply manifold 1523 to pressure chamber 3412. Actuation by actuator 216 will cause the print fluid to be ejected out of the jetting channel through nozzle 403. The jetting channel for nozzle 404 includes diaphragm 3430, pressure chamber 3432, and nozzle 404. Pressure chamber 3432 is fluidly coupled to lower supply manifold 1524 via restrictor 3434. Restrictor 3434 controls the flow of print fluid from lower supply manifold 1524 to pressure chamber 3432. Actuation by actuator 216 will cause the print fluid to be ejected out of the jetting channel through nozzle 404.

Figure 35:
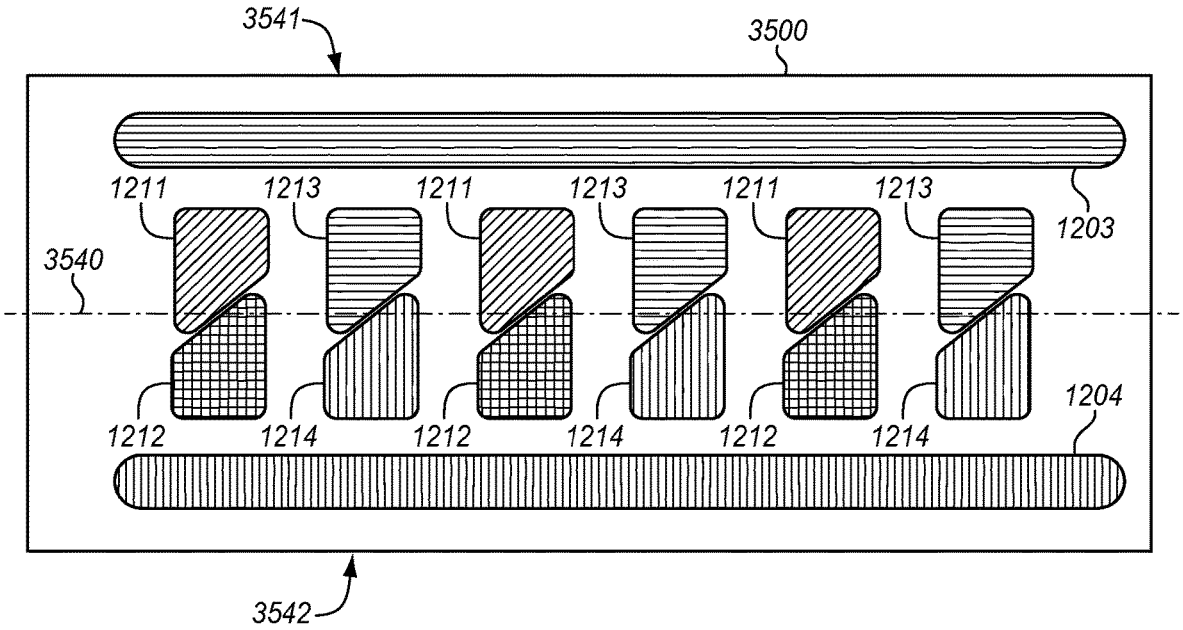
FIG. 35 is a plan view of a chamber plate in an illustrative embodiment.
Figure 36:
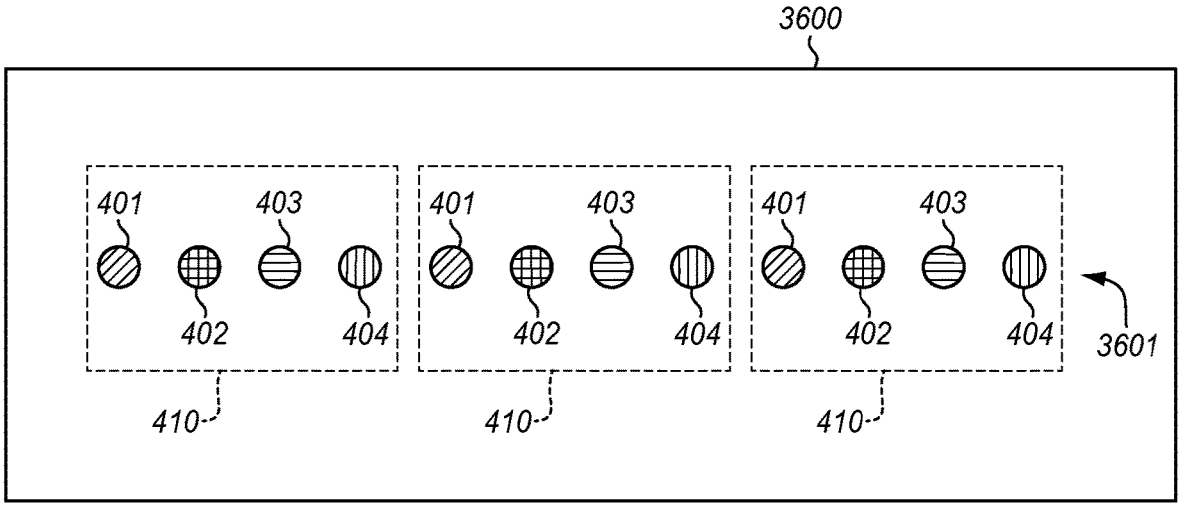
FIG. 36 is a plan view of a nozzle plate in an illustrative embodiment.

FIGS. 35-36 illustrate the structure of head member 102 in another illustrative embodiment. In this embodiment, diaphragm plate 2700, upper restrictor plate 2800, and lower restrictor plate 2900 may be similar to the embodiment described above in FIGS. 27-29, but alternative plates are shown for the chamber plate and the nozzle plate. FIG. 35 is a plan view of chamber plate 3500 in an illustrative embodiment. Chamber plate 3500 is a thin sheet of material that is generally rectangular in shape and is substantially flat or planar. Chamber plate 3500 includes chamber openings 1211-1214 disposed toward a middle region of chamber plate 3500. Chamber openings 1211-1214 are aligned in two longitudinal rows. A chamber opening 1211 and 1213 in one row is aligned with a chamber opening 1212 and 1214 in the other row. However, chamber openings 1211-1214 each extend across a longitudinal center line 3540 of chamber plate 3500. Chamber plate 3500 further includes manifold openings 1203-1204, which comprise elongated apertures or holes through chamber plate 3500 disposed longitudinally along a length of chamber plate 3500. Manifold openings 1203-1204 are disposed toward the long sides 3541-3542 of chamber plate 3500 on opposing sides of chamber openings 1211-1214 to form the lower supply manifolds of head member 102. Although one chamber plate 3500 is illustrated, there may be multiple chamber plates 3500 used to form the pressure chambers and lower supply manifolds.

FIG. 36 is a plan view of nozzle plate 3600 in an illustrative embodiment. Nozzle plate 3600 is a thin sheet of material that is generally rectangular in shape and is substantially flat or planar. Nozzle plate 3600 includes orifices that form nozzles 401-404 of the jetting channels. As described in FIG. 6, nozzles 401-404 are arranged in a single nozzle row 3601. Nozzles 401-404 are arranged into groupings 410 of four adjacent nozzles, where the adjacent nozzles are consecutive along nozzle row 3601. Each nozzle 401-404 in a grouping 410 is configured to jet a different type of print fluid.

Figure 37:
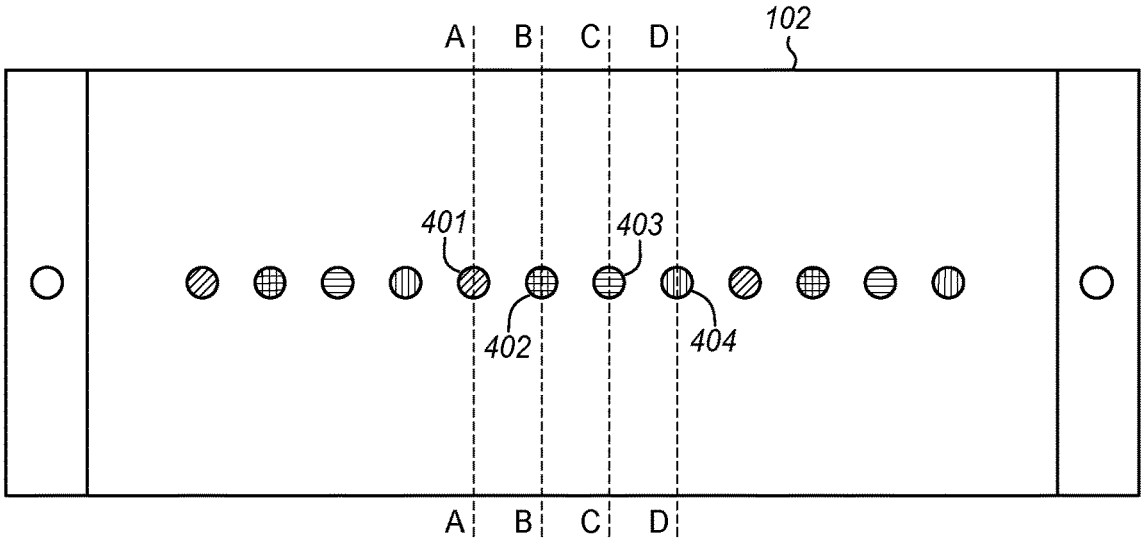
FIG. 37 is a bottom view of a head member in an illustrative embodiment.
Figure 38:
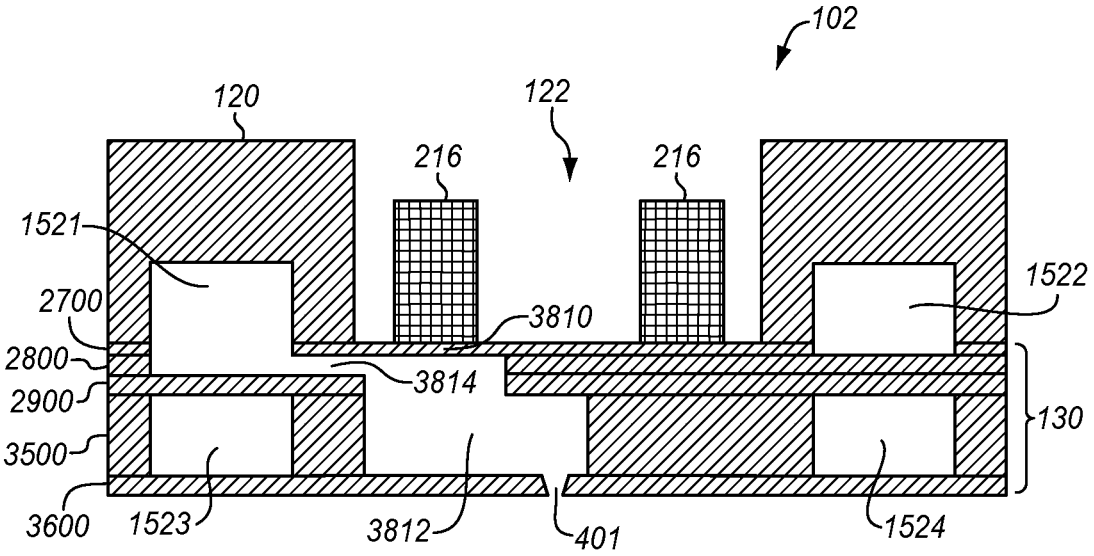
FIGS. 38-41 are cross-sectional views of a head member in an illustrative embodiment.

FIG. 37 is a bottom view of head member 102 in an illustrative embodiment. FIGS. 38-41 are cross-sectional views of head member 102 in an illustrative embodiment. The view in FIG. 38 is across cut plane A-A in FIG. 37. From top to bottom in FIG. 38, head member 102 includes housing 120, diaphragm plate 2700, upper restrictor plate 2800, lower restrictor plate 2900, chamber plate 3500, and nozzle plate 3600. Plate stack 130 forms a jetting channel for nozzle 401. The jetting channel includes diaphragm 3810, pressure chamber 3812, and nozzle 401. Pressure chamber 3812 is fluidly coupled to upper supply manifold 1521 via restrictor 3814. Restrictor 3814 controls the flow of print fluid from upper supply manifold 1521 to pressure chamber 3812. Actuation by actuator 216 will cause the print fluid to be ejected out of the jetting channel through nozzle 401.

Figure 39:
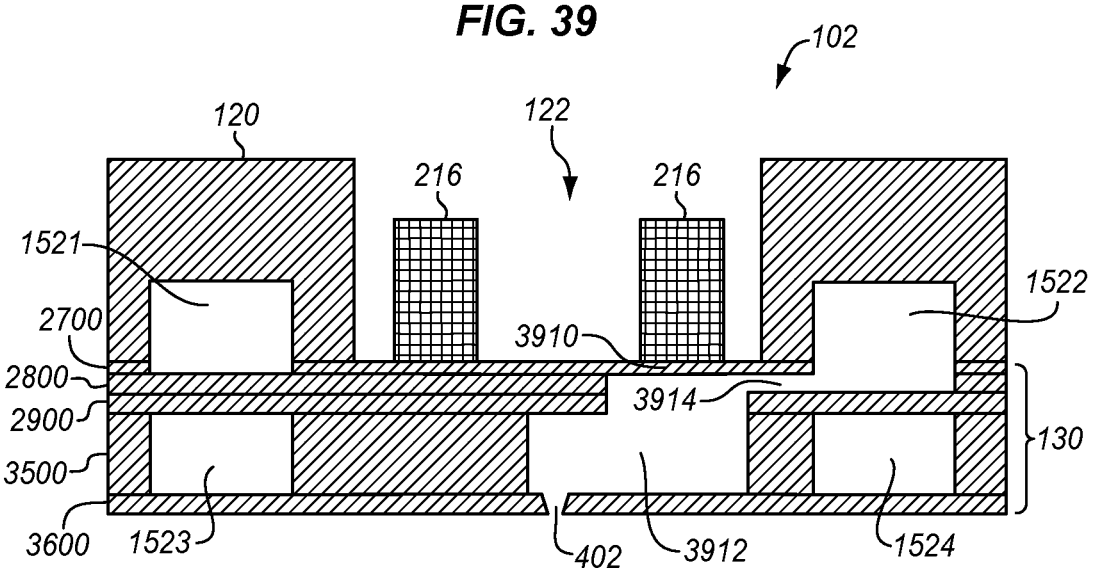

The view in FIG. 39 is across cut plane B-B in FIG. 37, showing a jetting channel for nozzle 402. The jetting channel includes diaphragm 3910, pressure chamber 3912, and nozzle 402. Pressure chamber 3912 is fluidly coupled to upper supply manifold 1522 via restrictor 3914. Restrictor 3914 controls the flow of print fluid from upper supply manifold 1522 to pressure chamber 3912. Actuation by actuator 216 will cause the print fluid to be ejected out of the jetting channel through nozzle 402.

Figure 40:
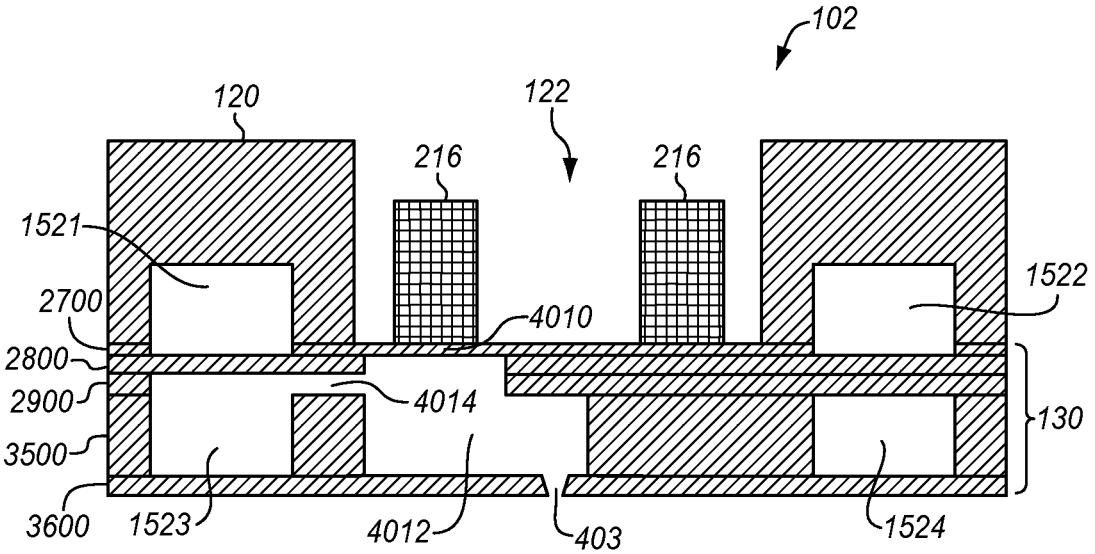

The view in FIG. 40 is across cut plane C-C in FIG. 37, showing a jetting channel for nozzle 403. The jetting channel includes diaphragm 4010, pressure chamber 4012, and nozzle 403. Pressure chamber 4012 is fluidly coupled to lower supply manifold 1523 via restrictor 4014. Restrictor 4014 controls the flow of print fluid from lower supply manifold 1523 to pressure chamber 4012. Actuation by actuator 216 will cause the print fluid to be ejected out of the jetting channel through nozzle 403.

Figure 41:
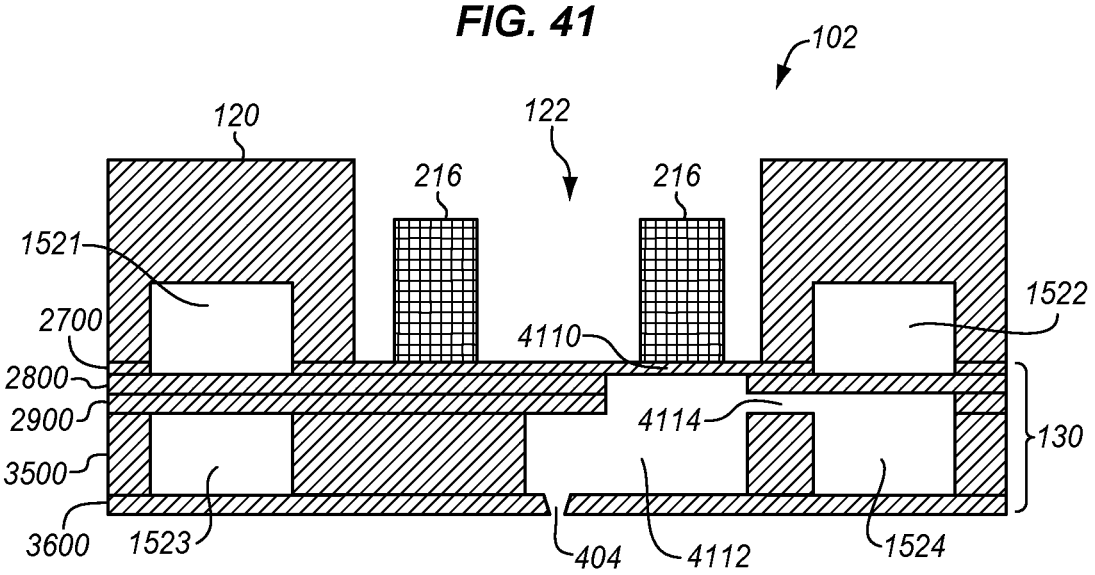

The view in FIG. 41 is across cut plane D-D in FIG. 37, showing a jetting channel for nozzle 404. The jetting channel includes diaphragm 4110, pressure chamber 4112, and nozzle 404. Pressure chamber 4112 is fluidly coupled to lower supply manifold 1524 via restrictor 4114. Restrictor 4114 controls the flow of print fluid from lower supply manifold 1524 to pressure chamber 4112. Actuation by actuator 216 will cause the print fluid to be ejected out of the jetting channel through nozzle 404.

Figure 42:
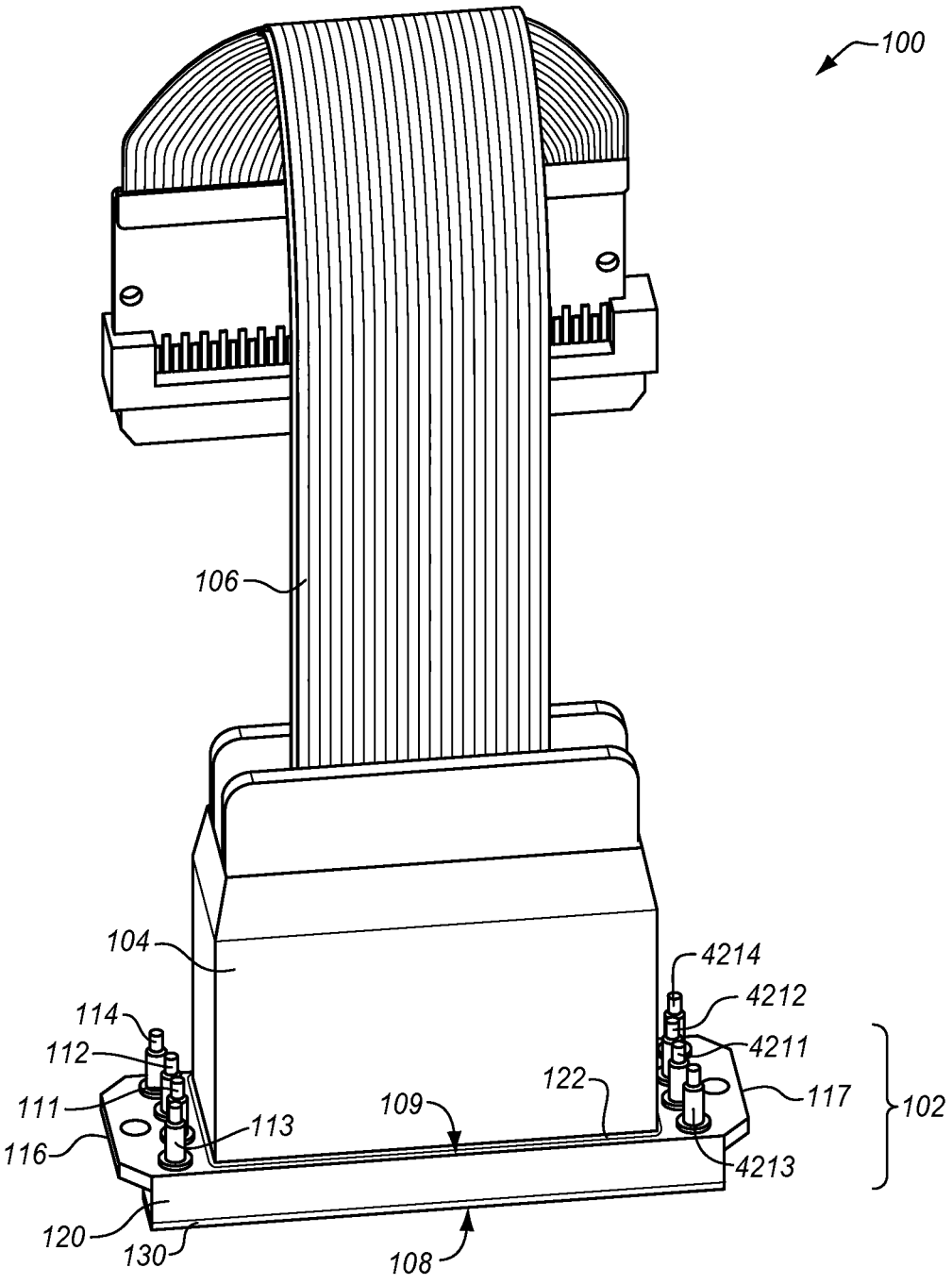
FIG. 42 is another perspective view of a printhead in an illustrative embodiment.

In further embodiments, printhead 100 may further include outlet ports for each supply manifold. FIG. 42 is another perspective view of printhead 100 in an illustrative embodiment. In this embodiment, top surface 109 of head member 102 (i.e., the I/O portion) includes a plurality of outlet ports 4211-4214 in addition to inlet ports 111-114. An outlet port 4211-4214 comprises an opening in head member 102 that acts as an exit point for a print fluid. Outlet ports 4211-4214 may include a hose coupling, hose barb, etc., for coupling with a return hose of a reservoir, a cartridge, or the like. In one embodiment, inlet ports 111-114 may be disposed toward end 116, and outlet ports 4211-4214 may be disposed toward end 117. In other embodiments, inlet ports 111-114 and outlet ports 4211-4214 may be disposed on either end 116-117.

Figure 43:
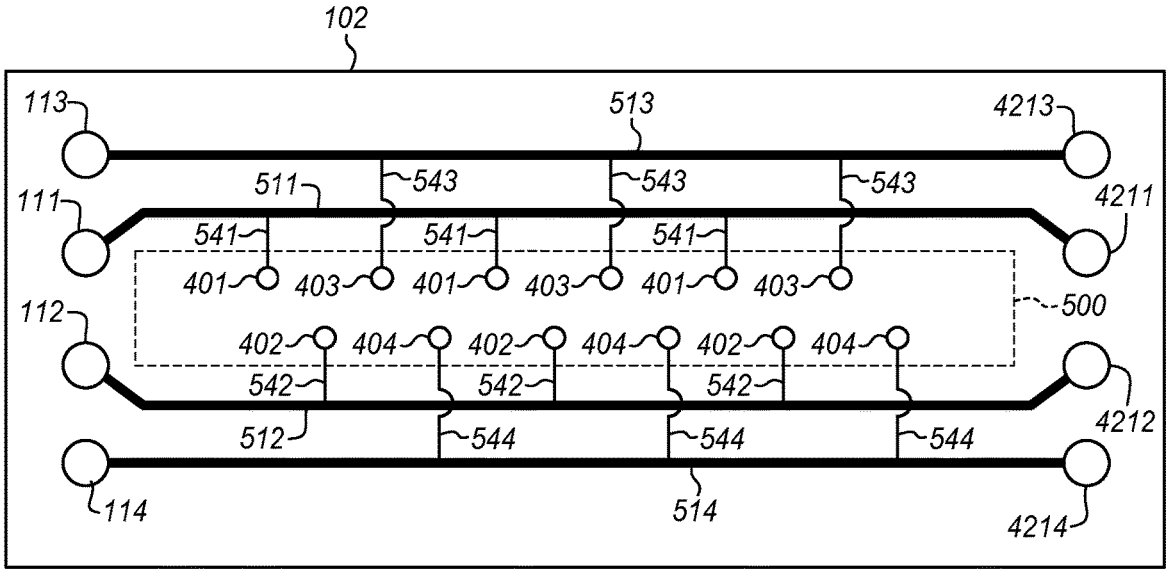
FIG. 43 is a schematic diagram of a head member in an illustrative embodiment.

FIG. 43 is a schematic diagram of head member 102 in an illustrative embodiment. The jetting channels 500 of printhead 100 are schematically illustrated in FIG. 43 as nozzles in two nozzle rows. Head member 102 includes supply manifolds 511-514 that are disposed longitudinally. Supply manifold 511 extends between inlet port 111 and outlet port 4211, and is fluidly coupled to a subset of the jetting channels indicated by nozzles 401. Thus, a first print fluid (e.g., a first color of ink) is able to flow through supply manifold 511 between inlet port 111 and outlet port 4211. Supply manifold 512 extends between inlet port 112 and outlet port 4212, and is fluidly coupled to a subset of the jetting channels indicated by nozzles 402. Thus, a second print fluid (e.g., a second color of ink) is able to flow through supply manifold 512 between inlet port 112 and outlet port 4212. Supply manifold 513 extends between inlet port 113 and outlet port 4213, and is fluidly coupled to a subset of the jetting channels indicated by nozzles 403. Thus, a third print fluid (e.g., a third color of ink) is able to flow through supply manifold 513 between inlet port 113 and outlet port 4213. Supply manifold 514 extends between inlet port 114 and outlet port 4214, and is fluidly coupled to a subset of the jetting channels indicated by nozzles 404. Thus, a fourth print fluid (e.g., a fourth color of ink) is able to flow through supply manifold 514 between inlet port 114 and outlet port 4214.

Figure 44:
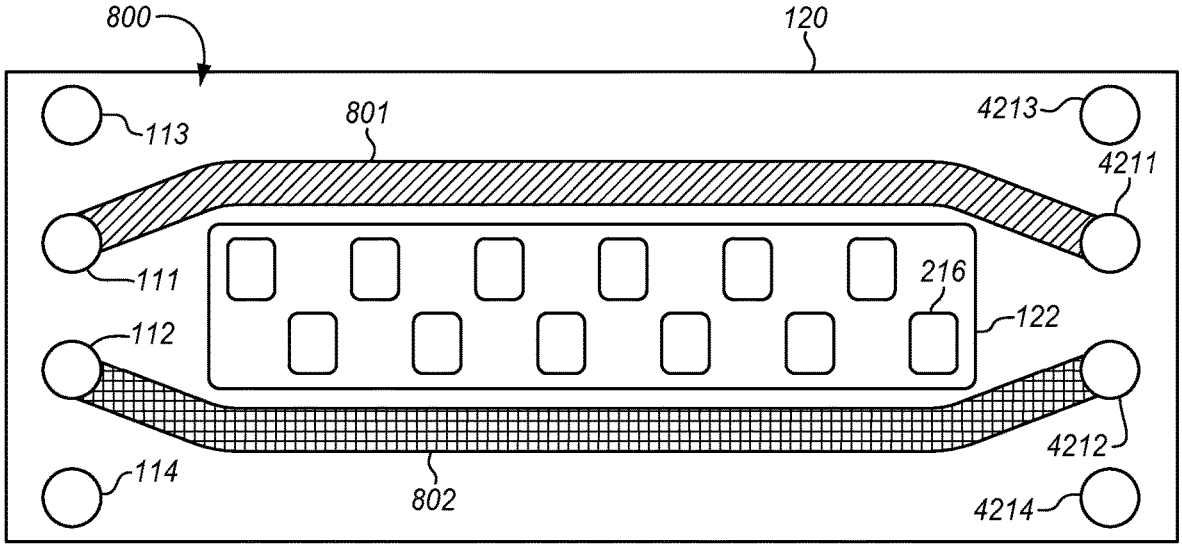
FIG. 44 is a bottom view of a housing in an illustrative embodiment.

FIG. 44 is a bottom view of housing 120 in an illustrative embodiment. Housing 120 includes manifold ducts 801-802 disposed longitudinally along a length of housing 120 on interface surface 800. Manifold duct 801 extends between inlet port 111 and outlet port 4211. Manifold duct 802 extends between inlet port 112 and outlet port 4212. Manifold ducts 801-802 form the upper supply manifolds for printhead 100. Inlet ports 113-114 are also visible as extending through housing 120, as well as outlet ports 4213-4214.

Figure 45:
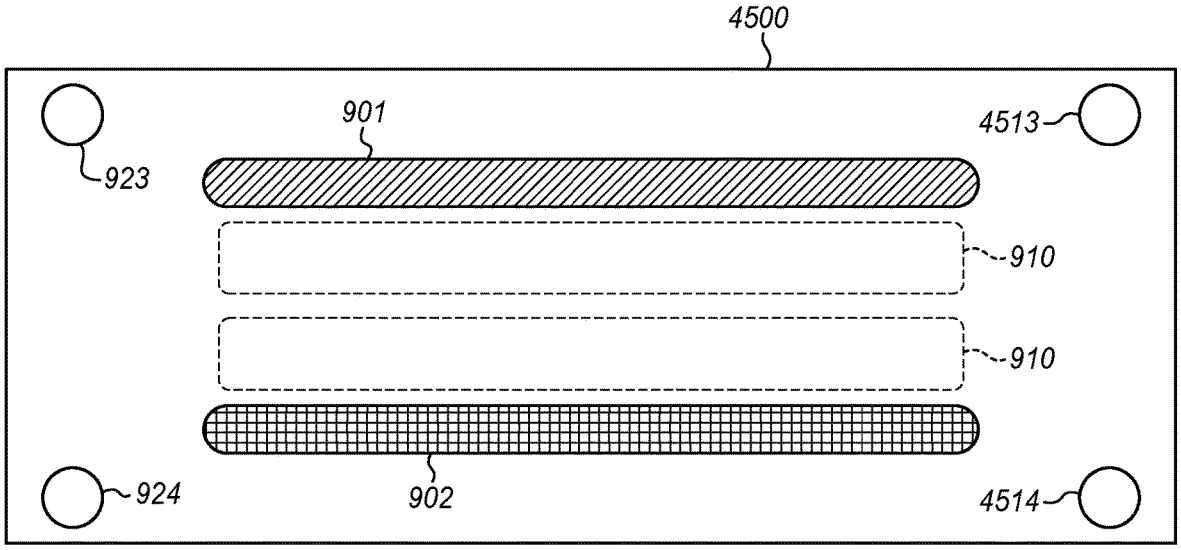
FIG. 45 is a plan view of a diaphragm plate in an illustrative embodiment.
Figure 46:
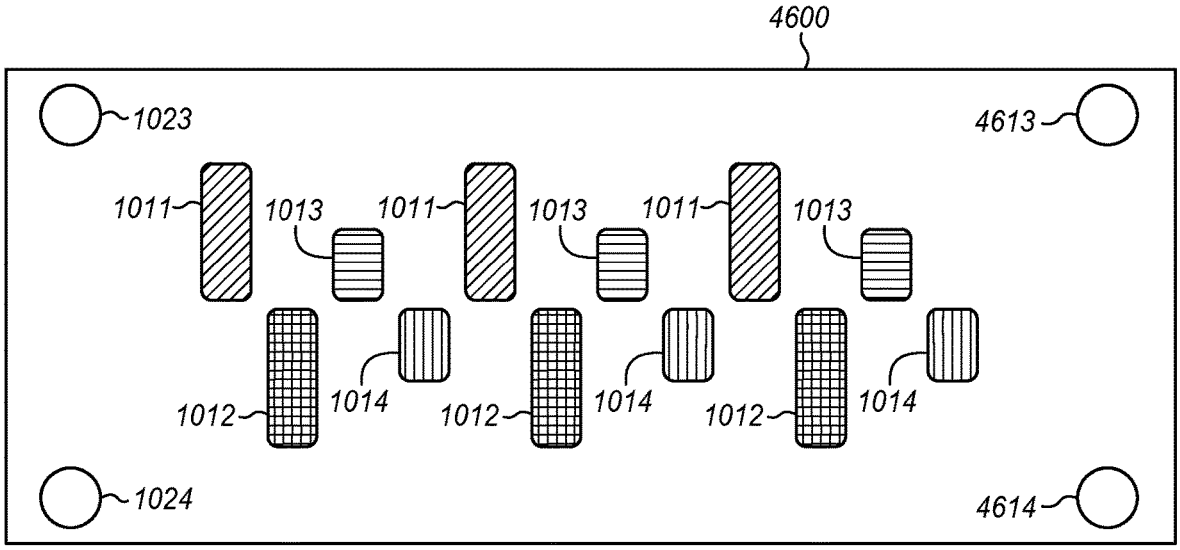
FIG. 46 is a plan view of an upper restrictor plate in an illustrative embodiment.
Figure 47:
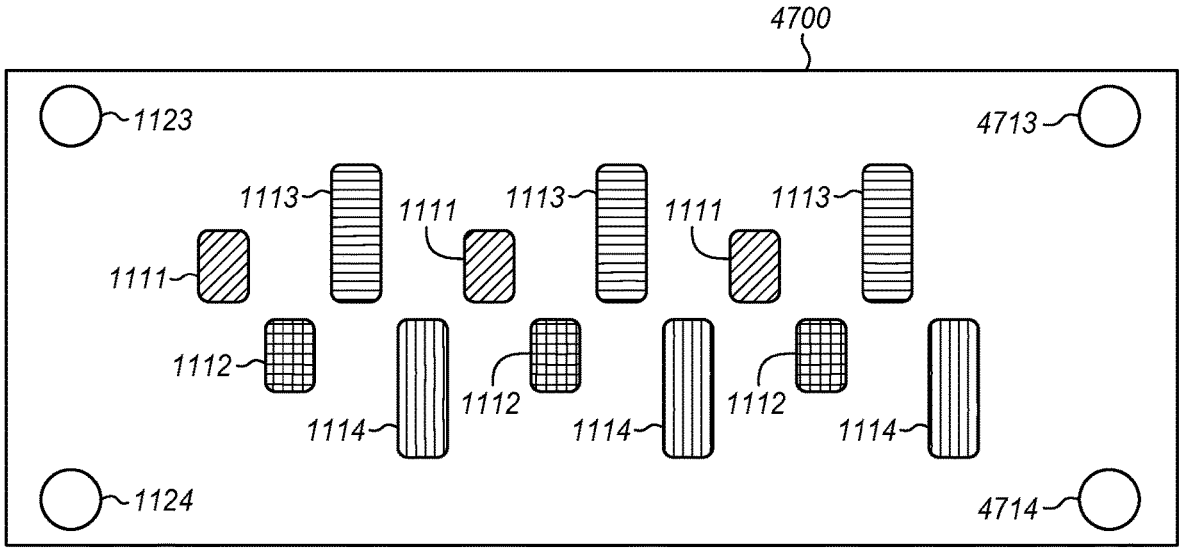
FIG. 47 is a plan view of a lower restrictor plate in an illustrative embodiment.

In order to connect the lower supply manifolds to outlet ports 4213-4214, additional port extension openings are formed in the diaphragm plate, the upper restrictor plate, and the lower restrictor plate. FIGS. 45-47 show the additional port extension openings, but similar port extension openings may be formed in any other plates described above.

FIG. 45 is a plan view of a diaphragm plate 4500 in an illustrative embodiment. Diaphragm plate 4500 is similar to diaphragm plate 900 as shown in FIG. 9. Diaphragm plate 4500 includes port extension openings 923-924 that coincide with inlet ports 113-114, respectively, of housing 120. Diaphragm plate 4500 also includes port extension openings 4513-4514 that coincide with outlet ports 4213-4214, respectively, of housing 120.

FIG. 46 is a plan view of an upper restrictor plate 4600 in an illustrative embodiment. Upper restrictor plate 4600 is similar to upper restrictor plate 1000 as shown in FIG. 10. Upper restrictor plate 4600 includes port extension openings 1023-1024 that coincide with port extension openings 923-924, respectively, of diaphragm plate 4500. Upper restrictor plate 4600 also includes port extension openings 4613-4614 that coincide with port extension openings 4513-4514, respectively, of diaphragm plate 4500.

FIG. 47 is a plan view of a lower restrictor plate 4700 in an illustrative embodiment. Lower restrictor plate 4700 is similar to lower restrictor plate 1100 as shown in FIG. 11. Lower restrictor plate 4700 includes port extension openings 1123-1124 that coincide with port extension openings 1023-1024, respectively, of upper restrictor plate 4600. Lower restrictor plate 4700 also includes port extension openings 4713-4714 that coincide with port extension openings 4613-4614, respectively, of upper restrictor plate 4600.

Figure 48:
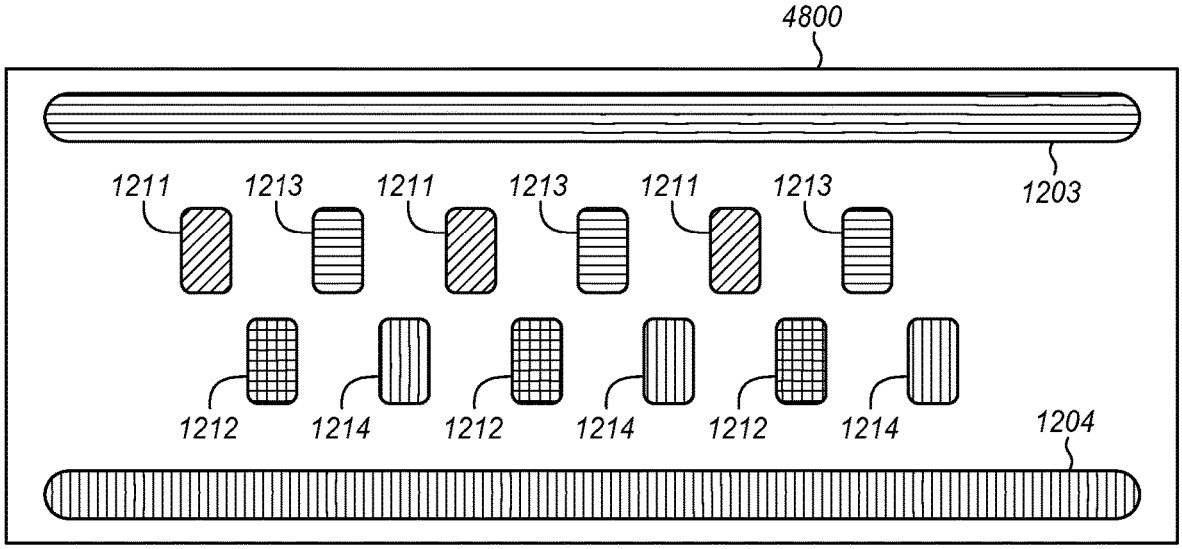
FIG. 48 is a plan view of a chamber plate in an illustrative embodiment.

FIG. 48 is a plan view of a chamber plate 4800 in an illustrative embodiment. Chamber plate 4800 is similar to chamber plate 1200 as shown in FIG. 12. Chamber plate 4800 includes manifold openings 1203-1204, which comprise elongated apertures or holes through chamber plate 4800 disposed longitudinally along a length of chamber plate 4800 to form the lower supply manifolds of head member 102. Manifold openings 1203-1204 fluidly couple the port extension openings for inlet ports 113-114 to the port extension openings for outlet ports 4213-4214 so that a print fluid is able to flow through the lower supply manifolds.

Figure 49:
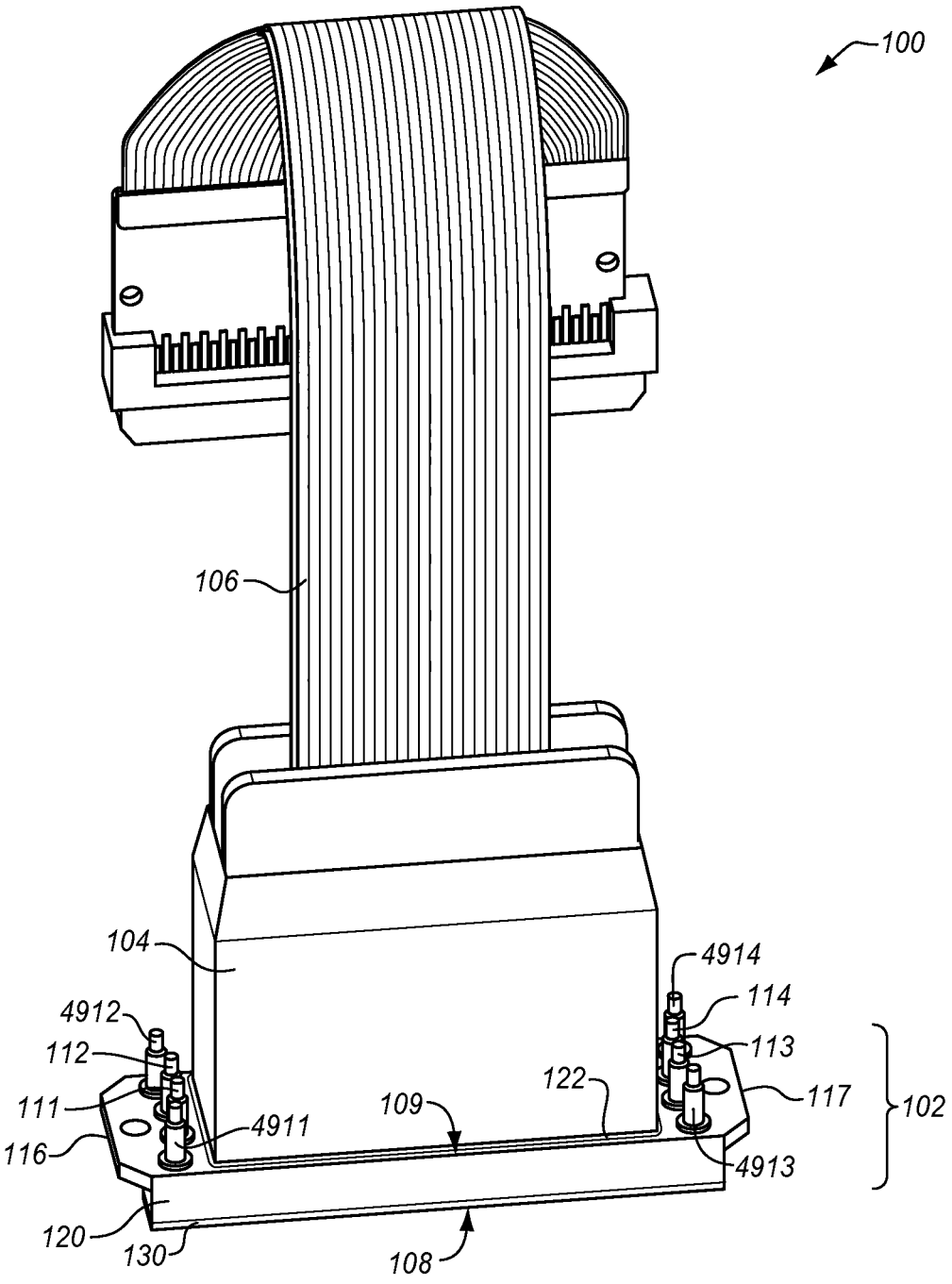
FIG. 49 is another perspective view of a printhead in an illustrative embodiment.

The above embodiments were directed to printheads that jet four (or more) different types of print fluid. The embodiments provided below are directed to printheads that jet eight (or more) different types of print fluid. FIG. 49 is another perspective view of printhead 100 in an illustrative embodiment. In this embodiment, top surface 109 of head member 102 (i.e., the I/O portion) includes inlet ports 4911-4914 in addition to inlet ports 111-114. In one embodiment, inlet ports 111-112 and 4911-4912 may be disposed toward end 116, and inlet ports 113-114 and 4913-4914 may be disposed toward end 117. In other embodiments, inlet ports 111-114 and 4911-4914 may be disposed on either end 116-117. Printhead 100 is configured to jet eight (or more) different types of print fluids, and may be referred to as an eight-color printhead. Types of print fluid may differ based on color or pigment, viscosity, density, polymers, etc. Inlet ports 111-114 and 4911-4914 are each fluidly coupled to a fluid reservoir, container, or other supply of a different type of print fluid.

Figure 50:
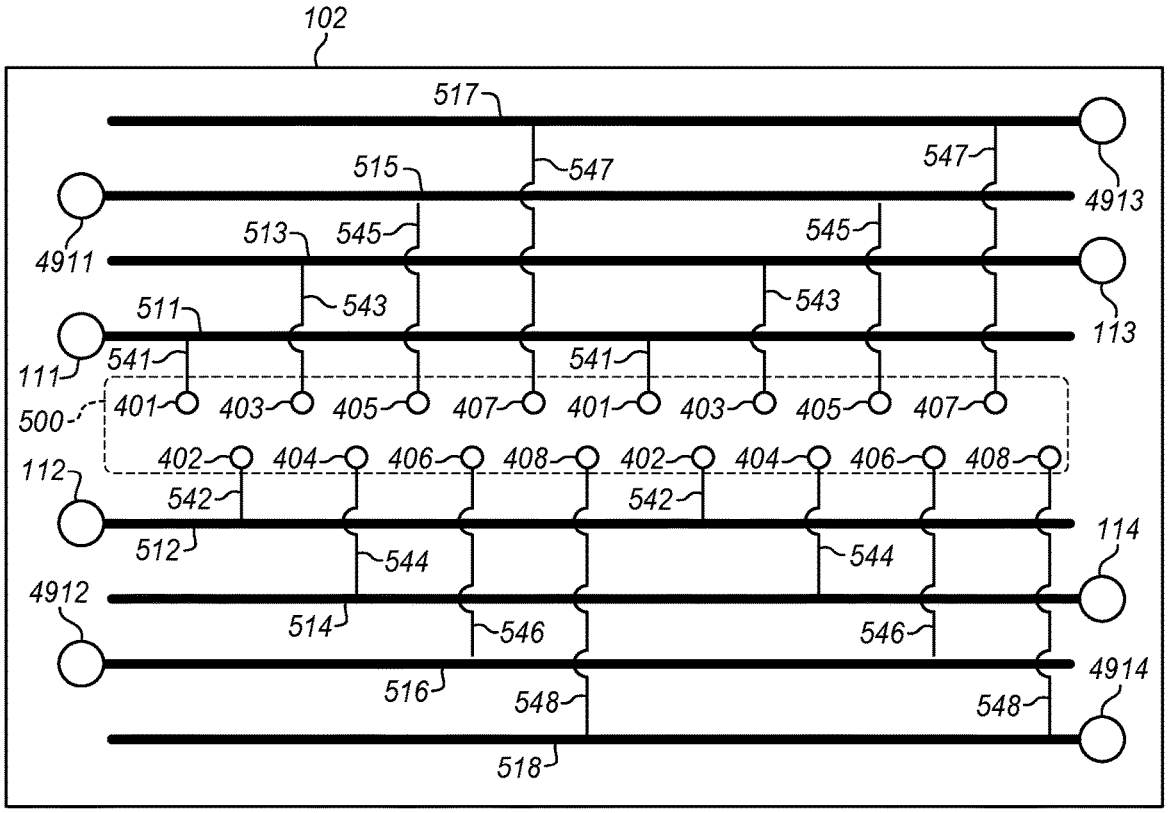
FIG. 50 is a schematic diagram of a head member in an illustrative embodiment.

FIG. 50 is a schematic diagram of head member 102 in an illustrative embodiment. The jetting channels of printhead 100 are schematically illustrated in FIG. 50 as nozzles in two nozzle rows. Although the nozzles are shown as staggered in FIG. 50, the nozzles in the two nozzle rows may be aligned in other embodiments. Head member 102 includes supply manifolds 511-518 that are disposed longitudinally. Supply manifold 511 is fluidly coupled to inlet port 111, and is fluidly coupled to a subset of the jetting channels indicated by nozzles 401 via fluid path 541. Thus, when a first print fluid (e.g., a first color of ink) is supplied to inlet port 111, supply manifold 511 receives the first print fluid and supplies the first print fluid to the subset of jetting channels for nozzles 401. Supply manifold 512 is fluidly coupled to inlet port 112, and is fluidly coupled to a subset of the jetting channels indicated by nozzles 402 via fluid path 542. Thus, when a second print fluid (e.g., a second color of ink) is supplied to inlet port 112, supply manifold 512 receives the second print fluid and supplies the second print fluid to the subset of jetting channels for nozzles 402. Supply manifold 513 is fluidly coupled to inlet port 113, and is fluidly coupled to a subset of the jetting channels indicated by nozzles 403 via fluid path 543. Thus, when a third print fluid (e.g., a third color of ink) is supplied to inlet port 113, supply manifold 513 receives the third print fluid and supplies the third print fluid to the subset of jetting channels for nozzles 403. Supply manifold 514 is fluidly coupled to inlet port 114, and is fluidly coupled to a subset of the jetting channels indicated by nozzles 404 via fluid path 544. Thus, when a fourth print fluid (e.g., a fourth color of ink) is supplied to inlet port 114, supply manifold 514 receives the fourth print fluid and supplies the fourth print fluid to the subset of jetting channels for nozzles 404. Supply manifold 515 is fluidly coupled to inlet port 4911, and is fluidly coupled to a subset of the jetting channels indicated by nozzles 405 via fluid path 545. Thus, when a fifth print fluid (e.g., a fifth color of ink) is supplied to inlet port 4911, supply manifold 515 receives the fifth print fluid and supplies the fifth print fluid to the subset of jetting channels for nozzles 405. Supply manifold 516 is fluidly coupled to inlet port 4912, and is fluidly coupled to a subset of the jetting channels indicated by nozzles 406 via fluid path 546. Thus, when a sixth print fluid (e.g., a sixth color of ink) is supplied to inlet port 4912, supply manifold 516 receives the sixth print fluid and supplies the sixth print fluid to the subset of jetting channels for nozzles 406. Supply manifold 517 is fluidly coupled to inlet port 4913, and is fluidly coupled to a subset of the jetting channels indicated by nozzles 407 via fluid path 547. Thus, when a seventh print fluid (e.g., a seventh color of ink) is supplied to inlet port 4913, supply manifold 517 receives the seventh print fluid and supplies the seventh print fluid to the subset of jetting channels for nozzles 407. Supply manifold 518 is fluidly coupled to inlet port 4914, and is fluidly coupled to a subset of the jetting channels indicated by nozzles 408 via fluid path 548. Thus, when an eighth print fluid (e.g., an eighth color of ink) is supplied to inlet port 4914, supply manifold 518 receives the eighth print fluid and supplies the eighth print fluid to the subset of jetting channels for nozzles 408.

In this embodiment, head member 102 includes eight supply manifolds 511-518. For example, supply manifolds 511-514 may represent upper supply manifolds for head member 102, and supply manifolds 515-518 may represent lower supply manifolds. Two of the upper supply manifolds (e.g., supply manifolds 511 and 513) may be disposed on one side of the row(s) of jetting channels, and the other two of the upper supply manifolds (e.g., supply manifolds 512 and 514) may be disposed on the other side of the row(s) of jetting channels. Likewise, two of the lower supply manifolds (e.g., supply manifolds 515 and 517) may be disposed on one side of the row(s) of jetting channels, and the other two of the lower supply manifolds (e.g., supply manifolds 516 and 518) may be disposed on the other side of the row(s) of jetting channels.

Figure 51:
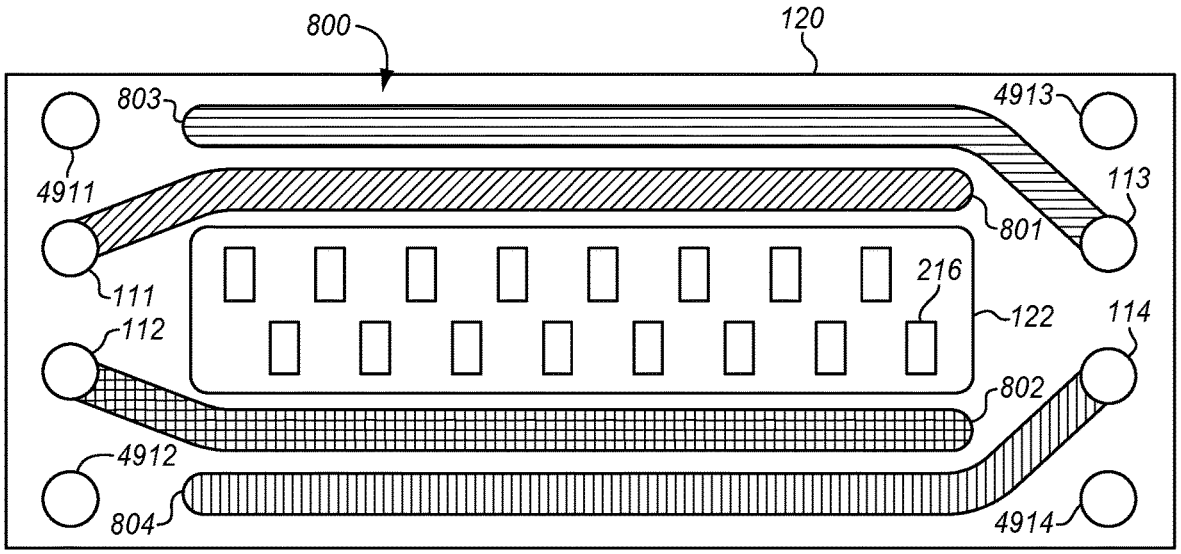
FIG. 51 is a bottom view of a housing in an illustrative embodiment.

FIG. 51 is a bottom view of housing 120 in an illustrative embodiment. Housing 120 includes manifold ducts 801-804 disposed longitudinally along a length of housing 120 on interface surface 800. Manifold ducts 801-804 are fluidly coupled to inlet ports 111-114, respectively. Manifold ducts 801 and 803 are arranged side-by-side on one side of housing 120 (i.e., on one side of access hole 122). In other words, manifold ducts 801 and 803 run generally parallel to one another on one side of housing 120. Similarly, manifold ducts 802 and 804 are arranged side-by-side on the other side of housing 120 (i.e., on the other side of access hole 122). In other words, manifold ducts 802 and 804 run generally parallel to one another on one side of housing 120. Manifold ducts 801-804 form the upper supply manifolds for head member 102. Inlet ports 4911-4914 are also visible as extending through housing 120, and will be fluidly coupled to the lower supply manifolds as is described in more detail below.

Figure 52:
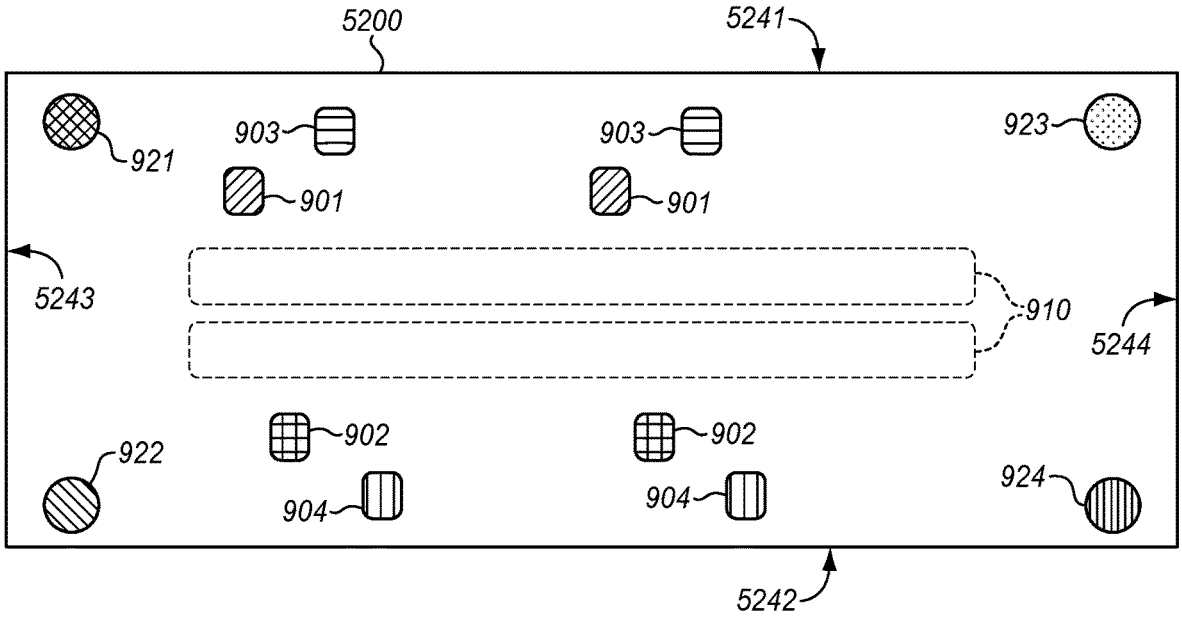
FIG. 52 is a plan view of a diaphragm plate in an illustrative embodiment.

FIGS. 52-57 show one example of plate stack 130 that includes a diaphragm plate, an upper restrictor plate, an upper chamber plate, a lower restrictor plate, a lower chamber plate, and a nozzle plate. FIG. 52 is a plan view of a diaphragm plate 5200 in an illustrative embodiment. Diaphragm plate 5200 is a thin sheet of material (e.g., metal, plastic, etc.) that is generally rectangular in shape and is substantially flat or planar. Diaphragm plate 5200 includes diaphragm sections 910 comprising a semi-flexible material that forms diaphragms for the jetting channels. Diaphragm plate 5200 further includes manifold openings 901-904 disposed between diaphragm sections 910 and longs sides 5241-5242. Manifold openings 901 comprise apertures or holes through diaphragm plate 5200 configured to fluidly coupled with manifold duct 801 in housing 120 to form an upper supply manifold (e.g., supply manifold 511). Manifold openings 902 comprise apertures or holes through diaphragm plate 5200 configured to fluidly coupled with manifold duct 802 in housing 120 to form another upper supply manifold (e.g., supply manifold 512). Manifold openings 903 comprises apertures or holes through diaphragm plate 5200 configured to fluidly couple with manifold duct 803 in housing 120 to form another upper supply manifold (e.g., supply manifold 513). Manifold openings 904 comprises apertures or holes through diaphragm plate 5200 configured to fluidly couple with manifold duct 804 in housing 120 to form another upper supply manifold (e.g., supply manifold 514). Diaphragm plate 5200 also includes port extension openings 921-924 that coincide with inlet ports 4911-4914, respectively, of housing 120. Port extension openings 921-922 may be disposed toward one end 5243 of diaphragm plate 5200, and port extension openings 923-924 may be disposed toward the other end 5244 of diaphragm plate 5200.

Figure 53:
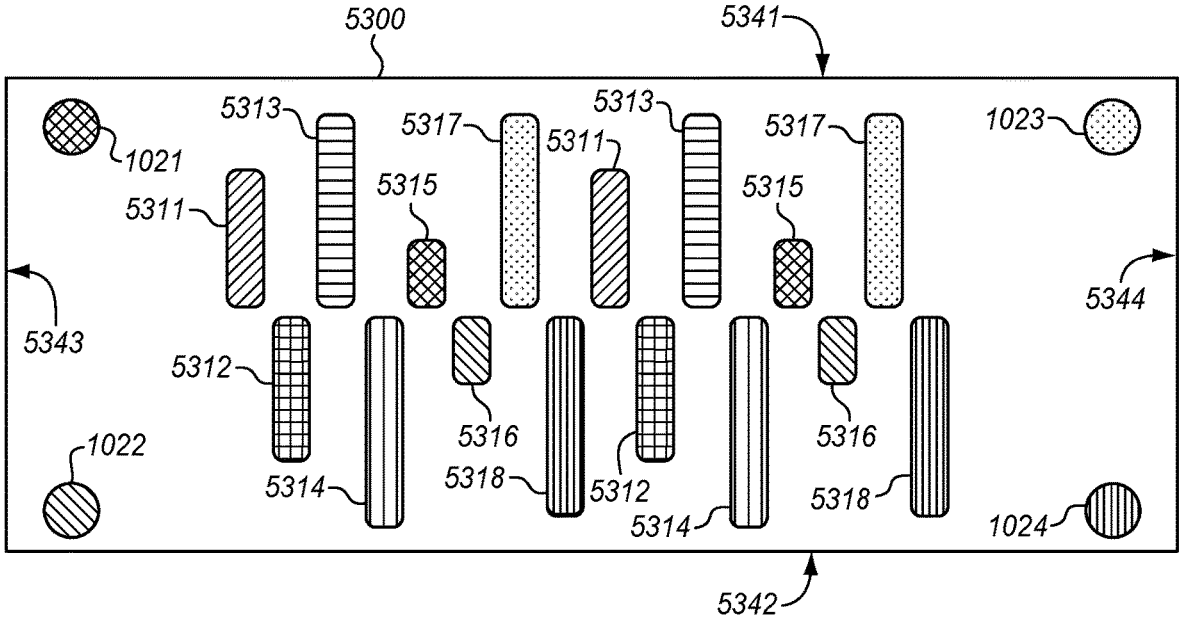
FIG. 53 is a plan view of an upper restrictor plate in an illustrative embodiment.

FIG. 53 is a plan view of upper restrictor plate 5300 in an illustrative embodiment. Upper restrictor plate 5300 is a thin sheet of material that is generally rectangular in shape and is substantially flat or planar. Upper restrictor plate 5300 includes restrictor openings 5311-5314 and 5317-5318. Restrictor openings 5311-5314 and 5317-5318 comprise elongated apertures or holes through upper restrictor plate 5300 transversely disposed or oriented. Restrictor openings 5311 are configured to fluidly couple pressure chambers of jetting channels (for nozzles 401) with manifold openings 901 of diaphragm plate 5200. Restrictor openings 5312 are configured to fluidly couple pressure chambers of jetting channels (for nozzles 402) with manifold openings 902 of diaphragm plate 5200. Restrictor openings 5313 are configured to fluidly couple pressure chambers of j jetting channels (for nozzles 403) with manifold openings 903 of diaphragm plate 5200. Restrictor openings 5314 are configured to fluidly couple pressure chambers of jetting channels (for nozzles 404) with manifold openings 904 of diaphragm plate 5200. Restrictor openings 5317 are configured to fluidly couple pressure chambers of jetting channels (for nozzles 407) with a lower supply manifold as will described further below. Restrictor openings 5318 are configured to fluidly couple pressure chambers of jetting channels (for nozzles 408) with a lower supply manifold. Restrictor openings 5311-5314 and 5317-5318 are formed in two rows (i.e., a top row and a bottom row), with restrictor openings 5311, 5313, and 5317 in one row, and restrictor openings 5312, 5314, and 5318 in the other row and offset or staggered in relation to one another.

Upper restrictor plate 5300 further includes chamber openings 5315-5316 toward a middle region of upper restrictor plate 5300. Chamber openings 5315-5316 comprise apertures or holes through upper restrictor plate 5300 that form pressure chambers for a portion of the jetting channels (i.e., the jetting channels for nozzles 405-406). Chamber openings 5315-5316 do not extend transversely as far as restrictor openings 5311-5314 and 5317-5318 toward the long sides 5341-5342 of upper restrictor plate 5300. Chamber openings 5315-5316 are formed in two rows, with chamber openings 5315 in one row and chamber openings 5316 in the other row that are offset or staggered in relation to one another. Upper restrictor plate 5300 also includes port extension openings 1021-1024 that coincide with port extension openings 921-924, respectively, of diaphragm plate 5200. Port extension openings 1021-1022 may be disposed toward an end 5343 of upper restrictor plate 5300, and port extension openings 1023-1024 may be disposed toward the other end 5344 of upper restrictor plate 5300.

Figure 54:
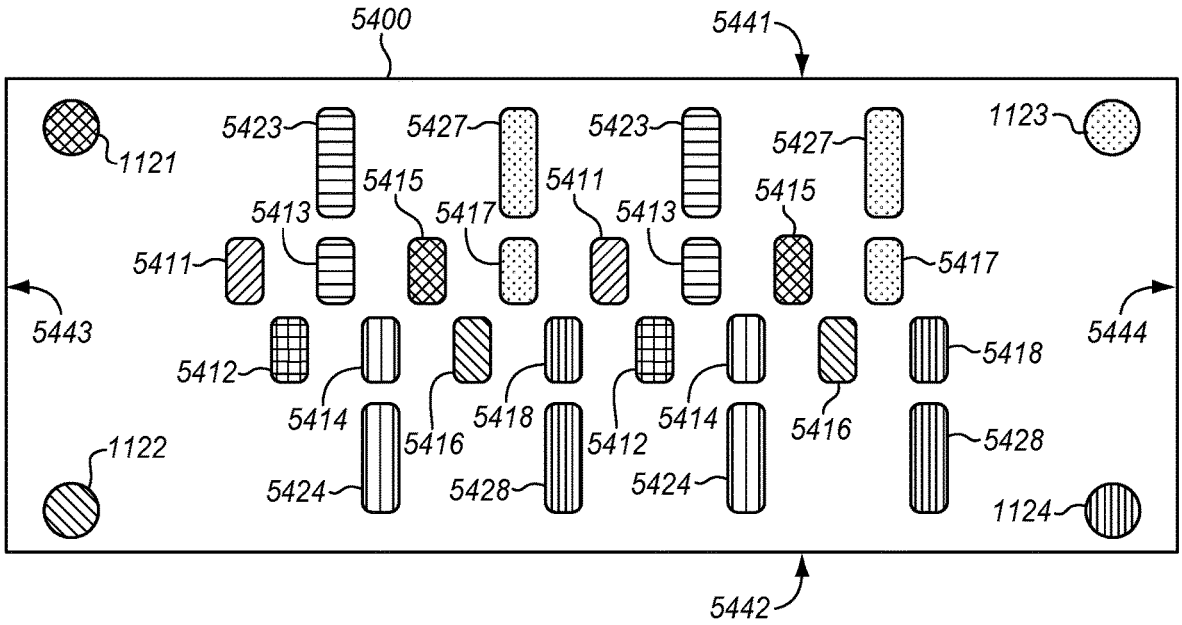
FIG. 54 is a plan view of an upper chamber plate in an illustrative embodiment.

FIG. 54 is a plan view of an upper chamber plate 5400 in an illustrative embodiment. Upper chamber plate 5400 is a thin sheet of material that is generally rectangular in shape and is substantially flat or planar. Upper chamber plate 5400 includes chamber openings 5411-5418 disposed toward a middle region of upper chamber plate 5400. Chamber openings 5411-5418 comprise apertures or holes through upper chamber plate 5400 that form pressure chambers for the jetting channels. Chamber openings 5411-5418 are aligned in two longitudinal rows that are staggered. Upper chamber plate 5400 further includes manifold openings 5423-5424 and 5427-5428, which comprise elongated apertures or holes through upper chamber plate 5400 transversely disposed or oriented. Manifold openings 5423 are disposed between a long side 5441 of upper chamber plate 5400 and chamber openings 5413, and are aligned transversely with chamber openings 5413. Manifold openings 5424 are disposed between a long side 5442 of upper chamber plate 5400 and chamber openings 5414, and are aligned transversely with chamber openings 5414. Manifold openings 5427 are disposed between a long side 5441 of upper chamber plate 5400 and chamber openings 5417, and are aligned transversely with chamber openings 5417. Manifold openings 5428 are disposed between a long side 5442 of upper chamber plate 5400 and chamber openings 5418, and are aligned transversely with chamber openings 5418. Upper chamber plate 5400 also includes port extension openings 1121-1124 that coincide with port extension openings 1021-1024, respectively, of upper restrictor plate 5300. Port extension openings 1121-1122 may be disposed toward an end 5443 of upper chamber plate 5400, and port extension openings 1123-1124 may be disposed toward the other end 5444 of upper chamber plate 5400.

Figure 55:
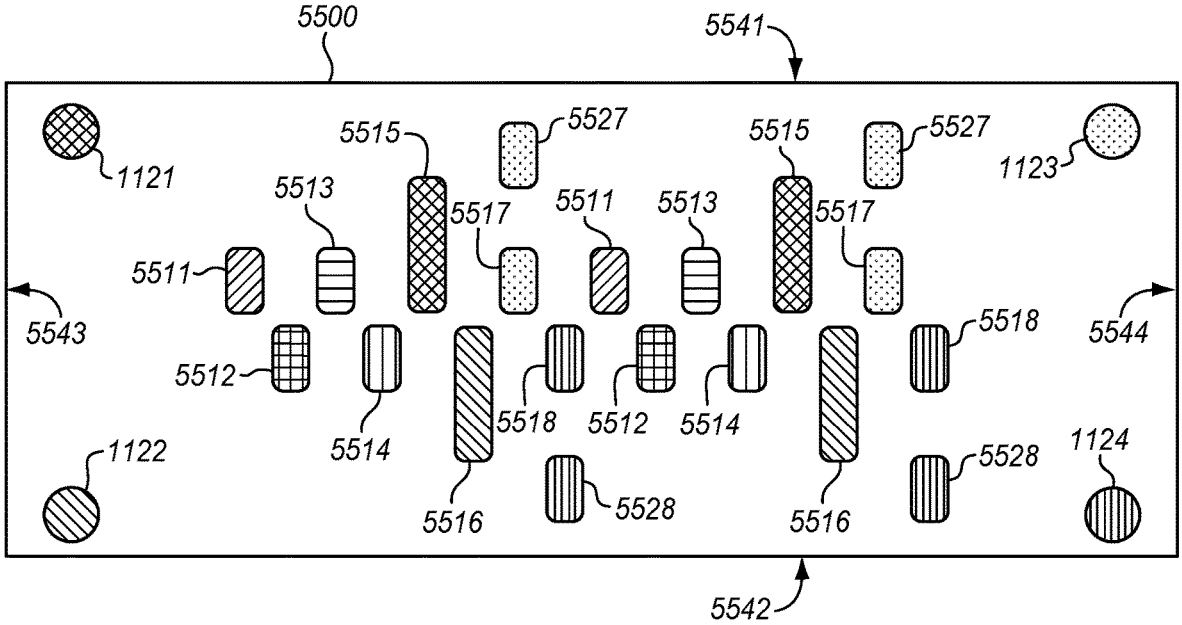
FIG. 55 is a plan view of a lower restrictor plate in an illustrative embodiment.

FIG. 55 is a plan view of lower restrictor plate 5500 in an illustrative embodiment. Lower restrictor plate 5500 is a thin sheet of material that is generally rectangular in shape and is substantially flat or planar. Lower restrictor plate 5500 includes restrictor openings 5515-5516. Restrictor openings 5515-5516 comprise elongated apertures or holes through lower restrictor plate 5500 transversely disposed or oriented. Restrictor openings 5515-5516 are configured to fluidly couple pressure chambers of jetting channels (for nozzles 405-406) with lower supply manifolds as described below. Restrictor openings 5515-5516 are formed in two rows (i.e., a top row and a bottom row), with restrictor openings 5515 in one row and restrictor openings 5516 in the other row and offset or staggered in relation to one another.

Lower restrictor plate 5500 further includes chamber openings 5511-5514 and 5517-5518 toward a middle region of lower restrictor plate 5500. Chamber openings 5511-5514 and 5517-5518 comprise apertures or holes through lower restrictor plate 5500 that form pressure chambers for a portion of the jetting channels (i.e., the jetting channels for nozzles 401-404 and 407-408). Chamber openings 5511-5514 and 5517-5518 do not extend transversely as far as restrictor openings 5515-5516 toward the long sides 5541-5542 of lower restrictor plate 5500. Chamber openings 5511-5514 and 5517-5518 are formed in two rows, with chamber openings 5511, 5513, and 5517 in one row, and chamber openings 5512, 5514, and 5518 in the other row that are offset or staggered in relation to one another.

Lower restrictor plate 5500 further includes manifold openings 5527-5528, which comprise apertures or holes through lower restrictor plate 5500. Manifold openings 5527 are disposed between a long side 5541 of lower restrictor plate 5500 and chamber openings 5517, and are aligned transversely with chamber openings 5517. Manifold openings 5528 are disposed between a long side 5542 of lower restrictor plate 5500 and chamber openings 5518, and are aligned transversely with chamber openings 5518. Lower restrictor plate 5500 also includes port extension openings 1121-1124 that coincide with port extension openings 1121-1124, respectively, of upper chamber plate 5400. Port extension openings 1121-1122 may be disposed toward an end 5543 of lower restrictor plate 5500, and port extension openings 1123-1124 may be disposed toward the other end 5544 of lower restrictor plate 5500.

Figure 56:
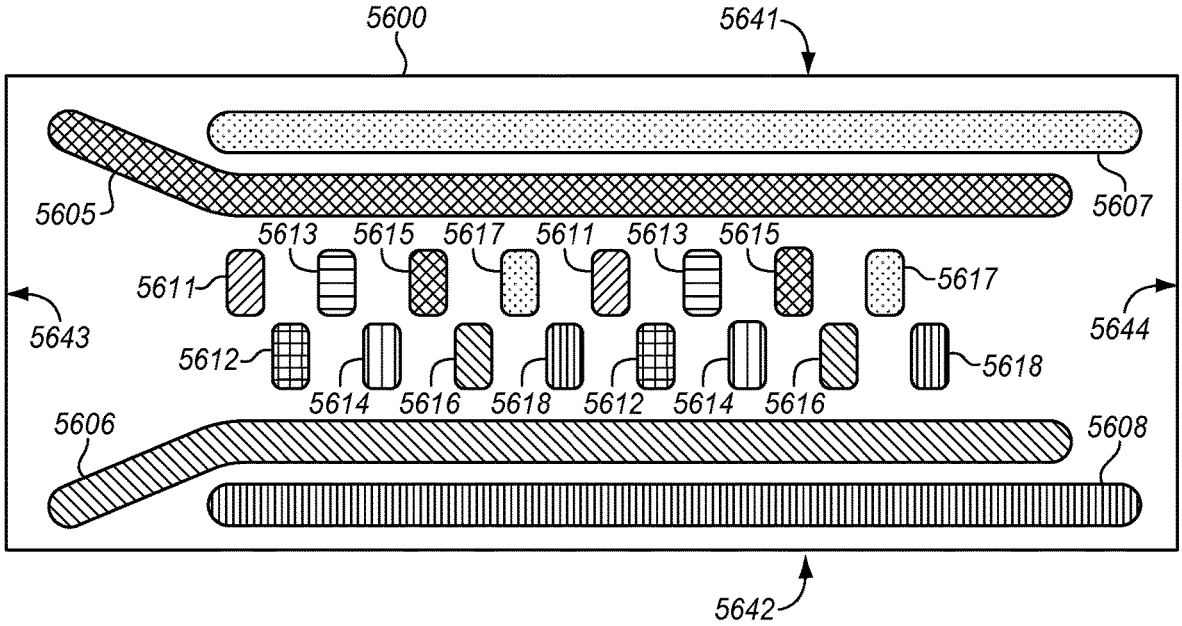
FIG. 56 is a plan view of a lower chamber plate in an illustrative embodiment.

FIG. 56 is a plan view of a lower chamber plate 5600 in an illustrative embodiment. Lower chamber plate 5600 is a thin sheet of material that is generally rectangular in shape and is substantially flat or planar. Lower chamber plate 5600 includes chamber openings 5611-5618 disposed toward a middle region of lower chamber plate 5600. Chamber openings 5611-5618 comprise apertures or holes through lower chamber plate 5600 that form pressure chambers for the jetting channels. Chamber openings 5611-5618 are aligned in two longitudinal rows that are staggered. Lower chamber plate 5600 further includes manifold openings 5605-5608, which comprise elongated apertures or holes through lower chamber plate 5600 disposed longitudinally along a length of lower chamber plate 5600 between ends 5643-5644. Manifold openings 5605 and 5607 are arranged side-by-side toward a long side 5641 of lower chamber plate 5600. In other words, manifold openings 5605 and 5607 run generally parallel to one another between long side 5641 and chamber openings 5611-5618. Likewise, manifold openings 5606 and 5608 are arranged side-by-side toward a long side 5642 of lower chamber plate 5600. In other words, manifold openings 5606 and 5608 run generally parallel to one another between long side 5642 and chamber openings 5611-5618. Manifold openings 5605-5608 form the lower supply manifolds (e.g., supply manifolds 515-518) of head member 102.

Figure 57:
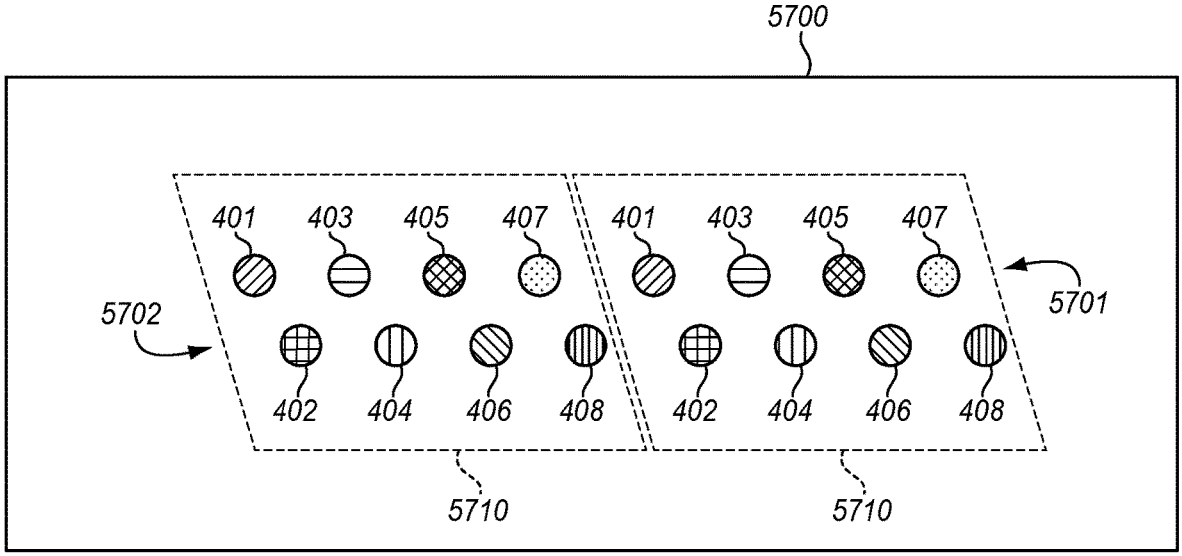
FIG. 57 is a plan view of a nozzle plate in an illustrative embodiment.

FIG. 57 is a plan view of nozzle plate 5700 in an illustrative embodiment. Nozzle plate 5700 is a thin sheet of material that is generally rectangular in shape and is substantially flat or planar. Nozzle plate 5700 includes orifices that form nozzles 401-408 of the jetting channels. In this embodiment, nozzles 401-408 are arranged in two nozzle rows 5701-5702 that are staggered or offset from one another. Nozzles 401, 403, 405, and 407 are in nozzle row 5701, and nozzles 402, 404, 406, and 408 are in nozzle row 5702. Nozzles 401-408 are arranged into groupings 5710 of eight adjacent nozzles, and each nozzle 401-408 in a grouping 5710 is configured to jet a different type of print fluid. Each of the nozzles 401-408 in a grouping 5710 is adjacent to at least one other nozzle in the grouping 5710 (regardless of row). Thus, the adjacent nozzles 401-408 are able to print consecutive pixels in a pixel row.

Figure 58:
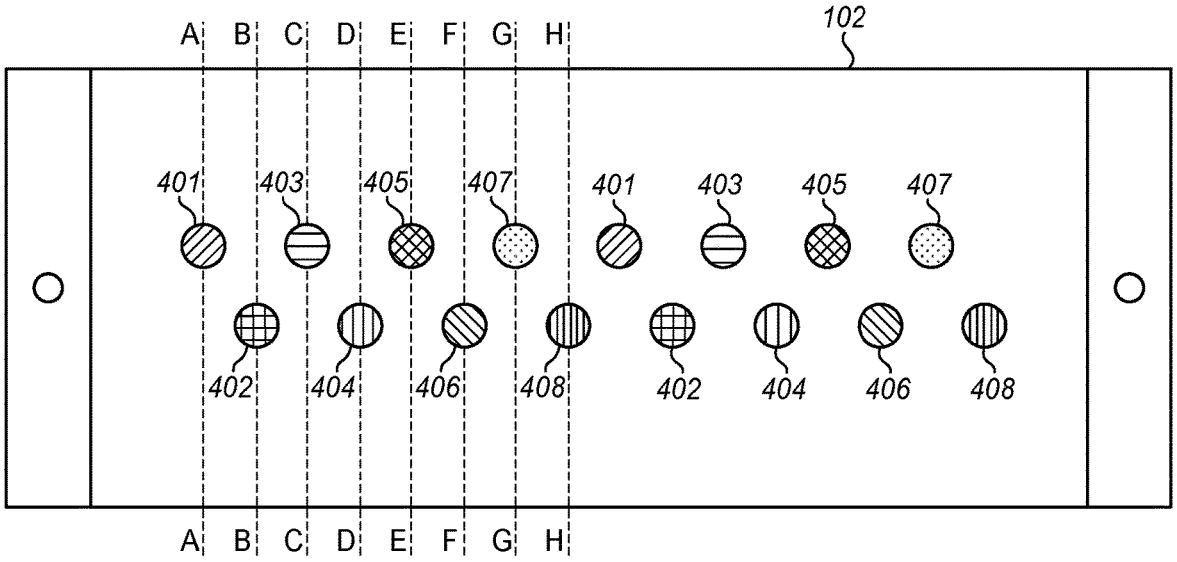
FIG. 58 is a bottom view of a head member in an illustrative embodiment.
Figure 59:
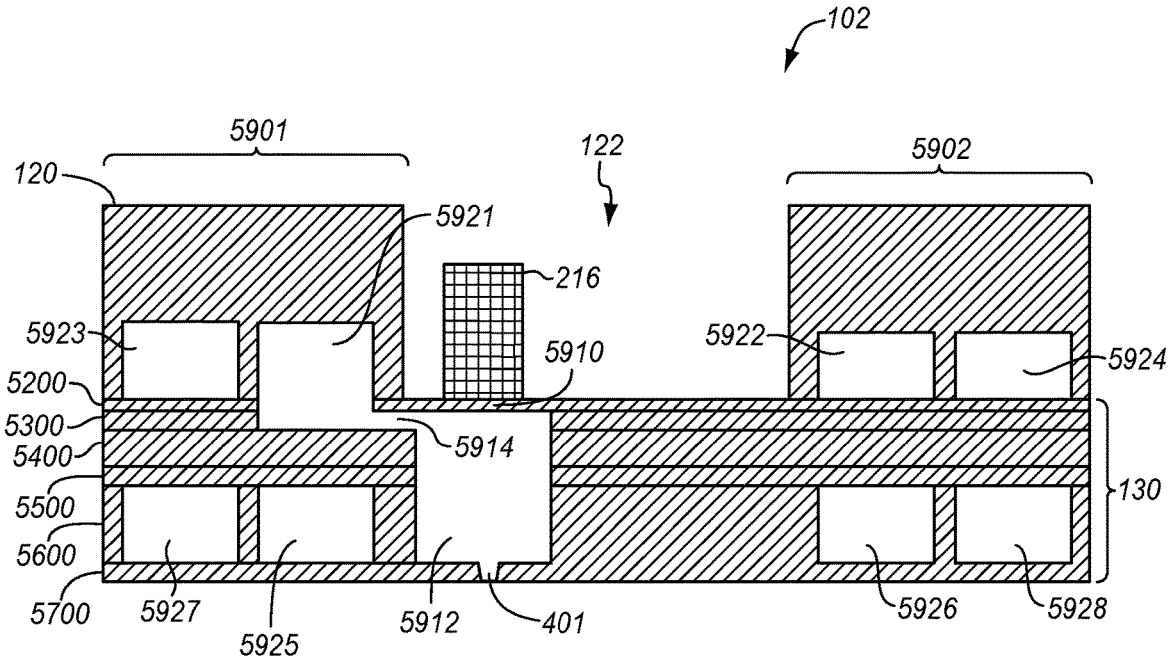
FIGS. 59-66 are cross-sectional views of a head member in an illustrative embodiment.

FIG. 58 is a bottom view of head member 102 in an illustrative embodiment. FIGS. 59-66 are cross-sectional views of head member 102 in an illustrative embodiment. The view in FIG. 59 is across cut plane A-A in FIG. 58. From top to bottom in FIG. 59, head member 102 includes housing 120, diaphragm plate 5200, upper restrictor plate 5300, upper chamber plate 5400, lower restrictor plate 5500, lower chamber plate 5600, and nozzle plate 5700. As is visible in FIG. 59, head member 102 includes (at least) four upper supply manifolds 5921-5924, and (at least) four lower supply manifolds 5925-5928. In this embodiment, a pair of upper supply manifolds 5921/5923 are disposed longitudinally on one side 5901 of head member 102 (i.e., one side of the jetting channel(s)), and a pair of upper supply manifolds 5922/5924 are disposed longitudinally on the other side 5902 of head member 102. Upper supply manifold 5921 is formed with manifold duct 801 and manifold openings 901, upper supply manifold 5922 is formed with manifold duct 802 and manifold openings 902, upper supply manifold 5923 is formed with manifold duct 803 and manifold openings 903, and upper supply manifold 5924 is formed with manifold duct 804 and manifold openings 904 (see FIGS. 51-52). Upper supply manifolds 5921/5923 run generally parallel to one another lengthwise on side 5901 (i.e., into and out of the page), and upper supply manifolds 5922/5924 run generally parallel to one another lengthwise on side 5902.

Further in this embodiment, a pair of lower supply manifolds 5925/5927 are disposed longitudinally on one side 5901 of head member 102, and a pair of lower supply manifolds 5926/5928 are disposed longitudinally on the other side 5902 of head member 102. Lower supply manifold 5925 is formed with manifold opening 5605, lower supply manifold 5926 is formed with manifold opening 5606, lower supply manifold 5927 is formed with manifold opening 5607, and lower supply manifold 5928 is formed with manifold opening 5608 (see FIG. 56). Lower supply manifolds 5925/5927 run generally parallel to one another lengthwise on side 5901, and lower supply manifolds 5926/5928 run generally parallel to one another lengthwise on side 5902.

Upper supply manifolds 5921-5924 and lower supply manifolds 5925-5928 are vertically stacked or aligned within head member 102. For example, upper supply manifold 5921 is vertically aligned with lower supply manifold 5925, upper supply manifold 5922 is vertically aligned with lower supply manifold 5926, upper supply manifold 5923 is vertically aligned with lower supply manifold 5927, and upper supply manifold 5924 is vertically aligned with lower supply manifold 5928.

Plate stack 130 forms a jetting channel for nozzle 401. The jetting channel includes diaphragm 5910, pressure chamber 5912, and nozzle 401. Pressure chamber 5912 is fluidly coupled to upper supply manifold 5921 via restrictor 5914 (formed with restrictor opening 5311 in FIG. 53). Restrictor 5914 controls the flow of print fluid from upper supply manifold 5921 to pressure chamber 5912. Actuation by actuator 216 will cause the print fluid to be ejected out of the jetting channel through nozzle 401. The jetting channel for nozzle 401 is fluidly coupled to upper supply manifold 5921, and is fluidly isolated from the other supply manifolds so that it receives one type of print fluid.

Figure 60:
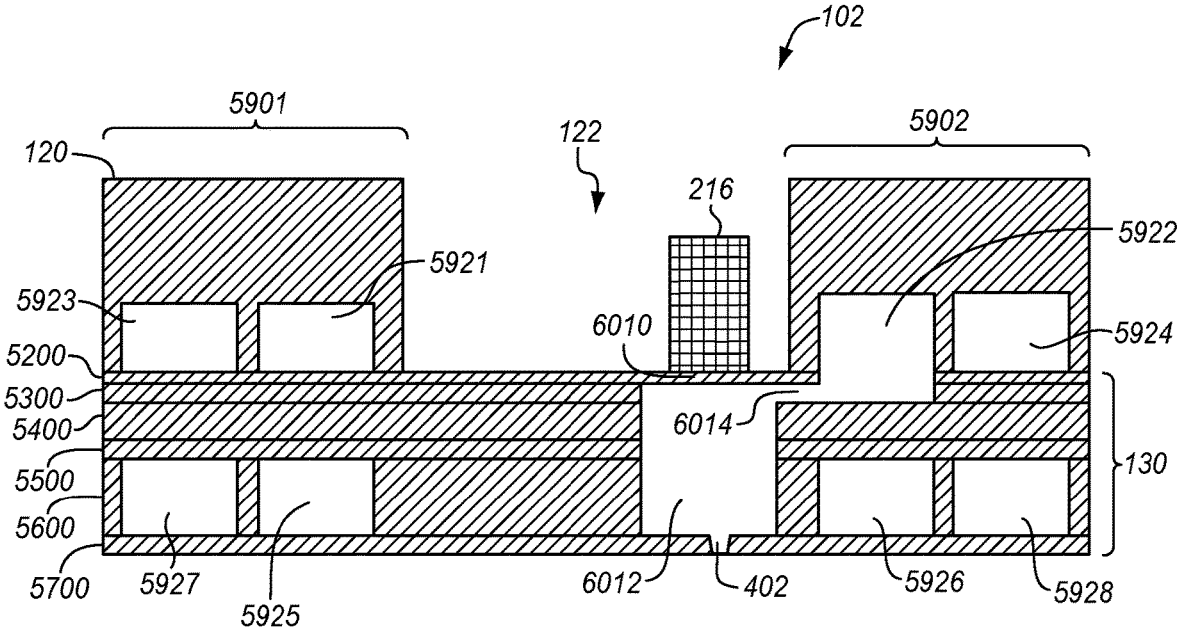

The view in FIG. 60 is across cut plane B-B in FIG. 58, showing a jetting channel for nozzle 402. The jetting channel includes diaphragm 6010, pressure chamber 6012, and nozzle 402. Pressure chamber 6012 is fluidly coupled to upper supply manifold 5922 via restrictor 6014 (formed with restrictor opening 5312 in FIG. 53). Restrictor 6014 controls the flow of print fluid from upper supply manifold 5922 to pressure chamber 6012. Actuation by actuator 216 will cause the print fluid to be ejected out of the jetting channel through nozzle 402. The jetting channel for nozzle 402 is fluidly coupled to upper supply manifold 5922, and is fluidly isolated from the other supply manifolds so that it receives one type of print fluid.

Figure 61:
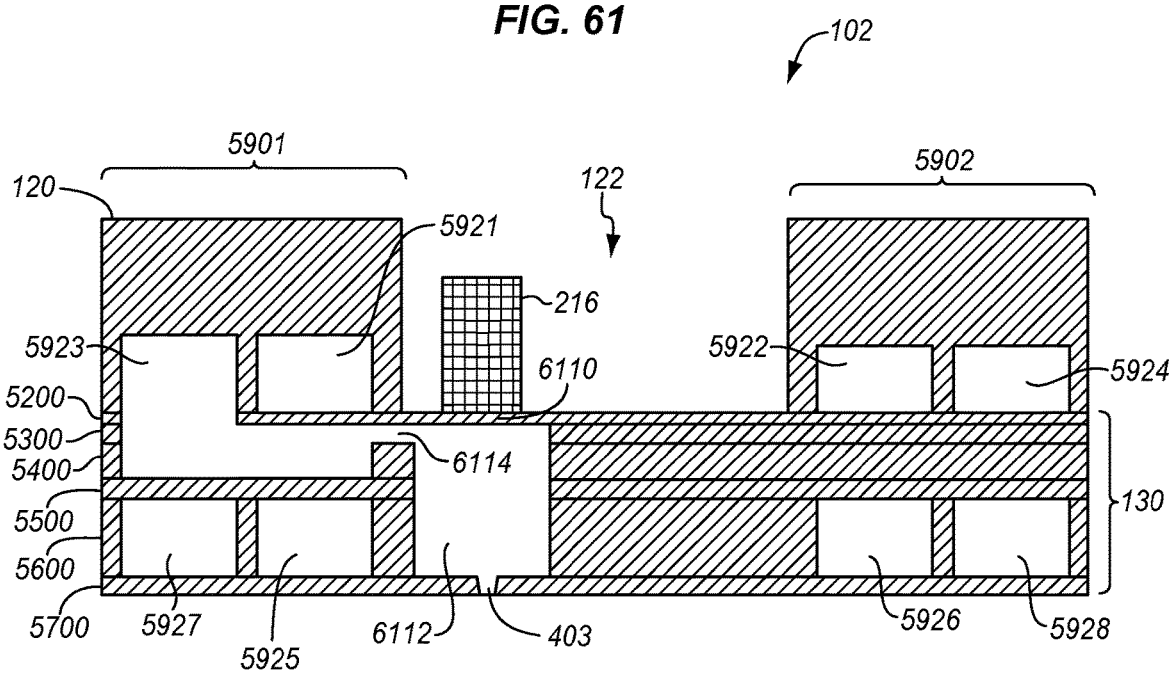

The view in FIG. 61 is across cut plane C-C in FIG. 58, showing a jetting channel for nozzle 403. The jetting channel includes diaphragm 6110, pressure chamber 6112, and nozzle 403. Pressure chamber 6112 is fluidly coupled to upper supply manifold 5923 via restrictor 6114 (formed with restrictor opening 5313 in FIG. 53). Restrictor 6114 controls the flow of print fluid from upper supply manifold 5923 to pressure chamber 6112. Actuation by actuator 216 will cause the print fluid to be ejected out of the jetting channel through nozzle 403. The jetting channel for nozzle 403 is fluidly coupled to upper supply manifold 5923, and is fluidly isolated from the other supply manifolds so that it receives one type of print fluid.

Figure 62:
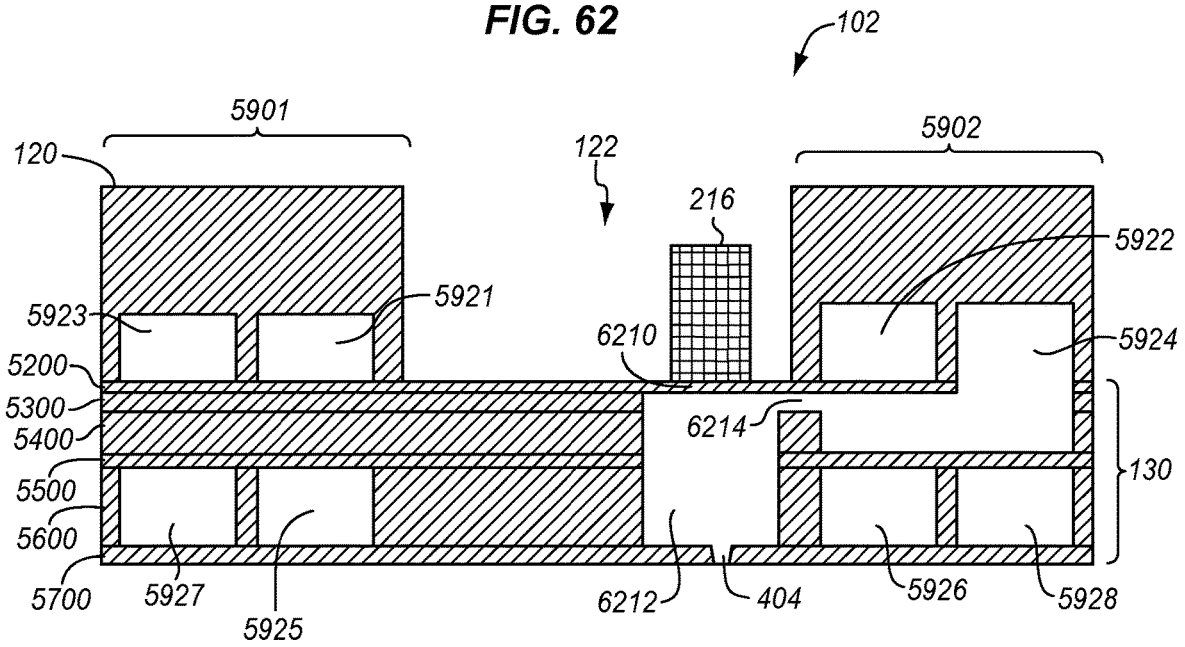

The view in FIG. 62 is across cut plane D-D in FIG. 58, showing a jetting channel for nozzle 404. The jetting channel includes diaphragm 6210, pressure chamber 6212, and nozzle 404. Pressure chamber 6212 is fluidly coupled to upper supply manifold 5924 via restrictor 6214 (formed with restrictor opening 5314 in FIG. 53). Restrictor 6214 controls the flow of print fluid from upper supply manifold 5924 to pressure chamber 6212. Actuation by actuator 216 will cause the print fluid to be ejected out of the jetting channel through nozzle 404. The jetting channel for nozzle 404 is fluidly coupled to upper supply manifold 5924, and is fluidly isolated from the other supply manifolds so that it receives one type of print fluid.

Figure 63:
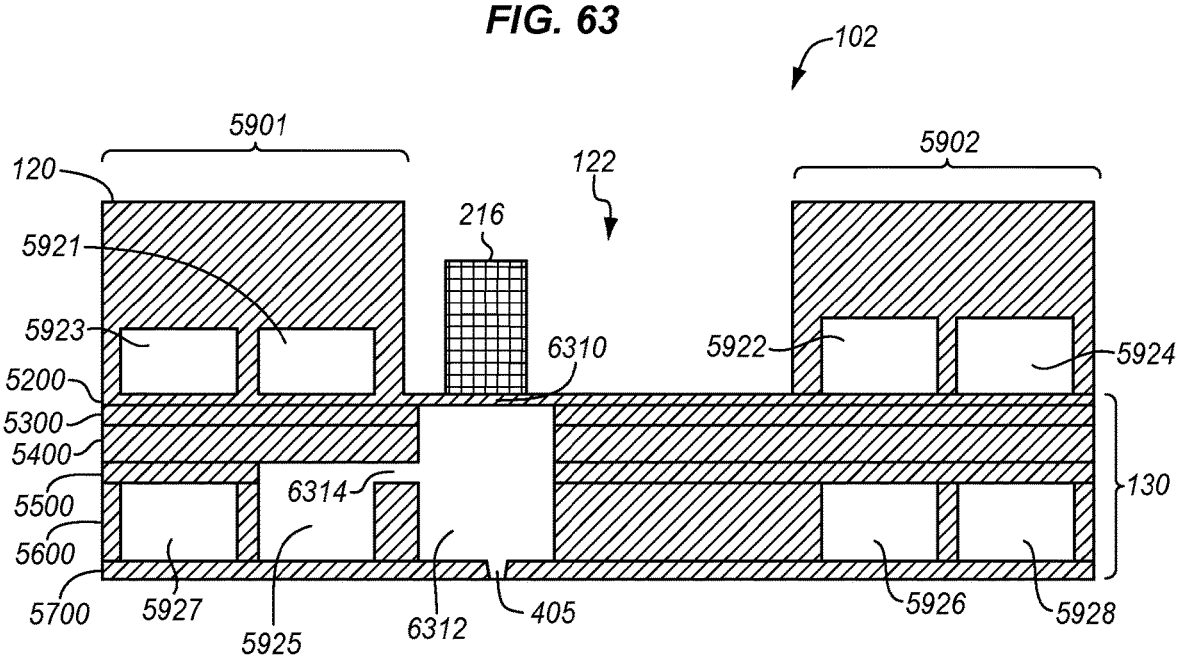

The view in FIG. 63 is across cut plane E-E in FIG. 58, showing a jetting channel for nozzle 405. The jetting channel includes diaphragm 6310, pressure chamber 6312, and nozzle 405. Pressure chamber 6312 is fluidly coupled to lower supply manifold 5925 via restrictor 6314 (formed with restrictor opening 5515 in FIG. 55). Restrictor 6314 controls the flow of print fluid from lower supply manifold 5925 to pressure chamber 6312. Actuation by actuator 216 will cause the print fluid to be ejected out of the jetting channel through nozzle 405. The jetting channel for nozzle 405 is fluidly coupled to lower supply manifold 5925, and is fluidly isolated from the other supply manifolds so that it receives one type of print fluid.

Figure 64:
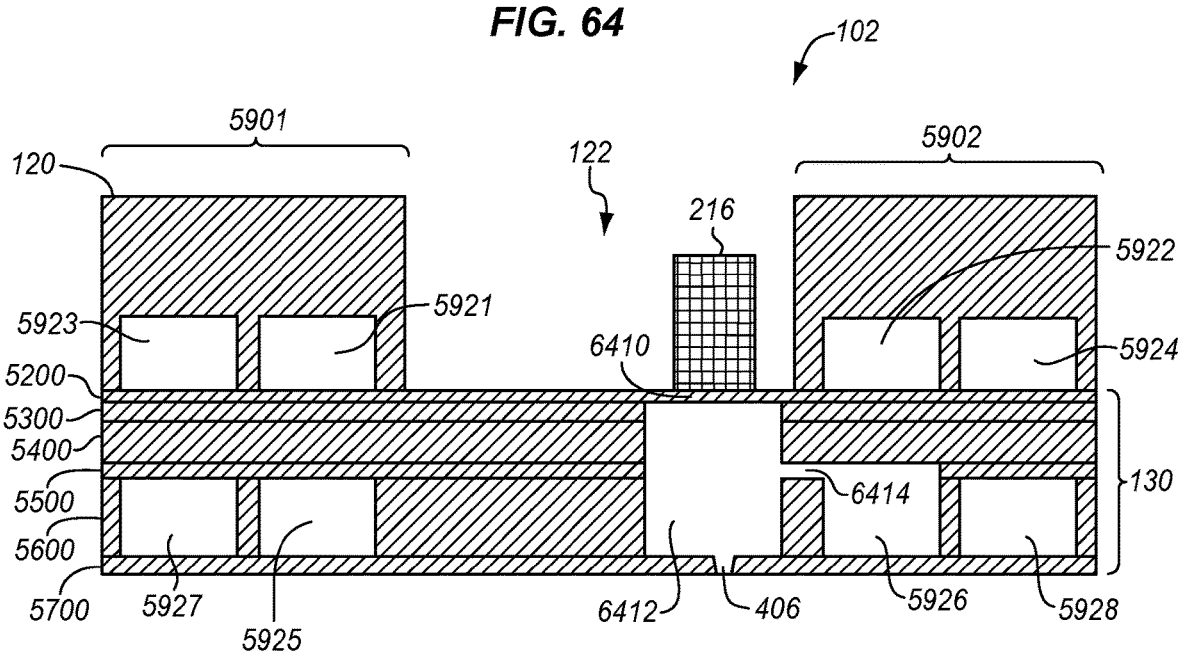

The view in FIG. 64 is across cut plane F-F in FIG. 58, showing a jetting channel for nozzle 406. The jetting channel includes diaphragm 6410, pressure chamber 6412, and nozzle 406. Pressure chamber 6412 is fluidly coupled to lower supply manifold 5926 via restrictor 6414 (formed with restrictor opening 5516 in FIG. 55). Restrictor 6414 controls the flow of print fluid from lower supply manifold 5926 to pressure chamber 6412. Actuation by actuator 216 will cause the print fluid to be ejected out of the jetting channel through nozzle 406. The jetting channel for nozzle 406 is fluidly coupled to lower supply manifold 5926, and is fluidly isolated from the other supply manifolds so that it receives one type of print fluid.

Figure 65:
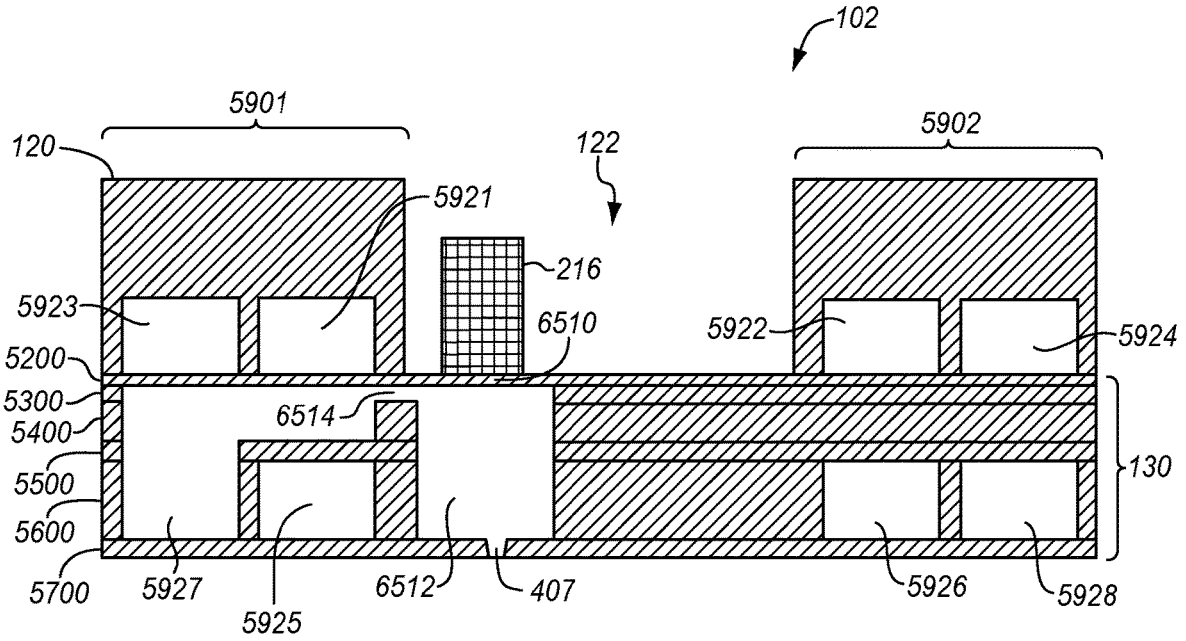

The view in FIG. 65 is across cut plane G-G in FIG. 58, showing a jetting channel for nozzle 407. The jetting channel includes diaphragm 6510, pressure chamber 6512, and nozzle 407. Pressure chamber 6512 is fluidly coupled to lower supply manifold 5927 via restrictor 6514 (formed with restrictor opening 5317 in FIG. 53). Restrictor 6514 controls the flow of print fluid from lower supply manifold 5927 to pressure chamber 6512. Actuation by actuator 216 will cause the print fluid to be ejected out of the jetting channel through nozzle 407. The jetting channel for nozzle 407 is fluidly coupled to lower supply manifold 5927, and is fluidly isolated from the other supply manifolds so that it receives one type of print fluid.

Figure 66:
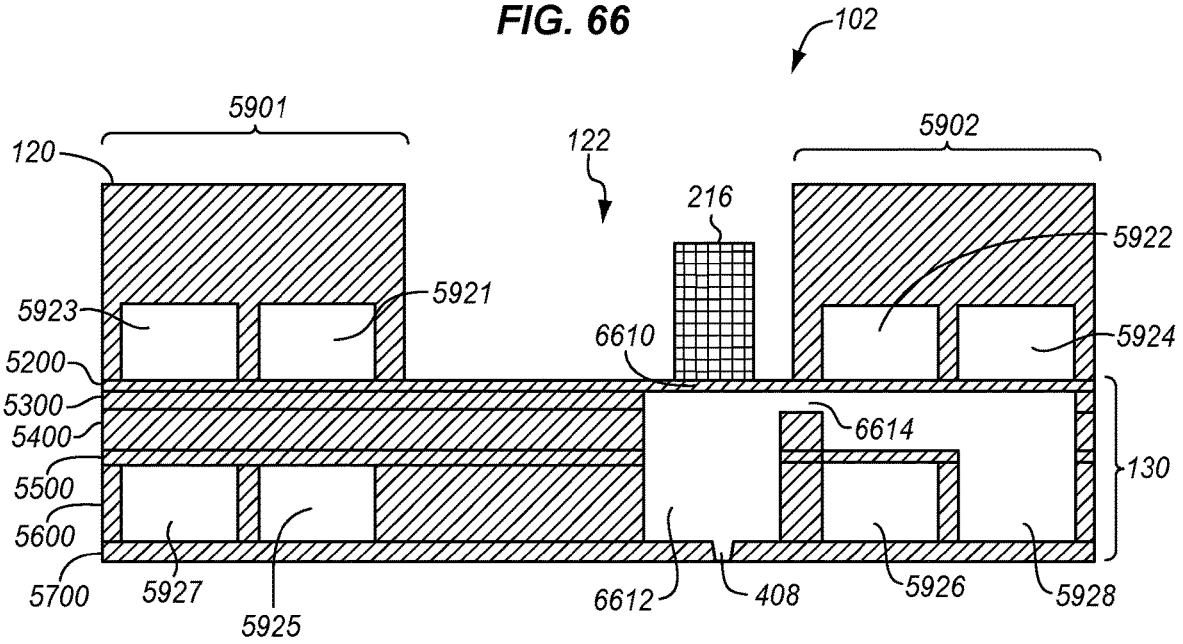

The view in FIG. 66 is across cut plane H-H in FIG. 58, showing a jetting channel for nozzle 408. The jetting channel includes diaphragm 6610, pressure chamber 6612, and nozzle 408. Pressure chamber 6612 is fluidly coupled to lower supply manifold 5928 via restrictor 6614 (formed with restrictor opening 5318 in FIG. 53). Restrictor 6614 controls the flow of print fluid from lower supply manifold 5928 to pressure chamber 6612. Actuation by actuator 216 will cause the print fluid to be ejected out of the jetting channel through nozzle 408. The jetting channel for nozzle 408 is fluidly coupled to lower supply manifold 5928, and is fluidly isolated from the other supply manifolds so that it receives one type of print fluid.

In the embodiment shown in FIGS. 58-66, the jetting channels/nozzles are in two rows and staggered. Similar concepts as described above may be used for jetting channels/nozzles in two rows that are aligned, such as is shown in FIG. 6.

Figure 67:
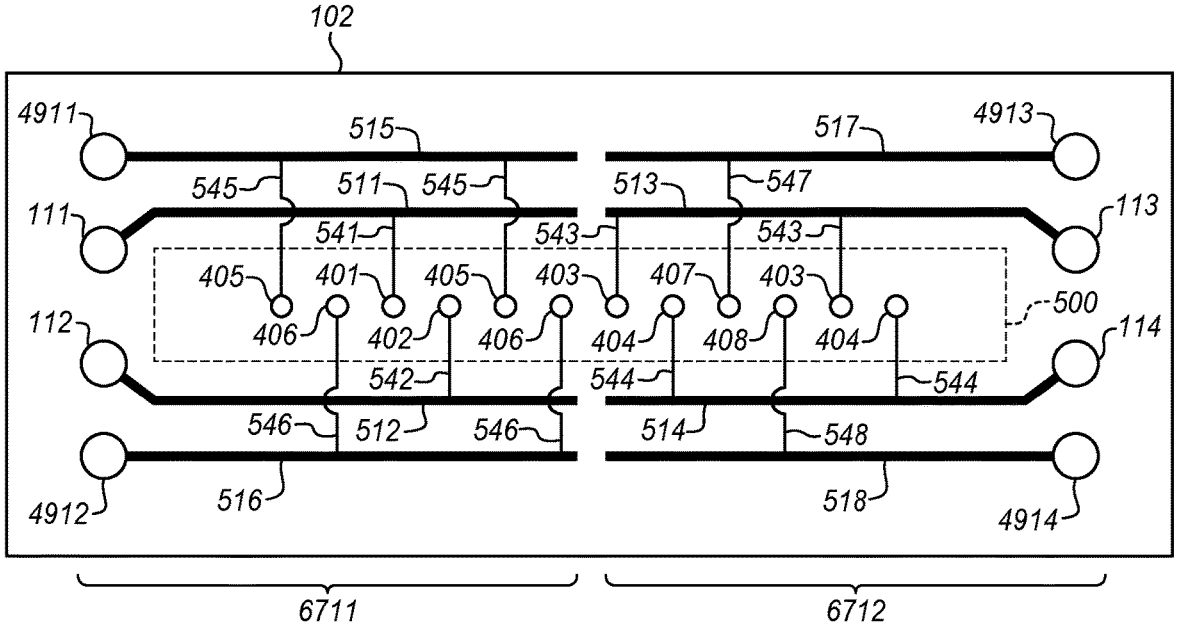
FIG. 67 is a schematic diagram of a head member in an illustrative embodiment.

FIGS. 67-73 illustrate the structure of head member 102 in another illustrative embodiment. Again, the structural elements in these figures are not drawn to scale, and are provided as an example. FIG. 67 is a schematic diagram of head member 102 in an illustrative embodiment. Head member 102 includes supply manifolds 511-518 that are disposed longitudinally. Supply manifold 511 is fluidly coupled to inlet port 111, and is fluidly coupled to a subset of the jetting channels indicated by nozzles 401 via fluid path 541. Thus, when a first print fluid (e.g., a first color of ink) is supplied to inlet port 111, supply manifold 511 receives the first print fluid and supplies the first print fluid to the subset of jetting channels for nozzles 401. Supply manifold 512 is fluidly coupled to inlet port 112, and is fluidly coupled to a subset of the jetting channels indicated by nozzles 402 via fluid path 542. Thus, when a second print fluid (e.g., a second color of ink) is supplied to inlet port 112, supply manifold 512 receives the second print fluid and supplies the second print fluid to the subset of jetting channels for nozzles 402. Supply manifold 513 is fluidly coupled to inlet port 113, and is fluidly coupled to a subset of the jetting channels indicated by nozzles 403 via fluid path 543. Thus, when a third print fluid (e.g., a third color of ink) is supplied to inlet port 113, supply manifold 513 receives the third print fluid and supplies the third print fluid to the subset of jetting channels for nozzles 403. Supply manifold 514 is fluidly coupled to inlet port 114, and is fluidly coupled to a subset of the jetting channels indicated by nozzles 404 via fluid path 544. Thus, when a fourth print fluid (e.g., a fourth color of ink) is supplied to inlet port 114, supply manifold 514 receives the fourth print fluid and supplies the fourth print fluid to the subset of jetting channels for nozzles 404. Supply manifold 515 is fluidly coupled to inlet port 4911, and is fluidly coupled to a subset of the jetting channels indicated by nozzles 405 via fluid path 545. Thus, when a fifth print fluid (e.g., a fifth color of ink) is supplied to inlet port 4911, supply manifold 515 receives the fifth print fluid and supplies the fifth print fluid to the subset of jetting channels for nozzles 405. Supply manifold 516 is fluidly coupled to inlet port 4912, and is fluidly coupled to a subset of the jetting channels indicated by nozzles 406 via fluid path 546. Thus, when a sixth print fluid (e.g., a sixth color of ink) is supplied to inlet port 4912, supply manifold 516 receives the sixth print fluid and supplies the sixth print fluid to the subset of jetting channels for nozzles 406. Supply manifold 517 is fluidly coupled to inlet port 4913, and is fluidly coupled to a subset of the jetting channels indicated by nozzles 407 via fluid path 547. Thus, when a seventh print fluid (e.g., a seventh color of ink) is supplied to inlet port 4913, supply manifold 517 receives the seventh print fluid and supplies the seventh print fluid to the subset of jetting channels for nozzles 407. Supply manifold 518 is fluidly coupled to inlet port 4914, and is fluidly coupled to a subset of the jetting channels indicated by nozzles 408 via fluid path 548. Thus, when an eighth print fluid (e.g., an eighth color of ink) is supplied to inlet port 4914, supply manifold 518 receives the eighth print fluid and supplies the eighth print fluid to the subset of jetting channels for nozzles 408.

In this embodiment, head member 102 includes eight supply manifolds 511-518. For example, supply manifolds 511-514 may represent upper supply manifolds for head member 102, and supply manifolds 515-518 may represent lower supply manifolds. Two of the upper supply manifolds (e.g., supply manifolds 511 and 513) may be disposed on one side of the row(s) of jetting channels, and the other two of the upper supply manifolds (e.g., supply manifolds 512 and 514) may be disposed on the other side of the row(s) of jetting channels. Likewise, two of the lower supply manifolds (e.g., supply manifolds 515 and 517) may be disposed on one side of the row(s) of jetting channels, and the other two of the lower supply manifolds (e.g., supply manifolds 516 and 518) may be disposed on the other side of the row(s) of jetting channels.

As will be described in more detail below, supply manifolds 511-518 extend longitudinally part way along the length of head member 102. Thus, head member 102 is schematically divided into half-sections 6711-6712. The term "half-section" refers to a lengthwise or longitudinal segment of head member 102 that does not extend along an entire row of jetting channels. Half-sections 6711-6712 do not have to be equal in size/length (i.e., not exactly half), as head member 102 may be schematically divided in different ways. Separate supply manifolds are disposed in half-sections 6711-6712 to supply print fluids to jetting channels located in the respective half-sections 6711-6712. In one embodiment, a supply manifold in half-section 6711 may be aligned lengthwise with a supply manifold in half-section 6712. For example, supply manifold 511 in half-section 6711 may be aligned lengthwise with supply manifold 513 in half-section 6712. Supply manifold 515 in half-section 6711 may be aligned lengthwise with supply manifold 517 in half-section 6712. Supply manifold 512 in half-section 6711 may be aligned lengthwise with supply manifold 514 in half-section 6712. Supply manifold 516 in half-section 6711 may be aligned lengthwise with supply manifold 518 in half-section 6712.

Figure 68:
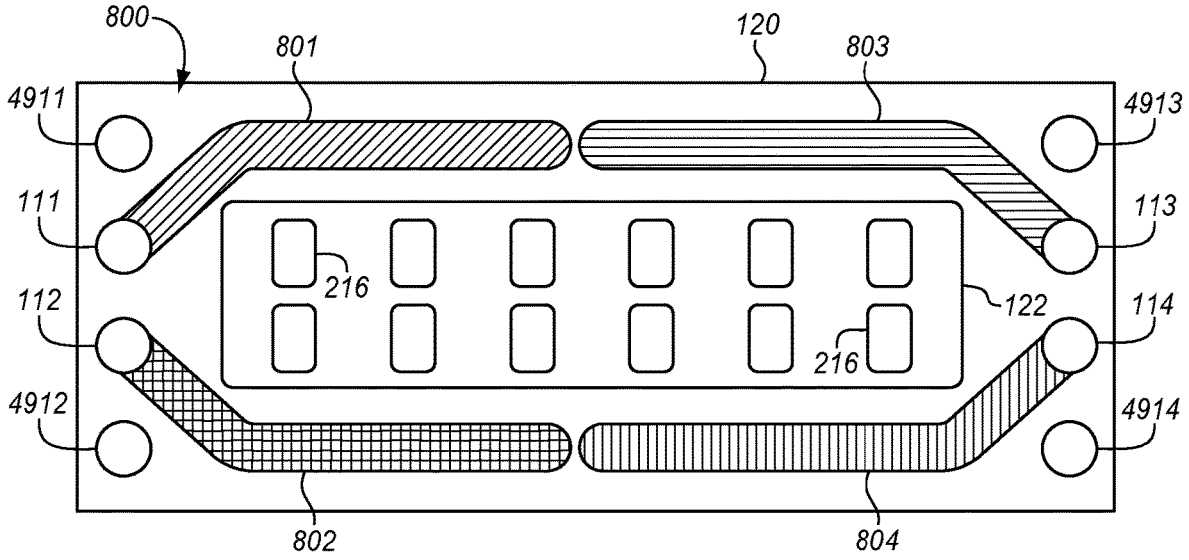
FIG. 68 is a bottom view of a housing in an illustrative embodiment.

FIG. 68 is a bottom view of housing 120 in an illustrative embodiment. Housing 120 includes manifold ducts 801-804 disposed longitudinally along a length of housing 120 on interface surface 800. Manifold ducts 801-804 are fluidly coupled to inlet ports 111-114, respectively. Manifold ducts 801 and 803 are longitudinally aligned on one side of housing 120 (i.e., on one side of access hole 122). Similarly, manifold ducts 802 and 804 are longitudinally aligned on the other side of housing 120 (i.e., on the other side of access hole 122). Manifold ducts 801-804 form upper supply manifolds for head member 102. Inlet ports 4911-4914 are also visible as extending through housing 120, and will be fluidly coupled to lower supply manifolds as is described in more detail below.

Figure 69:
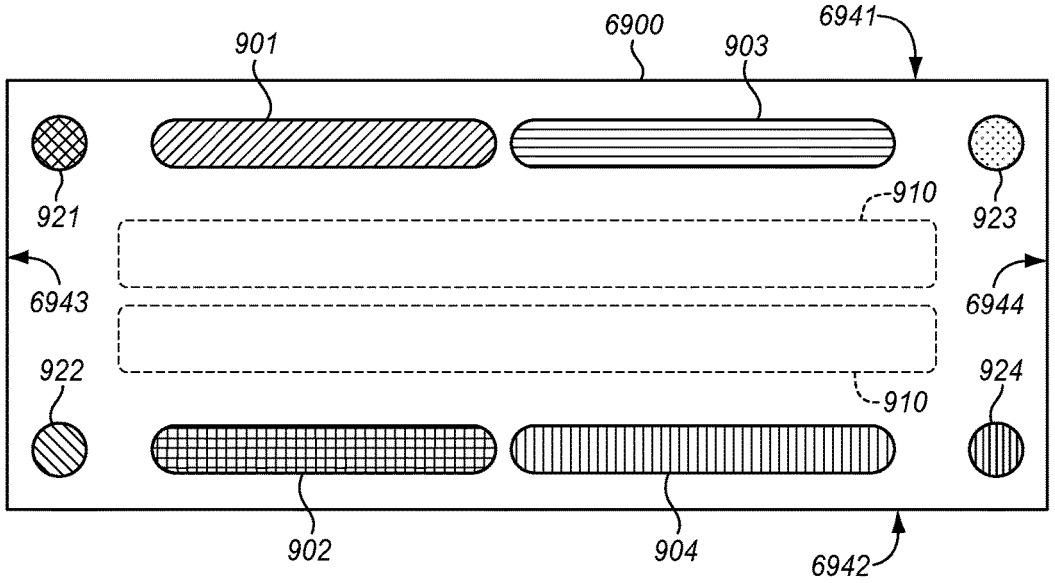
FIG. 69 is a plan view of a diaphragm plate in an illustrative embodiment.

FIGS. 69-73 show another example of plate stack 130 that includes a diaphragm plate, an upper restrictor plate, a lower restrictor plate, a chamber plate, and a nozzle plate. FIG. 69 is a plan view of a diaphragm plate 6900 in an illustrative embodiment. Diaphragm plate 6900 includes diaphragm sections 910 comprising a semi-flexible material that forms diaphragms for the jetting channels. Diaphragm plate 6900 further includes manifold openings 901-904, which comprise elongated apertures or holes through diaphragm plate 6900 disposed longitudinally along a length of diaphragm plate 6900. Manifold opening 901 is configured to fluidly couple with manifold duct 801 in housing 120 to form an upper supply manifold (e.g., supply manifold 511). Manifold opening 902 is configured to fluidly couple with manifold duct 802 in housing 120 to form another upper supply manifold (e.g., supply manifold 512). Manifold opening 903 is configured to fluidly couple with manifold duct 803 in housing 120 to form another upper supply manifold (e.g., supply manifold 513). Manifold opening 904 is configured to fluidly couple with manifold duct 804 in housing 120 to form another upper supply manifold (e.g., supply manifold 514). Manifold openings 901 and 903 are disposed toward long side 6941 of diaphragm plate 6900 (i.e., between diaphragm sections 910 and long side 6941), and are longitudinally aligned. Manifold openings 902 and 904 are disposed toward long side 6942 of diaphragm plate 6900 (i.e., between diaphragm sections 910 and long side 6942), and are longitudinally aligned.

Diaphragm plate 6900 also includes port extension openings 921-924 that coincide with inlet ports 4911-4914, respectively, of housing 120. Port extension openings 921-922 may be disposed toward one end 6943 of diaphragm plate 6900, and port extension openings 923-924 may be disposed toward the other end 6944 of diaphragm plate 6900.

Figure 70:
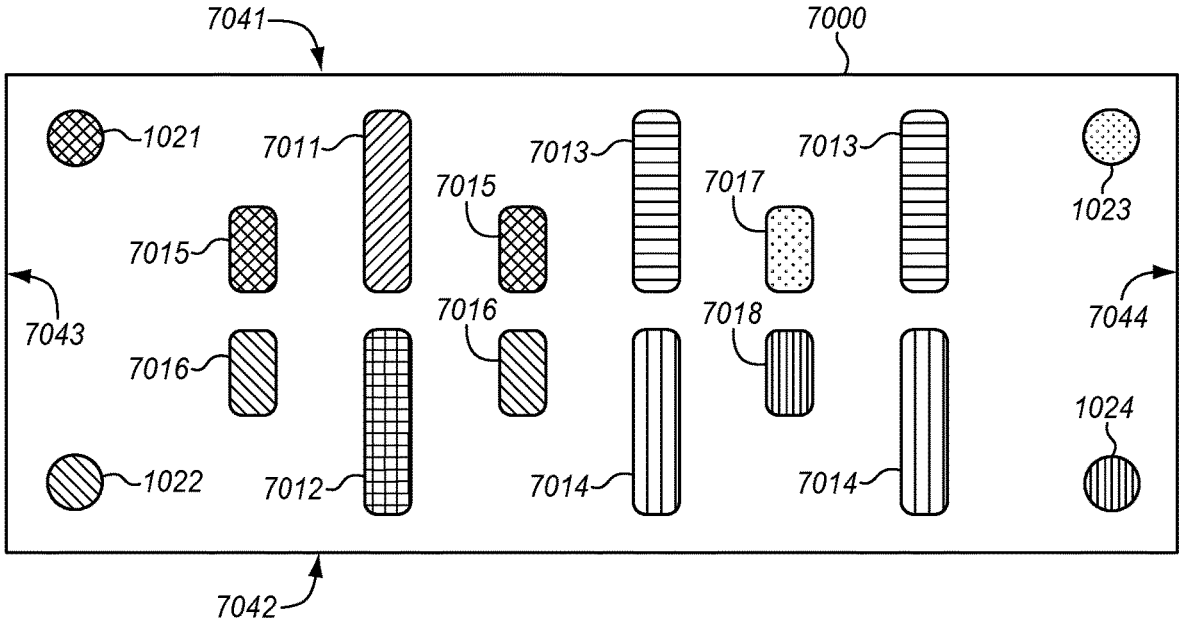
FIG. 70 is a plan view of an upper restrictor plate in an illustrative embodiment.

FIG. 70 is a plan view of upper restrictor plate 7000 in an illustrative embodiment. Upper restrictor plate 7000 is a thin sheet of material that is generally rectangular in shape and is substantially flat or planar. Upper restrictor plate 7000 includes restrictor openings 7011-7014. Restrictor openings 7011-7014 comprise elongated apertures or holes through upper restrictor plate 7000 transversely disposed or oriented. Restrictor openings 7011 are configured to fluidly couple pressure chambers of jetting channels (for nozzles 401) with manifold openings 901 of diaphragm plate 6900. Restrictor openings 7012 are configured to fluidly couple pressure chambers of j jetting channels (for nozzles 402) with manifold openings 902 of diaphragm plate 6900. Restrictor openings 7013 are configured to fluidly couple pressure chambers of jetting channels (for nozzles 403) with manifold openings 903 of diaphragm plate 6900. Restrictor openings 7014 are configured to fluidly couple pressure chambers of jetting channels (for nozzles 404) with manifold openings 904 of diaphragm plate 6900. Restrictor openings 7011-7014 are formed in two rows (i.e., a top row and a bottom row), with restrictor openings 7011 and 7013 in one row and restrictor openings 7012 and 7014 in the other row (in transverse alignment).

Upper restrictor plate 7000 further includes chamber openings 7015-7018 toward a middle region of upper restrictor plate 7000. Chamber openings 7015-7018 comprise apertures or holes through upper restrictor plate 7000 that form pressure chambers for a portion of the jetting channels (i.e., the jetting channels for nozzles 405-408). Chamber openings 7015-7018 do not extend transversely as far as restrictor openings 7011-7014 toward the long sides 7041-7042 of upper restrictor plate 7000. Chamber openings 7015-7018 are formed in two rows, with chamber openings 7015 and 7017 in one row and chamber openings 7016 and 7018 in the other row (in transverse alignment). Upper restrictor plate 7000 also includes port extension openings 1021-1024 that coincide with port extension openings 921-924, respectively, of diaphragm plate 6900. Port extension openings 1021-1022 may be disposed toward an end 7043 of upper restrictor plate 7000, and port extension openings 1023-1024 may be disposed toward the other end 7044 of upper restrictor plate 7000.

Figure 71:
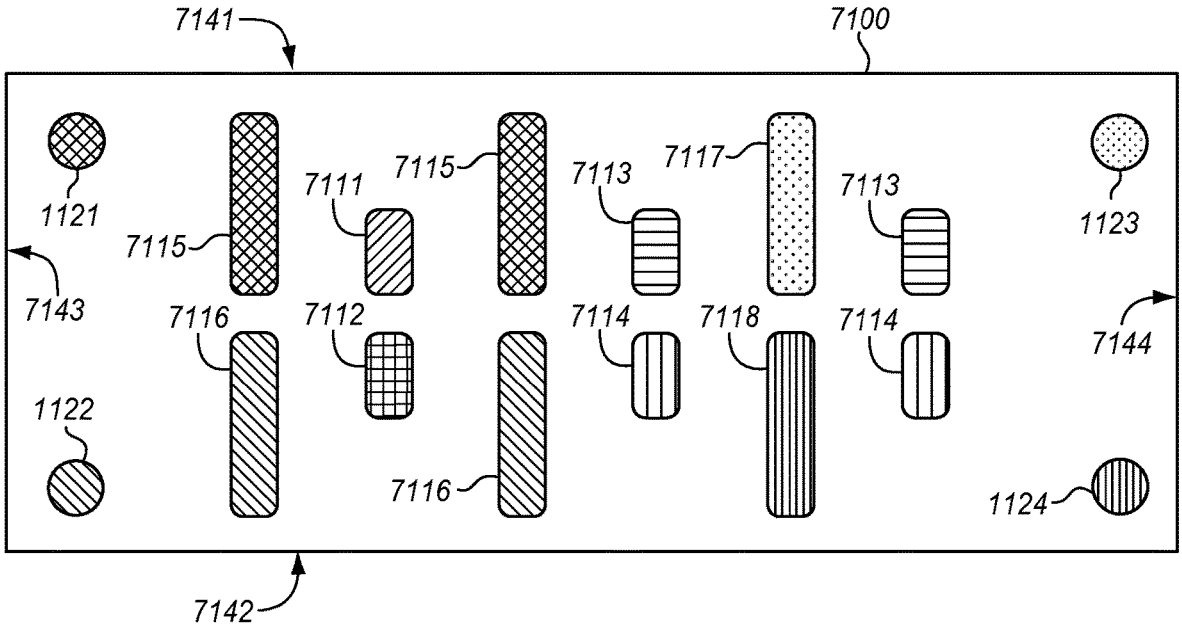
FIG. 71 is a plan view of a lower restrictor plate in an illustrative embodiment.

FIG. 71 is a plan view of lower restrictor plate 7100 in an illustrative embodiment. Lower restrictor plate 7100 is a thin sheet of material that is generally rectangular in shape and is substantially flat or planar. Lower restrictor plate 7100 includes restrictor openings 7115-7118. Restrictor openings 7115-7118 comprise elongated apertures or holes through lower restrictor plate 7100 transversely disposed or oriented. Restrictor openings 7115-7118 are configured to fluidly couple pressure chambers of jetting channels (for nozzles 405-408) with lower supply manifolds as described below. Restrictor openings 7115-7118 are formed in two rows (i.e., a top row and a bottom row), with restrictor openings 7115 and 7117 in one row and restrictor openings 7116 and 7118 in the other row (in transverse alignment). Lower restrictor plate 7100 further includes chamber openings 7111-7114 toward a middle region of lower restrictor plate 7100. Chamber openings 7111-7114 comprise apertures or holes through lower restrictor plate 7100 that form pressure chambers for a portion of the jetting channels (i.e., the jetting channels for nozzles 401-404). Chamber openings 7111-7114 do not extend transversely as far as restrictor openings 7115-7118 toward the long sides 7141-7142 of lower restrictor plate 7100. Chamber openings 7111-7114 are formed in two rows, with chamber openings 7111 and 7113 in one row, and chamber openings 7112 and 7114 in the other row (in transverse alignment). Lower restrictor plate 7100 also includes port extension openings 1121-1124 that coincide with port extension openings 1021-1024, respectively, of upper restrictor plate 7000. Port extension openings 1121-1122 may be disposed toward an end 7143 of lower restrictor plate 7100, and port extension openings 1123-1124 may be disposed toward the other end 7144 of lower restrictor plate 7100.

Figure 72:
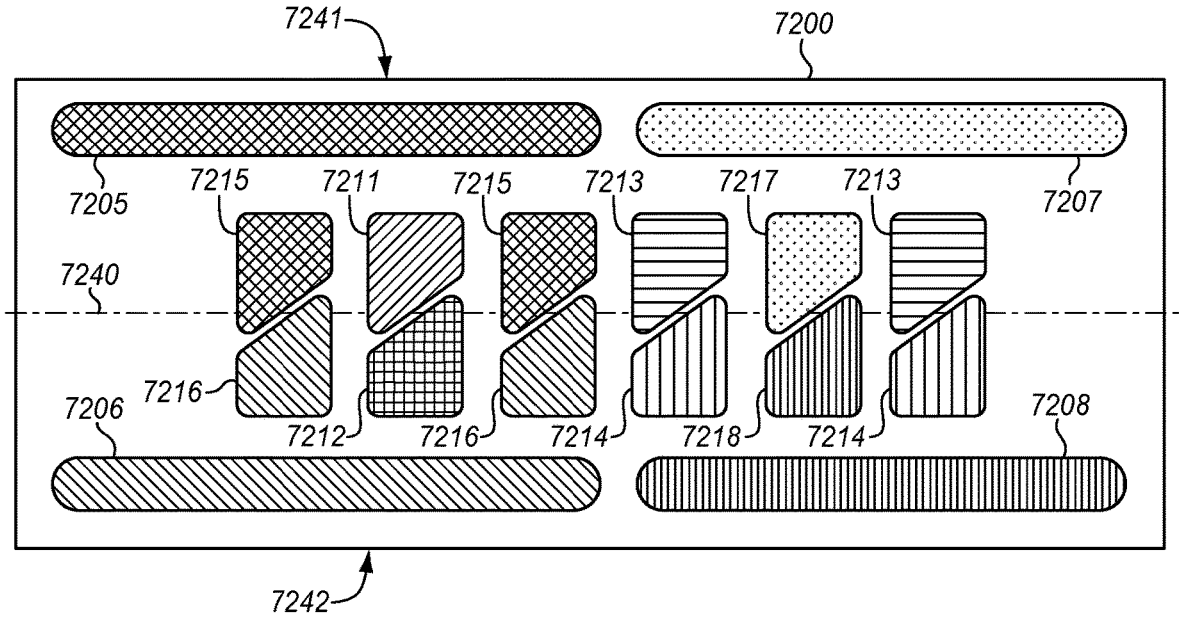
FIG. 72 is a plan view of a chamber plate in an illustrative embodiment.

FIG. 72 is a plan view of chamber plate 7200 in an illustrative embodiment. Chamber plate 7200 is a thin sheet of material that is generally rectangular in shape and is substantially flat or planar. Chamber plate 7200 includes chamber openings 7211-7218 disposed toward a middle region of chamber plate 7200. Chamber openings 7211-7218 are aligned in two longitudinal rows. A chamber opening in one row is aligned with a chamber opening in the other row. However, chamber openings 7211-7218 each extend across a longitudinal center line 7240 of chamber plate 7200. Chamber plate 7200 further includes manifold openings 7205-7208, which comprise elongated apertures or holes through chamber plate 7200 disposed longitudinally along a length of chamber plate 7200. Manifold opening 7205 is configured to fluidly couple with port extension opening 1121 in lower restrictor plate 7100 to form a lower supply manifold (e.g., supply manifold 515). Manifold opening 7206 is configured to fluidly couple with port extension opening 1122 in lower restrictor plate 7100 to form another lower supply manifold (e.g., supply manifold 516). Manifold opening 7207 is configured to fluidly couple with port extension opening 1123 in lower restrictor plate 7100 to form another lower supply manifold (e.g., supply manifold 517). Manifold opening 7208 is configured to fluidly couple with port extension opening 1124 in lower restrictor plate 7100 to form another lower supply manifold (e.g., supply manifold 518). Manifold openings 7205 and 7207 are disposed toward long side 7241 of chamber plate 7200 (i.e., between chamber openings 7211-7218 and long side 7241), and are longitudinally aligned. Manifold openings 7206 and 7208 are disposed toward long side 7242 of chamber plate 7200 (i.e., between chamber openings 7211-7218 and long side 7242), and are longitudinally aligned.

Figure 73:
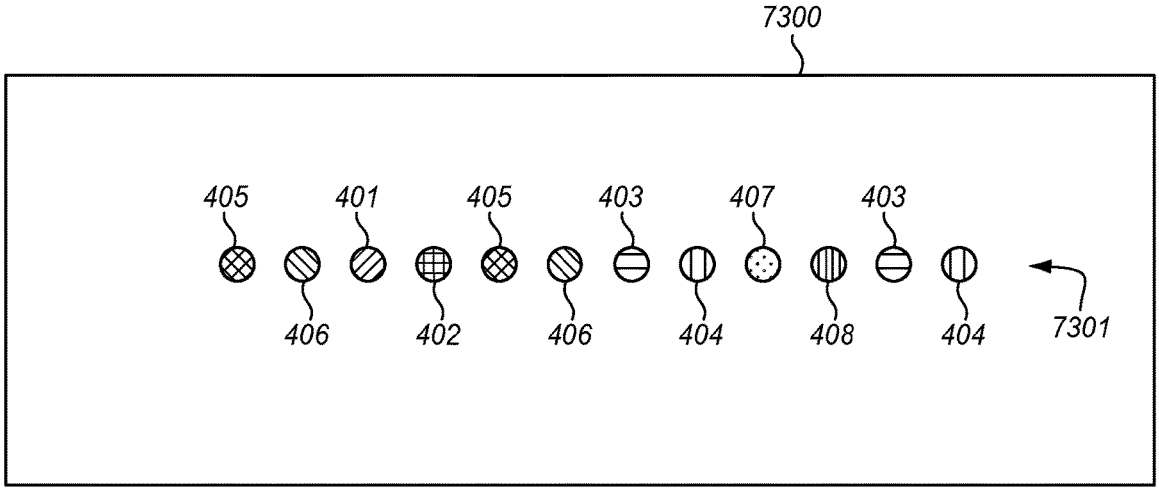
FIG. 73 is a plan view of a nozzle plate in an illustrative embodiment.

FIG. 73 is a plan view of nozzle plate 7300 in an illustrative embodiment. Nozzle plate 7300 is a thin sheet of material that is generally rectangular in shape and is substantially flat or planar. Nozzle plate 7300 includes orifices that form nozzles 401-408 of the jetting channels in a single nozzle row 7301.

Figure 74:
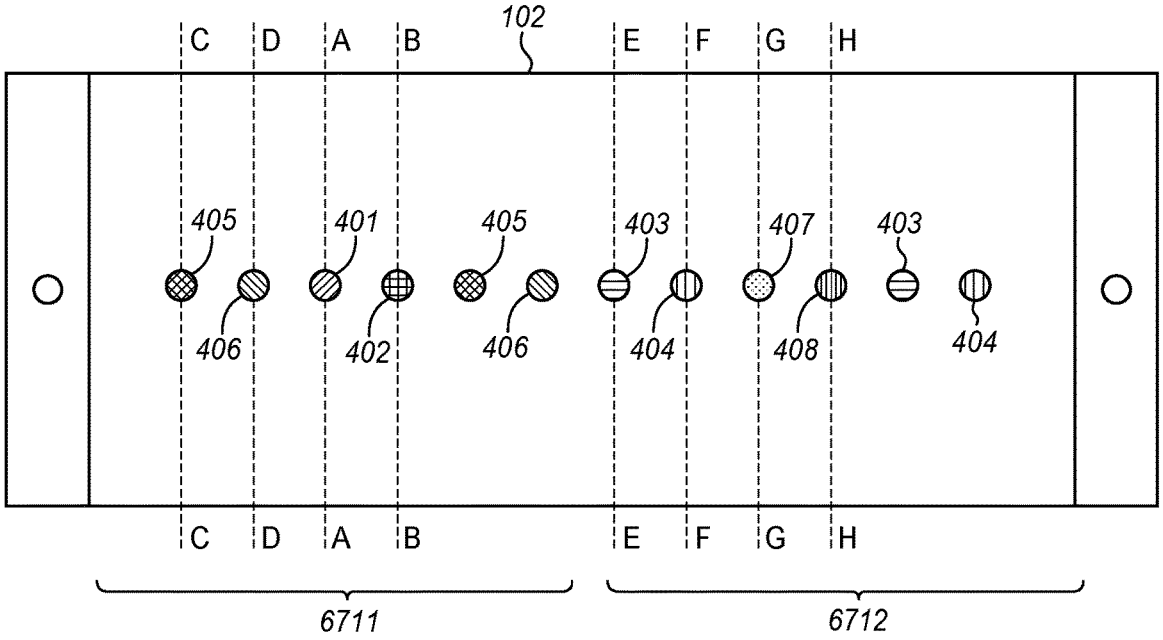
FIG. 74 is a bottom view of a head member in an illustrative embodiment.

FIG. 74 is a bottom view of head member 102 in an illustrative embodiment. Shown in FIG. 74 are a single row of nozzles 401-408 associated with jetting channels. Head member 102 is shown as being schematically divided into half-sections 6711-6712 as was shown in FIG. 67.

Figure 75:
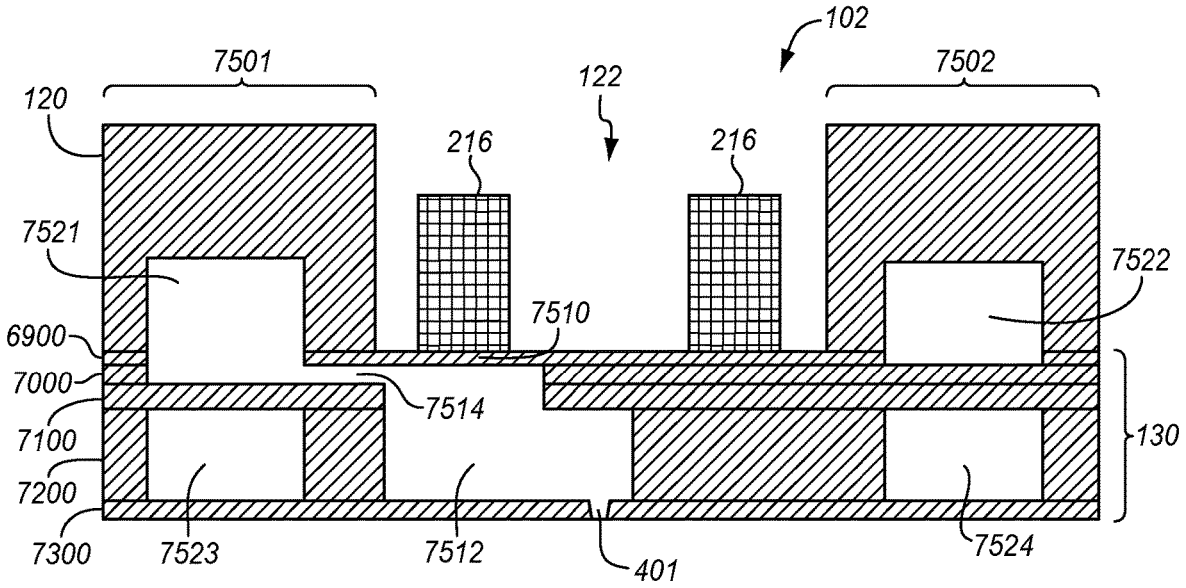
FIGS. 75-82 are cross-sectional views of a head member in an illustrative embodiment.

FIGS. 75-78 are cross-sectional views of half-section 6711 of head member 102 in an illustrative embodiment. The view in FIG. 75 is across cut plane A-A in FIG. 74. From top to bottom in FIG. 75, head member 102 includes housing 120, diaphragm plate 6900, upper restrictor plate 7000, lower restrictor plate 7100, chamber plate 7200, and nozzle plate 7300. For half-section 6711, head member 102 includes a pair of upper supply manifolds 7521-7522, and a pair of lower supply manifolds 7523-7524. Although not visible in FIG. 75, upper supply manifolds 7521-7522 and lower supply manifolds 7523-7524 run partially along the length of head member 102 within half-section 6711. For example, upper supply manifold 7521 may correspond with supply manifold 511 in FIG. 67, upper supply manifold 7522 may correspond with supply manifold 512, lower supply manifold 7523 may correspond with supply manifold 515, and lower supply manifold 7524 may correspond with supply manifold 516.

In this embodiment, upper supply manifold 7521 is disposed longitudinally on one side 7501 of head member 102 (i.e., one side of the jetting channel(s)), and upper supply manifold 7522 is disposed longitudinally on the other side 7502 of head member 102. Upper supply manifold 7521 is formed with manifold duct 801 in housing 120 and manifold opening 901 of diaphragm plate 6900, and upper supply manifold 7522 is formed with manifold duct 802 in housing 120 and manifold openings 902 of diaphragm plate 6900 as shown in FIGS. 68-69. Lower supply manifold 7523 is disposed longitudinally on one side 7501 of head member 102, and lower supply manifold 7524 is disposed longitudinally on the other side 7502 of head member 102. Lower supply manifold 7523 is formed with manifold opening 7205 of chamber plate 7200, and lower supply manifold 7524 is formed with manifold opening 7206 of chamber plate 7200 as shown in FIG. 72. Upper supply manifold 7521 and lower supply manifold 7523 are vertically stacked or aligned within head member 102, and upper supply manifold 7522 and lower supply manifold 7524 are vertically stacked or aligned within head member 102.

Plate stack 130 forms a jetting channel for nozzle 401. The jetting channel includes diaphragm 7510, pressure chamber 7512, and nozzle 401. Pressure chamber 7512 is fluidly coupled to upper supply manifold 7521 via restrictor 7514 (formed with restrictor opening 7011 in FIG. 70). Restrictor 7514 controls the flow of print fluid from upper supply manifold 7521 to pressure chamber 7512. Actuation by actuator 216 will cause the print fluid to be ejected out of the jetting channel through nozzle 401. The jetting channel for nozzle 401 is fluidly coupled to upper supply manifold 7521, and is fluidly isolated from the other supply manifolds so that it receives one type of print fluid.

Figure 76:
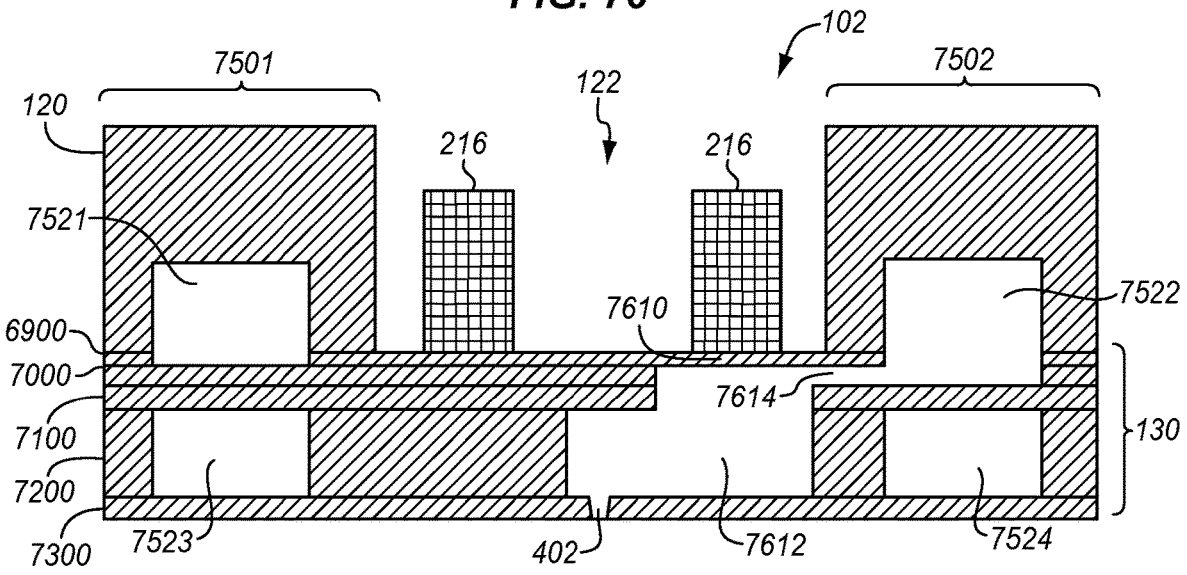

The view in FIG. 76 is across cut plane B-B in FIG. 74, showing a jetting channel for nozzle 402. The jetting channel includes diaphragm 7610, pressure chamber 7612, and nozzle 402. Pressure chamber 7612 is fluidly coupled to upper supply manifold 7522 via restrictor 7614 (formed with restrictor opening 7012 in FIG. 70). Restrictor 7614 controls the flow of print fluid from upper supply manifold 7522 to pressure chamber 7612. Actuation by actuator 216 will cause the print fluid to be ejected out of the jetting channel through nozzle 402. The jetting channel for nozzle 402 is fluidly coupled to upper supply manifold 7522, and is fluidly isolated from the other supply manifolds so that it receives one type of print fluid.

Figure 77:
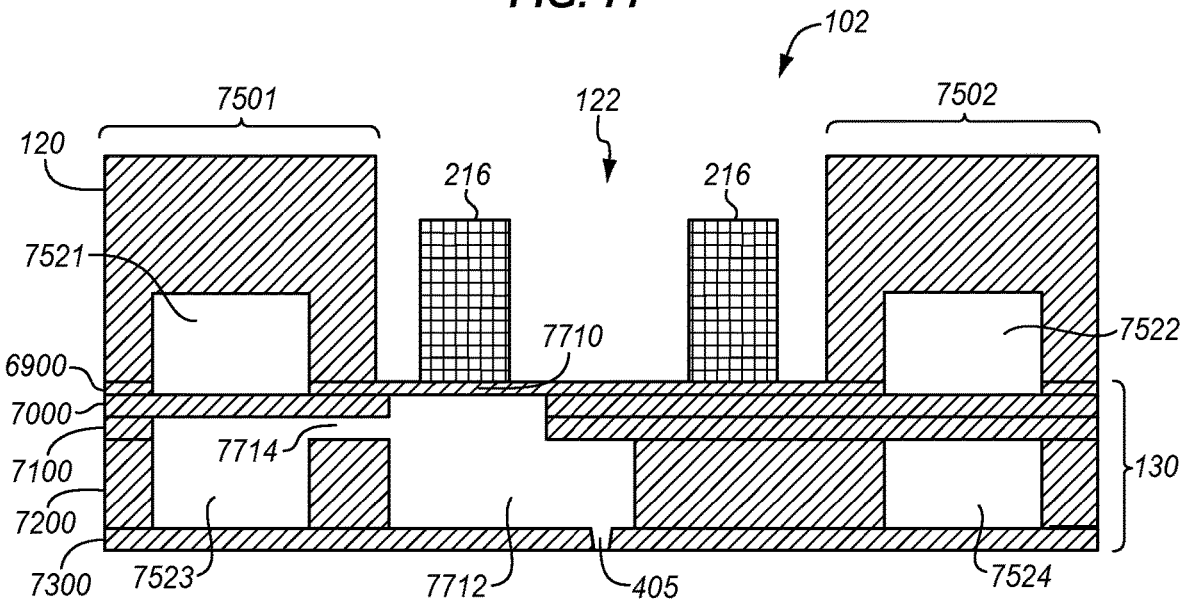

The view in FIG. 77 is across cut plane C-C in FIG. 74, showing a jetting channel for nozzle 405. The jetting channel includes diaphragm 7710, pressure chamber 7712, and nozzle 405. Pressure chamber 7712 is fluidly coupled to lower supply manifold 7523 via restrictor 7714 (formed with restrictor opening 7115 in FIG. 71). Restrictor 7714 controls the flow of print fluid from lower supply manifold 7523 to pressure chamber 7712. Actuation by actuator 216 will cause the print fluid to be ejected out of the jetting channel through nozzle 405. The jetting channel for nozzle 405 is fluidly coupled to lower supply manifold 7523, and is fluidly isolated from the other supply manifolds so that it receives one type of print fluid.

Figure 78:
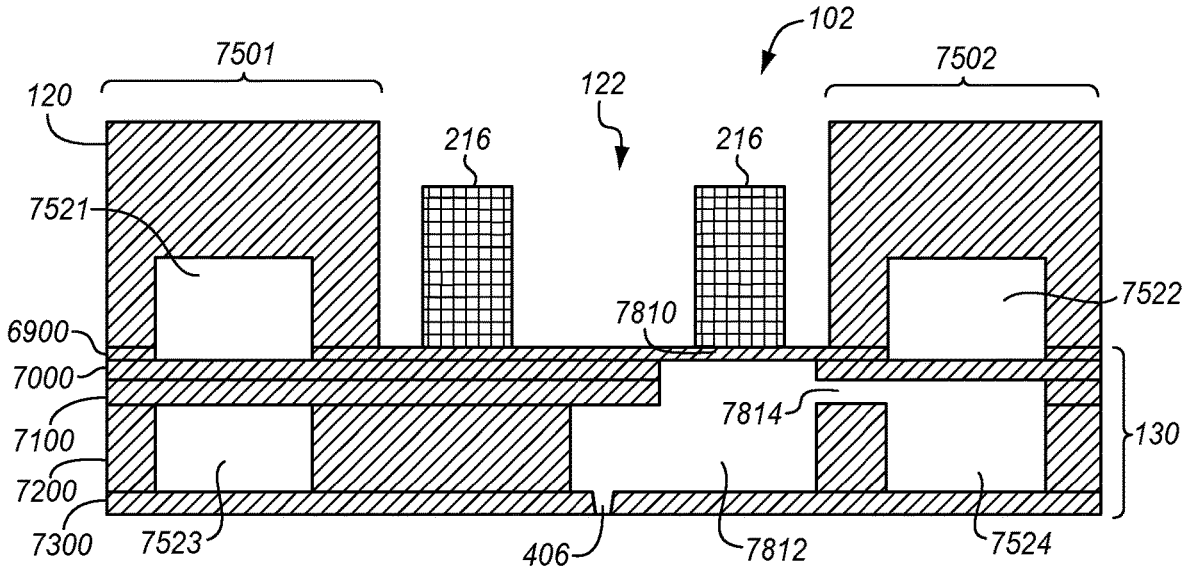

The view in FIG. 78 is across cut plane D-D in FIG. 74, showing a jetting channel for nozzle 406. The jetting channel includes diaphragm 7810, pressure chamber 7812, and nozzle 406. Pressure chamber 7812 is fluidly coupled to lower supply manifold 7524 via restrictor 7814 (formed with restrictor opening 7116 in FIG. 71). Restrictor 7814 controls the flow of print fluid from lower supply manifold 7524 to pressure chamber 7812. Actuation by actuator 216 will cause the print fluid to be ejected out of the jetting channel through nozzle 406. The jetting channel for nozzle 406 is fluidly coupled to lower supply manifold 7524, and is fluidly isolated from the other supply manifolds so that it receives one type of print fluid.

Figure 79:
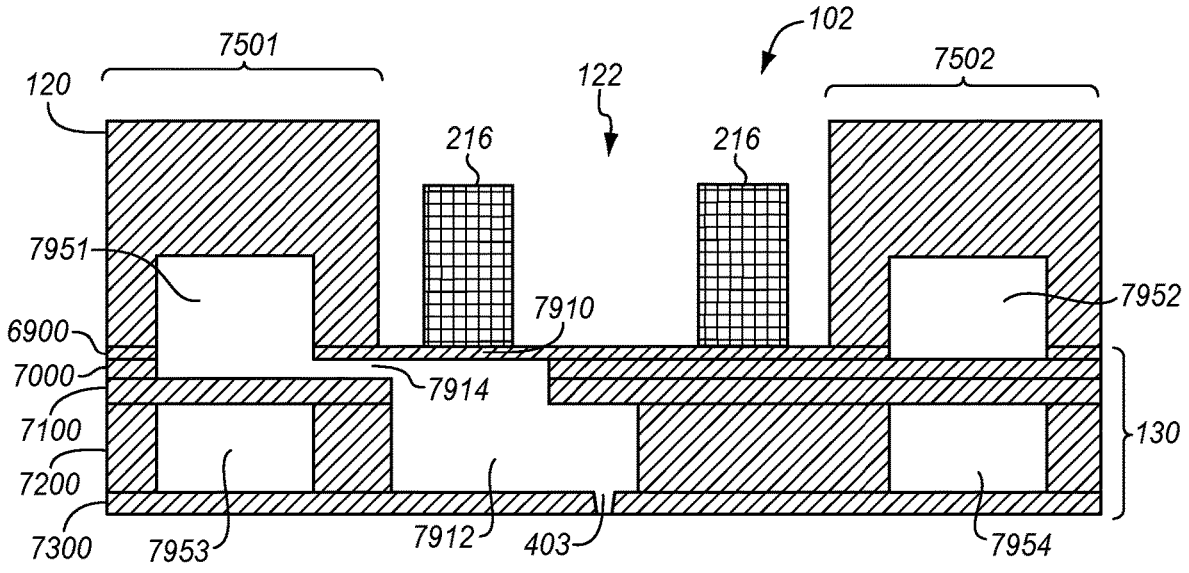

FIGS. 79-82 are cross-sectional views of half-section 6712 of head member 102 in an illustrative embodiment. The view in FIG. 79 is across cut plane E-E in FIG. 74. Half-section 6712 may include a different set of supply manifolds than half-section 6711. For half-section 6712, head member 102 includes a pair of upper supply manifolds 7951-7952, and a pair of lower supply manifolds 7953-7954. Although not visible in FIG. 79, upper supply manifolds 7951-7952 and lower supply manifolds 7953-7954 run partially along the length of head member 102. For example, upper supply manifold 7951 may correspond with supply manifold 513 in FIG. 67, upper supply manifold 7952 may correspond with supply manifold 514, lower supply manifold 7953 may correspond with supply manifold 517, and lower supply manifold 7954 may correspond with supply manifold 518.

In this embodiment, upper supply manifold 7951 is disposed longitudinally on one side 7501 of head member 102, and upper supply manifold 7952 is disposed longitudinally on the other side 7502 of head member 102. Upper supply manifold 7951 is formed with manifold duct 803 in housing 120 and manifold opening 903 of diaphragm plate 6900, and upper supply manifold 7952 is formed with manifold duct 804 in housing 120 and manifold opening 904 of diaphragm plate 6900 as shown in FIGS. 68-69. Lower supply manifold 7953 is disposed longitudinally on one side 7501 of head member 102, and lower supply manifold 7954 is disposed longitudinally on the other side 7502 of head member 102. Lower supply manifold 7953 is formed with manifold opening 7207 of chamber plate 7200, and lower supply manifold 7954 is formed with manifold opening 7208 of chamber plate 7200 as shown in FIG. 72. Upper supply manifold 7951 and lower supply manifold 7953 are vertically stacked or aligned within head member 102, and upper supply manifold 7952 and lower supply manifold 7954 are vertically stacked or aligned within head member 102.

Plate stack 130 forms a jetting channel for nozzle 403. The jetting channel includes diaphragm 7910, pressure chamber 7912, and nozzle 403. Pressure chamber 7912 is fluidly coupled to upper supply manifold 7951 via restrictor 7914 (formed with restrictor opening 7013 in FIG. 70). Restrictor 7914 controls the flow of print fluid from upper supply manifold 7951 to pressure chamber 7912. Actuation by actuator 216 will cause the print fluid to be ejected out of the jetting channel through nozzle 403. The jetting channel for nozzle 403 is fluidly coupled to upper supply manifold 7951, and is fluidly isolated from the other supply manifolds so that it receives one type of print fluid.

Figure 80:
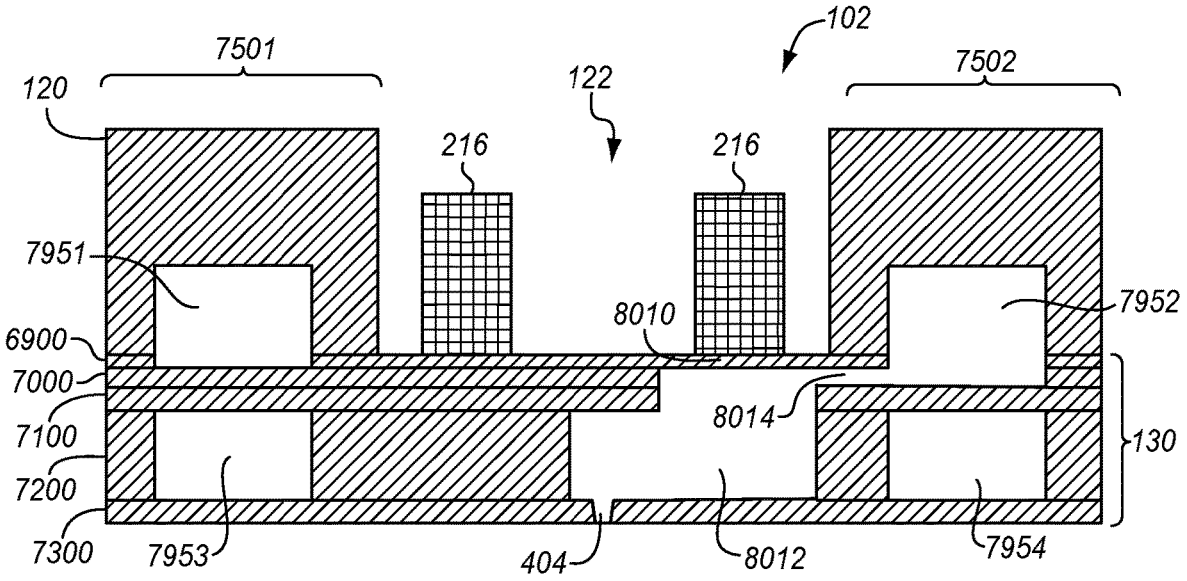

The view in FIG. 80 is across cut plane F-F in FIG. 74, showing a jetting channel for nozzle 404. The jetting channel includes diaphragm 8010, pressure chamber 8012, and nozzle 404. Pressure chamber 8012 is fluidly coupled to upper supply manifold 7952 via restrictor 8014 (formed with restrictor opening 7014 in FIG. 70). Restrictor 8014 controls the flow of print fluid from upper supply manifold 7952 to pressure chamber 8012. Actuation by actuator 216 will cause the print fluid to be ejected out of the jetting channel through nozzle 404. The jetting channel for nozzle 404 is fluidly coupled to upper supply manifold 7952, and is fluidly isolated from the other supply manifolds so that it receives one type of print fluid.

Figure 81:
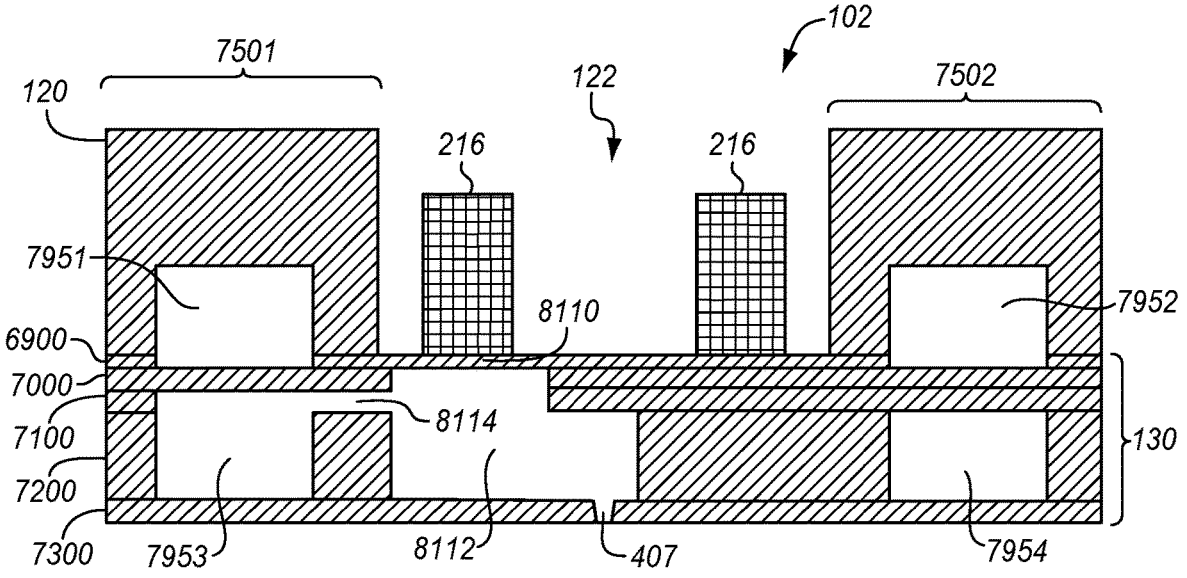

The view in FIG. 81 is across cut plane G-G in FIG. 74, showing a jetting channel for nozzle 407. The jetting channel includes diaphragm 8110, pressure chamber 8112, and nozzle 407. Pressure chamber 8112 is fluidly coupled to lower supply manifold 7953 via restrictor 8114 (formed with restrictor opening 7117 in FIG. 71). Restrictor 8114 controls the flow of print fluid from lower supply manifold 7953 to pressure chamber 8112. Actuation by actuator 216 will cause the print fluid to be ejected out of the jetting channel through nozzle 407. The jetting channel for nozzle 407 is fluidly coupled to lower supply manifold 7953, and is fluidly isolated from the other supply manifolds so that it receives one type of print fluid.

Figure 82:
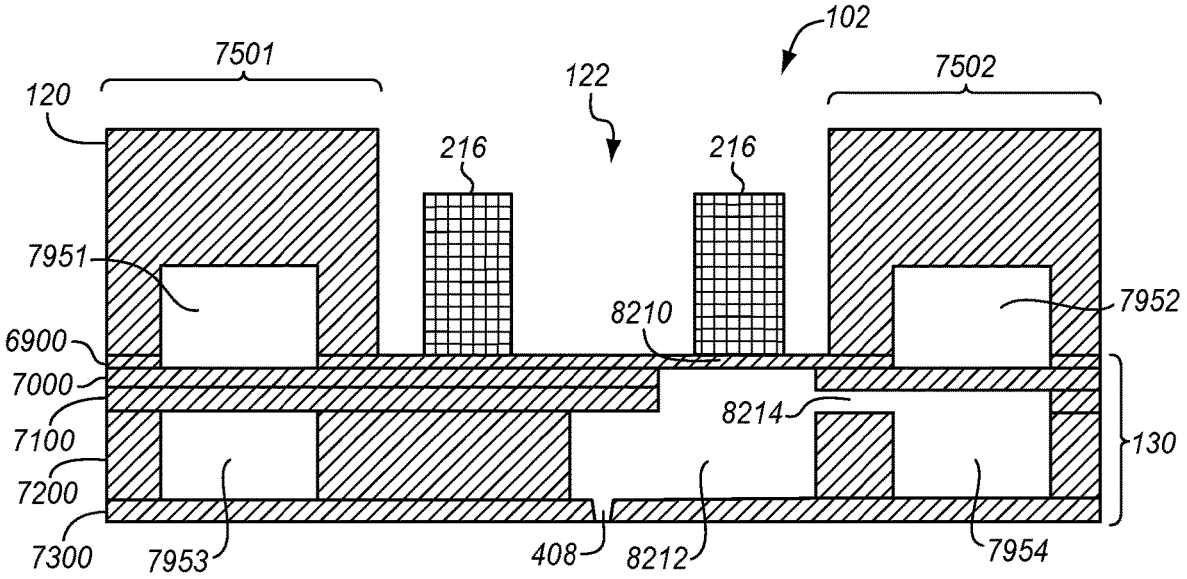

The view in FIG. 82 is across cut plane H-H in FIG. 74, showing a jetting channel for nozzle 408. The jetting channel includes diaphragm 8210, pressure chamber 8212, and nozzle 408. Pressure chamber 8212 is fluidly coupled to lower supply manifold 7954 via restrictor 8214 (formed with restrictor opening 7118 in FIG. 71). Restrictor 8214 controls the flow of print fluid from lower supply manifold 7954 to pressure chamber 8212. Actuation by actuator 216 will cause the print fluid to be ejected out of the jetting channel through nozzle 408. The jetting channel for nozzle 408 is fluidly coupled to lower supply manifold 7954, and is fluidly isolated from the other supply manifolds so that it receives one type of print fluid.

Although specific embodiments were described herein, the scope of the invention is not limited to those specific embodiments. The scope of the invention is defined by the following claims and any equivalents thereof.

What is claimed is:

1. A printhead comprising:

inlet ports each configured to receive one of eight or more types of print fluids; and a plurality of nozzles arranged in one or two nozzle rows, wherein each of the nozzles is fluidly coupled to one of the inlet ports;

wherein, in groupings of eight or more adjacent nozzles of the plurality, the adjacent nozzles are each configured to jet a different one of the types of print fluids.

2. The printhead of claim 1 further comprising:

supply manifolds disposed within the printhead;

wherein a first one of the supply manifolds is fluidly coupled to a first one of the inlet ports, and to a first subset of the nozzles;

wherein a second one of the supply manifolds is fluidly coupled to a second one of the inlet ports, and to a second subset of the nozzles;

wherein a third one of the supply manifolds is fluidly coupled to a third one of the inlet ports, and to a third subset of the nozzles;

wherein a fourth one of the supply manifolds is fluidly coupled to a fourth one of the inlet ports, and to a fourth subset of the nozzles;

wherein a fifth one of the supply manifolds is fluidly coupled to a fifth one of the inlet ports, and to a fifth subset of the nozzles;

wherein a sixth one of the supply manifolds is fluidly coupled to a sixth one of the inlet ports, and to a sixth subset of the nozzles;

wherein a seventh one of the supply manifolds is fluidly coupled to a seventh one of the inlet ports, and to a seventh subset of the nozzles; and wherein an eighth one of the supply manifolds is fluidly coupled to an eighth one of the inlet ports, and to an eighth subset of the nozzles.

3. The printhead of claim 2 wherein:

the nozzles are arranged longitudinally along the printhead;

the first one of the supply manifolds and the third one of the supply manifolds comprise upper supply manifolds disposed longitudinally along a first side of the printhead; and the second one of the supply manifolds and the fourth one of the supply manifolds comprise upper supply manifolds disposed longitudinally along a second side of the printhead.

4. The printhead of claim 3 wherein:

the fifth one of the supply manifolds and the seventh one of the supply manifolds comprise lower supply manifolds disposed longitudinally along the first side of the printhead; and the sixth one of the supply manifolds and the eighth one of the supply manifolds comprise lower supply manifolds disposed longitudinally along the second side of the printhead.

5. The printhead of claim 4 wherein:

the first one of the supply manifolds and the fifth one of the supply manifolds are vertically aligned on the first side of the printhead;

the third one of the supply manifolds and the seventh one of the supply manifolds are vertically aligned on the first side of the printhead;

the second one of the supply manifolds and the sixth one of the supply manifolds are vertically aligned on the second side of the printhead; and the fourth one of the supply manifolds and the eighth one of the supply manifolds are vertically aligned on the second side of the printhead.

6. The printhead of claim 1 wherein:

the nozzles are arranged in two nozzle rows, and the nozzles in a first one of the nozzle rows are offset from the nozzles in a second one of the nozzle rows.

7. The printhead of claim 1 wherein:

the types of print fluids comprise different colors of ink; and the adjacent nozzles in the groupings are each configured to jet a different color of ink.

8. A printhead comprising:

a housing having inlet ports disposed at a top surface; and a plate stack attached to an interface surface of the housing, the plate stack comprising:

a diaphragm plate that forms diaphragms for jetting channels of the printhead;

an upper restrictor plate;

an upper chamber plate;

a lower restrictor plate;

a lower chamber plate; and a nozzle plate having nozzles arranged in one or two nozzle rows for the jetting channels;

wherein the housing and the plate stack form a first upper supply manifold fluidly coupled to a first one of the inlet ports and a first subset of the jetting channels, a second upper supply manifold fluidly coupled to a second one of the inlet ports and a second subset of the jetting channels, a third upper supply manifold fluidly coupled to a third one of the inlet ports and a third subset of the jetting channels, and a fourth upper supply manifold fluidly coupled to a fourth one of the inlet ports and a fourth subset of the jetting channels;

wherein the housing and the plate stack form a first lower supply manifold fluidly coupled to a fifth one of the inlet ports and a fifth subset of the jetting channels, a second lower supply manifold fluidly coupled to a sixth one of the inlet ports and a sixth subset of the jetting channels, a third lower supply manifold fluidly coupled to a seventh one of the inlet ports and a seventh subset of the jetting channels, and a fourth lower supply manifold fluidly coupled to an eighth one of the inlet ports and an eighth subset of the jetting channels.

9. The printhead of claim 8 wherein:

the nozzles are arranged longitudinally along the printhead;

the first upper supply manifold, the third upper supply manifold, the first lower supply manifold, and the third lower supply manifold are disposed longitudinally along a first side of the printhead; and the second upper supply manifold, the fourth upper supply manifold, the second lower supply manifold, and the fourth lower supply manifold are disposed longitudinally along a second side of the printhead.

10. The printhead of claim 8 wherein:

the housing includes:

an access hole that extends from the interface surface through to the top surface; and manifold ducts disposed longitudinally along the interface surface on opposite sides of the access hole;

a first one of the manifold ducts is disposed along a first side of the access hole, and forms the first upper supply manifold;

a second one of the manifold ducts is disposed along a second side of the access hole, and forms the second upper supply manifold;

a third one of the manifold ducts is disposed along the first side of the access hole in parallel with the first one of the manifold ducts, and forms the third upper supply manifold; and a fourth one of the manifold ducts is disposed along the second side of the access hole in parallel with the second one of the manifold ducts, and forms the fourth upper supply manifold.

11. The printhead of claim 10 wherein:

the diaphragm plate includes:

first manifold openings fluidly coupled with the first one of the manifold ducts, second manifold openings fluidly coupled with the second one of the manifold ducts, third manifold openings fluidly coupled with the third one of the manifold ducts, and fourth manifold openings fluidly coupled with the fourth one of the manifold ducts; and port extension openings each fluidly coupled to one of the inlet ports.

12. The printhead of claim 11 wherein:

the upper restrictor plate includes:

restrictor openings for the first subset of the jetting channels, the second subset of the jetting channels, the third subset of the jetting channels, the fourth subset of the jetting channels, the seventh subset of the jetting channels, and the eighth subset of the jetting channels;

chamber openings for the fifth subset of the jetting channels, and the sixth subset of the jetting channels; and port extension openings that coincide with the port extension openings of the diaphragm plate.

13. The printhead of claim 12 wherein:

the upper chamber plate includes:

chamber openings for each of the subsets of the jetting channels; and port extension openings that coincide with the port extension openings of the upper restrictor plate.

14. The printhead of claim 13 wherein:

the lower restrictor plate includes:

restrictor openings for the fifth subset of the jetting channels, and the sixth subset of the jetting channels;

chamber openings for the first subset of the jetting channels, the second subset of the jetting channels, the third subset of the jetting channels, the fourth subset of the jetting channels, the seventh subset of the jetting channels, and the eighth subset of the jetting channels; and port extension openings that coincide with the port extension openings of the upper chamber plate.

15. The printhead of claim 14 wherein:

the lower chamber plate includes:

chamber openings for each of the subsets of the jetting channels; and manifold openings disposed longitudinally;

a first one of the manifold openings is disposed along a first side of the chamber openings, and forms the first lower supply manifold;

a second one of the manifold openings is disposed along a second side of the chamber openings, and forms the second lower supply manifold;

a third one of the manifold openings is disposed along the first side of the chamber openings in parallel with the first one of the manifold openings, and forms the third lower supply manifold; and a fourth one of the manifold openings is disposed along the second side of the chamber openings in parallel with the second one of the manifold openings, and forms the fourth lower supply manifold.

16. A printhead comprising:

inlet ports each configured to receive one of eight or more types of print fluids;

a plurality of nozzles arranged in one or two nozzle rows, wherein each of the nozzles is fluidly coupled to one of the inlet ports; and supply manifolds;

wherein the supply manifolds include a first upper supply manifold fluidly coupled to a first one of the inlet ports and a first subset of the nozzles, a second upper supply manifold fluidly coupled to a second one of the inlet ports and a second subset of the nozzles, a third upper supply manifold fluidly coupled to a third one of the inlet ports and a third subset of the nozzles, and a fourth upper supply manifold fluidly coupled to a fourth one of the inlet ports and a fourth subset of the nozzles;

wherein the supply manifolds further include a first lower supply manifold fluidly coupled to a fifth one of the inlet ports and a fifth subset of the nozzles, a second lower supply manifold fluidly coupled to a sixth one of the inlet ports and a sixth subset of the nozzles, a third lower supply manifold fluidly coupled to a seventh one of the inlet ports and a seventh subset of the nozzles, and a fourth lower supply manifold fluidly coupled to an eighth one of the inlet ports and an eighth subset of the nozzles.

17. The printhead of claim 16 wherein:

the first upper supply manifold is disposed longitudinally along a first side of the nozzles within a first half section of the printhead, the third upper supply manifold is disposed longitudinally along the first side within a second half section of the printhead, and the first upper supply manifold and the third upper supply manifold are longitudinally aligned along the first side; and the second upper supply manifold is disposed longitudinally along a second side of the nozzles within the first half section of the printhead, the fourth upper supply manifold is disposed longitudinally along the second side within the second half section of the printhead, and the second upper supply manifold and the fourth upper supply manifold are longitudinally aligned along the second side.

18. The printhead of claim 17 wherein:

the first lower supply manifold is disposed longitudinally along the first side of the nozzles within the first half section of the printhead, the third lower supply manifold is disposed longitudinally along the first side within the second half section of the printhead, and the first lower supply manifold and the third lower supply manifold are longitudinally aligned along the first side; and the second lower supply manifold is disposed longitudinally along the second side of the nozzles within the first half section of the printhead, the fourth lower supply manifold is disposed longitudinally along the second side within the second half section of the printhead, and the second lower supply manifold and the fourth lower supply manifold are longitudinally aligned along the second side.

19. The printhead of claim 18 wherein:

the first upper supply manifold and the first lower supply manifold are vertically aligned within the first half section;

the second upper supply manifold and the second lower supply manifold are vertically aligned within the first half section;

the third upper supply manifold and the third lower supply manifold are vertically aligned within the second half section; and the fourth upper supply manifold and the fourth lower supply manifold are vertically aligned within the second half section.

20. The printhead of claim 16 wherein:

the nozzles are arranged in a single nozzle row.

* * * * *